US008413347B2

(12) United States Patent
Gress et al.

(10) Patent No.: US 8,413,347 B2
(45) **Date of Patent: *Apr. 9, 2013**

(54) DRAIN CLEANING APPARATUS WITH ELECTRONIC CABLE MONITORING SYSTEM

(75) Inventors: Paul W. Gress, Bay Village, OH (US); Michael J. Rutkowski, Brunswick, OH (US); Philip Eisermann, Winnabow, NC (US); Mark S. Olsson, La Jolla, CA (US); Ray Merewether, La Jolla, CA (US); Jeffrey A. Prsha, San Diego, CA (US)

(73) Assignee: Emerson Electric Co., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/447,799

(22) Filed: Apr. 16, 2012

(65) Prior Publication Data

US 2012/0203501 A1 Aug. 9, 2012

Related U.S. Application Data

(60) Division of application No. 12/469,757, filed on May 21, 2009, now Pat. No. 8,176,593, which is a continuation-in-part of application No. 12/188,433, filed on Aug. 8, 2008, now Pat. No. 8,046, 862.

(60) Provisional application No. 61/055,391, filed on May 22, 2008.

(51) Int. Cl.
*B08B 9/04* (2006.01)

(52) U.S. Cl.
USPC ..... 33/733; 33/732; 33/743; 33/1 PT; 15/104.33; 242/563.2; 254/134.3 FT

(58) Field of Classification Search ..... 33/733, 33/732, 750, 1 PT, 743; 242/563.2; 15/104.31, 15/104.33; 254/134.3 FT
See application file for complete search history.

(56) References Cited

U.S. PATENT DOCUMENTS 2,468,490 A 4/1949 Di Joseph
2,730,740 A 1/1956 O'Brien (Continued)

FOREIGN PATENT DOCUMENTS

WO 2008/079702 7/2008

OTHER PUBLICATIONS

International Search Report, Dec. 16, 2009 (10 pages) for PCT/US2009/045089.

*Primary Examiner* — Christopher Fulton
(74) *Attorney, Agent, or Firm* — Rankin, Hill & Clark LLP

(57) ABSTRACT

A drain cleaning machine with an electronic cable monitoring system is disclosed which comprises a frame supporting a rotatable drum which is driven by a motor through an endless belt. The drum contains a flexible drain cleaning cable which is rotatable with the drum and axially displaceable into and out from the drum, and the frame supports a cable feeding device through which the cable extends and by which the cable is displaced into and out of the drum. An electronic cable monitoring system is configured to assess an amount of cable payed out from and retracted into the drum. A process determines an amount and direction of relative movement between a rotatable drum and a cable follower member and generates a signal representative of an amount of cable payed out or retracted into the drum.

3 Claims, 35 Drawing Sheets

U.S. PATENT DOCUMENTS

| | | | | |
|---|---|---|---|---|
| 2,930,584 | A | | 3/1960 | Hamrick et al. |
| 3,007,186 | A | | 11/1961 | Olsson |
| 3,078,486 | A | | 2/1963 | Casto et al. |
| 3,095,592 | A | | 7/1963 | Hunt |
| 3,134,119 | A | | 5/1964 | Criscuolo |
| 3,246,354 | A | | 4/1966 | Cooney et al. |
| 3,394,422 | A | | 7/1968 | Siegal |
| 3,585,076 | A | | 6/1971 | Prange |
| 4,092,780 | A | | 6/1978 | Trethewey et al. |
| 4,364,139 | A | | 12/1982 | Babb et al. |
| 4,540,017 | A | | 9/1985 | Prange |
| 4,546,519 | A | | 10/1985 | Pembroke |
| 4,580,306 | A | | 4/1986 | Irwin |
| 5,009,242 | A | | 4/1991 | Prange |
| 5,031,276 | A | | 7/1991 | Babb et al. |
| 5,199,129 | A | | 4/1993 | Salecker et al. |
| 5,526,975 | A | * | 6/1996 | Endo ..... 228/103 |
| 6,009,588 | A | | 1/2000 | Rutkowski |
| 6,016,609 | A | | 1/2000 | Donovan et al. |
| 6,056,218 | A | | 5/2000 | Nanbu |
| 6,076,219 | A | | 6/2000 | Irwin |
| 6,269,547 | B1 | | 8/2001 | Chuang |
| 6,640,451 | B1 | * | 11/2003 | Vinarcik ..... 33/1 PT |
| 7,007,399 | B2 | * | 3/2006 | Catalano ..... 33/735 |
| 7,263,782 | B2 | * | 9/2007 | Steinich ..... 33/732 |
| 8,046,862 | B2 | * | 11/2011 | Eisermann et al. ..... 15/104.33 |
| 8,176,593 | B2 | * | 5/2012 | Gress et al. ..... 15/104.33 |
| 2008/0148503 | A1 | | 6/2008 | Babb et al. |

* cited by examiner

DRAIN CLEANING APPARATUS WITH ELECTRONIC CABLE MONITORING SYSTEM

CROSS REFERENCES TO RELATED APPLICATIONS

This application is a divisional and claims priority from U.S. application Ser. No. 12/469,757 filed May 21, 2009, now U.S. Pat. No. 8,176,593 issued May 15, 2012, which is a continuation in part of and claims priority from U.S. application Ser. No. 12/188,433 filed Aug. 8, 2008, now U.S. Pat. No. 8,046,862 issued Nov. 1, 2012, and also claims priority from U.S. provisional application Ser. No. 61/055,391 filed May 22, 2008.

FIELD OF THE INVENTION

The present invention relates to devices, systems and methods for feeding cable or similar elements into and through conduits, pipelines, or drainage systems for purposes of cleaning, clearing, or repair. More specifically, the present invention relates to monitoring systems used with drain cleaning machines to measure cable lengths fed into such pipes or conduits, and provide information to the machine's operator as to the advancement of the cable into a pipe or conduit.

BACKGROUND

Drum type sewer cleaning machines of the type to which the present invention is directed are well known and are shown, for example, in U.S. Pat. Nos. 2,468,490 to DiJoseph; 2,730,740 to O'Brien; 3,007,186 to Olsson; 3,394,422 to Siegal; 3,095,592 to Hunt; 3,134,119 to Criscuolo; 3,246,354 to Cooney, et al.; 4,364,139 to Babb, et al.; 4,580,306 to Irwin; 5,031,276 to Babb, et al.; and, 6,009,588 to Rutkowski. As will be seen from these patents, it is known to provide a drum type sewer cleaning machine comprising a frame structure supporting a rotatable drum and a drive motor arrangement for rotating the drum and a cable stored within the drum, and to provide for the drum to be removable from the frame and drive arrangement to, for example, facilitate replacement of the drum with one containing a cable having a different diameter. It will also be seen from these prior art patents that such drum type sewer cleaning machines may include a cable feeding arrangement supported by the frame and by which the cable is adapted to be axially displaced relative to the drum during use of the machine. In these feeding devices, typically, a set of stationary roller wheels are moved into selective engagement with the rotating cable. The wheels are held at an angle relative to the rotational axis of the cable to thereby axially urge the cable out from and into the rotating carrier member where it is stored.

Simple devices for monitoring the length of cable material payed out from a sewer or drain cleaning machine are also known in the art, such as noted in U.S. Pat. Nos. 3,394,422 to Siegal; 4,546,519 to Pembroke; 4,540,017 to Prange; and 5,009,242 to Prange. These patents are generally concerned with measuring the length of a cable displaced into a drain being cleaned. However, in these patents, the cable material in the sewer cleaning device is not rotated about its axis, and is not in the form of a helically wound member. In addition, in several of these patents, the cable counting device requires a direct physical contact with the drain cleaning cable which could in some circumstances cause the counting device to become contaminated by debris carried by the drain cleaning cable. Thus, these devices are somewhat limited and, further, do not encounter the same problems as are encountered in connection with monitoring the displacement of such a rotating cable coiled inside a rotating drum.

Accordingly, there is a need for an electronic cable monitoring system configured to assess an amount of drain cleaning cable payed out from, or retracted into, a rotating drum of an associated drain cleaning apparatus without the need to directly contact the cable and while permitting drum rotation. There is a further need for a drain cleaning apparatus including a frame, a drum, a flexible drain cleaning cable, and an electronic cable monitoring system configured to assess the amount of cable payed out from or retracted into the rotating drum of the apparatus.

There is an additional need for an electronic cable monitoring system configured to determine an amount of drain cleaning cable payed out from or retracted into a rotating drum of an associated drain cleaning apparatus on a per job basis as well as on an overall or historical basis. There is a further need for a drain cleaning apparatus including a frame, a drum, a flexible drain cleaning cable, and an electronic cable monitoring system configured to determine the amount of cable payed out from or retracted into the rotating drum of the apparatus on a per job basis as well as on an overall or historical basis. Additionally, a need exists for a method of determining and notifying, such as via a visual indicator such as a light or notification on a visual display, or by an audible indicator such as a speaker, of cable payed out or retracted. The use of such indicators would provide a convenient way for informing an operator as to cable pay out or other operating conditions.

There is yet a further need for an electronic cable monitoring system configured to measure a time of use of the machine on a per job basis as well as on an overall or historical basis. There is a further need for a drain cleaning apparatus including a frame, a drum, a flexible drain cleaning cable, and an electronic cable monitoring system configured to measure the time of use of the machine on a per job basis as well as on an overall or historical basis.

A condition that may occur when using a powered rotary drum drain cleaning device is "cable loading." This condition can occur when a rotating drain cleaning cable encounters blockage or other obstruction(s) which can suddenly restrict rotation at a distal end of the cable. The machine-end of the cable however, is still undergoing rotation, and so the cable becomes wound or twisted about its longitudinal axis.

Various techniques have been used to assess a cable loading condition such as excessive current draw of the motor. For example, U.S. Pat. No. 5,199,129 describes a sensor for measuring motor drive torque. A sensing circuit is also described that activates one or more notification lights when the motor drive torque exceeds a selected allowable torque level. These techniques are based upon a cable loading situation as it is occurring. Other strategies do not attempt to detect such conditions and instead, use clutches or similar devices to divert application of rotary power from an already over-stressed cable.

Although satisfactory, a need remains for a method of predicting a cable loading condition during operation of a powered rotary drum drain cleaning device.

It would also be desirable to detect other conditions that may occur during operation of a drain cleaning device, such as reverse rotation of a drain cleaning cable, and in particular, prolonged existence of this condition. Extended use of a cable undergoing reverse rotation can result in permanent damage to the cable.

SUMMARY

In one aspect, the present invention provides a rotary drum drain cleaning device having a cable monitoring system. The device comprises a frame assembly, and a first rotatable member rotatably supported on the frame assembly. The first member defines an interior hollow region. The device also comprises a second rotatable member rotatably supported on either the first rotatable member or the frame assembly. The second member defines a cable outlet. The device further comprises a flexible cable at least partially disposed in the hollow region of the first member and extending through the cable outlet of the second member. Upon displacement of the cable through the cable outlet, the second rotatable member rotates. The device also comprises a cable monitoring system for measuring relative rotation of the first member and the second member to thereby monitor the length of cable extended or retracted relative to the device.

In another aspect, the present invention provides a method for determining a length of cable extended or retracted relative to a rotary drum drain cleaning device. The device includes (i) a frame assembly, (ii) a first rotatable member rotatably supported on the frame assembly, the first member defining an interior hollow region, (iii) a second rotatable member rotatably supported on at least one of the first rotatable member and the frame assembly, the second member defining a cable outlet, and (iv) a flexible cable at least partially disposed in the first member and extending through the cable outlet of the second member. The method comprises sensing relative rotational movement between the first member and the second member. The method also comprises providing information regarding the sensed relative rotational movement to a processor. And, the method comprises the processor determining a length of cable extended or retracted relative to the device based upon the information.

In yet another aspect, the present invention provides an electronic cable monitoring system for use with an associated drain cleaning apparatus having (i) a frame assembly, (ii) a first rotatable member rotatably supported on the frame assembly, the first member defining an interior hollow region, (iii) a second rotatable member rotatably supported on at least one of the first rotatable member and the frame assembly, the second member defining a cable outlet, and (iv) a flexible cable at least partially disposed in the first member and extending through the cable outlet of the second member. Upon displacement of the cable through the cable outlet, the second rotatable member rotates. The cable monitoring system comprises at least one first marker affixed to the first rotatable member, at least one second marker affixed to the second rotatable member, and at least one sensor assembly adapted for sensing the at least one first marker and the at least one second marker.

In still another aspect, the present invention provides a method for detecting a cable loading condition in a rotary drum drain cleaning device. The device includes (i) a frame assembly, (ii) a first rotatable member rotatably supported on the frame, the first member defining an interior hollow region, (iii) a second rotatable member rotatably supported on at least one of the first rotatable member and the frame assembly, the second member defining a cable outlet, (iv) a flexible cable at least partially disposed in the first member and extending through the cable outlet of the second member, and (v) a system adapted for sensing relative rotational movement between the first member and the second member, the system including a processor. The method comprises inputting data to the processor including information relating to the cable properties and/or the amount of permissible rotational difference between the first rotatable member and the second rotatable member. The method also comprises sensing relative rotational movement between the first member and the second member. The method also comprises providing information regarding the sensed relative rotational movement to the processor. The processor detects a cable loading condition by analyzing the speed of the second rotatable member and comparing that speed to information stored in the processor. As the second member reaches a predetermined lower speed, the operator can be notified of the potential for a cable loading condition.

And in another aspect, the present invention provides a method for detecting a cable reverse rotation condition in a rotary drum drain cleaning device, the device including (i) a frame assembly, (ii) a first rotatable member rotatably supported on the frame assembly, the first member defining an interior hollow region, (iii) a second rotatable member rotatably supported on at least one of the first rotatable member and the frame assembly, the second member defining a cable outlet, (iv) a flexible cable at least partially disposed in the first member and extending through the cable outlet of the second member, and (v) a system adapted for sensing rotational movement of the first member and the second member, the system including a processor. The method comprises inputting data to the processor, the data including direction of cable rotation during normal use of the device. The method also comprises sensing direction of rotation of the first member and the second member. And, the method additionally comprises comparing the sensed direction of rotation of the first and second members to the direction of cable rotation during normal use of the device, and if the compared directions are different, then outputting a signal indicating a cable reverse rotation condition.

Other aspects and advantages of the present invention will become apparent to those of ordinary skill in the art upon a reading and understanding of the enclosed specification and figures.

DETAILED DESCRIPTION

Figure 1:
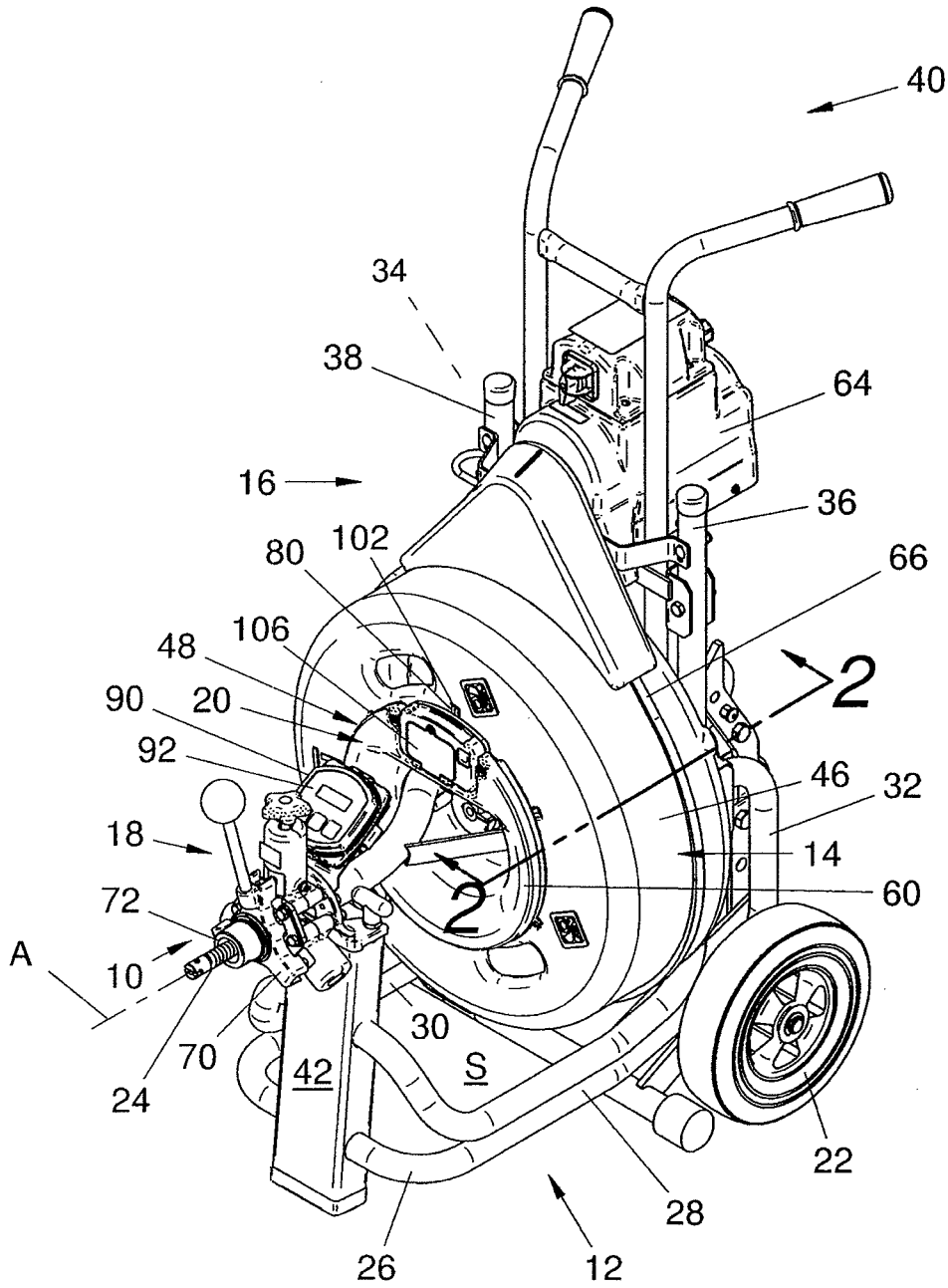
FIG. 1 is a perspective view of a drain cleaning apparatus with an electronic cable monitoring system in accordance with a preferred embodiment of the present invention.

The present invention relates to a drain cleaning apparatus or like device using an extendable flexible member which is typically administered into a piping system to remove or otherwise fragment blockages in the system so that fluid flow can be restored. The invention provides a system for readily measuring the length of the flexible member that is extended from the device or which is retracted into the device. Preferably, the system is an electronic system in which data associated with relative revolutions of an inner drum (sometimes referred to as a guide member or guide tube) and an outer drum of a drain cleaning apparatus are measured. The system preferably includes a processor to analyze the data and to provide information to the operator of the drain cleaning apparatus. The system may also utilize a wireless communication link to transmit at least a portion of the data to other components of the system, drain cleaning apparatus, and/or the operator.

Specifically, the present invention relates to sewer cleaning machines and, more particularly, to improvements in sewer cleaning machines of the type having a flexible plumbers cable or "snake" with a bulk portion coiled within a rotatable drum from which a working portion of the snake is withdrawn and inserted into a pipe or sewer to be cleaned and by which the snake is rotated to achieve such cleaning. In one aspect, the invention provides an electronic cable monitoring system (or electronic cable counter) configured to assess an amount of cable payed out from or withdrawn into the rotating drum during use of the drain cleaning apparatus. In another aspect, the invention provides a drain cleaning apparatus in combination with such electronic cable monitoring system. It will be appreciated, however, that the present invention may find application in related environments and in any application in which a working member is carried in or on a rotating carrier member and wherein there is a need or desire to determine an amount of the working member payed out from the rotating carrier member.

The present invention also provides various methods by which a drain cleaning machine or apparatus may be equipped with a system capable of measuring the feed of cable sent out or recovered when it is being used in a drain, and methods of computing critical use information based on the system's design, as well as a means for displaying such information to the operator. Preferably, the system also provides indication and/or presentation of information relating to cable pay out, cable retraction, cable feed rates, cable rotation speeds and directions, data concerning the operation of the drain cleaning machine, particulars of the job, and other conditions. The indication is preferably made by human recognizable visual and/or audible means such as for example by lights, panel indicators, presentation of information on display panels, speakers or other visual or audible indicators. It is also contemplated that the indication can be presented in readable form such as by the conveyance of short passages of text or words indicative of the information presented. In addition to monitoring or measuring the amount, i.e. linear distance of cable payed out from or retracted into the device, the system can also assess, determine, and indicate other information such as rate of cable feed or retraction, amounts of cable payed out on a per job basis and/or historical basis, and other conditions and parameters associated with the cable. And in certain embodiments, a system and related method are provided in which a cable loading condition can be detected. In additional embodiments, a system and related method are provided in which a cable reverse rotation condition can be detected. These and other aspects and features are all described in greater detail herein.

Thus, the present invention provides various drain cleaning devices having electronic cable monitoring systems. The present invention also provides electronic cable monitoring systems that can be readily incorporated with drain cleaning devices, such as by incorporation in new devices or by retrofitting a conventional device with a system as described in greater detail herein. And, the present invention further provides techniques by which linear displacement of a cable payed out from, or retracted into, a rotating drum can be readily determined. Moreover, the invention also provides techniques for detecting various conditions that may occur during use of a drain cleaning machine and providing notification or other indication to an operator as to the conditions.

As described in greater detail herein and particularly in association with various preferred embodiments, the present invention determines an amount of cable payed out from, or retracted into, a drain cleaning device by assessing the relative rotation between an outer drum member and a secondary rotatable member which can for example be an inner drum, a cable follower, or a cable guide member. The sensed relative rotation may be with regard to an angular difference in the positions of the two rotating components, or may relate to differences in the rotational velocities of the two rotating components. Furthermore, the sensed relative rotation may also be with regard to changes in the angular positional differences of the two components, changes in the rotational velocities, i.e. acceleration or deceleration, of either or both of the components, and/or changes in the difference between the rotational velocities of the two rotating components. A variety of sensor configurations and sensing strategies are utilized to assess such relative rotation. Once obtained, such information is then processed to provide indication as to the amount of cable payed out or retracted into the device, and/or provide indication as to various operating conditions.

More specifically, in a preferred embodiment, a length of cable extended or retracted relative to a drain cleaning device is determined by sensing the relative rotational movement between an outer drum and an inner drum (or comparable component). Preferably, the sensed relative rotational movement includes the angular difference between rotation of the outer drum and rotation of the inner drum. In particular, the determination of cable displacement is made by totaling or summing the angular difference in position of each of the drums over a time period of interest, such as from a time at which the device begins paying out cable until some time thereafter.

In many of the preferred embodiments described herein, the sensed relative rotation is achieved by sensor assemblies that detect magnetic fields and in certain embodiments, changes in magnetic fields. Measuring magnetic field strength and magnetic field orientation, or changes in these aspects, allows rotational direction and velocity of each of the rotating components to be determined. In accordance with this aspect of the present invention, one or more magnets are affixed to each of the outer drum and the inner drum. Preferably, the magnets on the outer drum are disposed or approximately so, within a common plane transverse to the rotational axis of the drum. And, preferably, the magnets on the inner drum are disposed or approximately so, within a common plane transverse to the rotational axis of the inner drum. These two planes are preferably parallel to one another and may in certain applications be coplanar or substantially so. Preferably, the magnets on the outer drum and on the inner drum are aligned such that at least in the sensing vicinity of a corresponding stationary sensor or sensing array, the axes of the respective magnets are transverse to one another or at least substantially so. Thus, using this preferred configuration, the magnetic field lines emitted from the magnets passing near two separate sensors or a single two-axis or three-axis sensor have distinctly distinguishable orientations relative to one another, thereby enabling the sensor to readily distinguish between the markers. The sensor assembly thereby can compute and display cable feed as well as the rotation rate and direction of rotation of the drum(s).

In a preferred embodiment, a drain cleaning apparatus is provided which includes a frame, a drum supported relative to the frame for rotation about a first axis, a flexible drain cleaning cable or snake carried by and rotatable with the drum, a cable follower member configured to engage the cable and supported for relative movement with the drum, and an electronic cable monitoring system configured to assess an amount of cable payed out from the drum. As previously noted, it will be understood that the cable follower member is also known and sometimes referred to as a "guide member" or "inner drum." When reference is made to the cable follower member as an inner drum, the drum which stores cable and which may be rotated by an electric motor, is referred to as an outer drum. The terms "inner drum" and "outer drum" are widely used by plumbing and drain cleaning professionals. The outer drum includes a main housing portion defining an opening therethrough. The cable is axially displaceable outwardly of the drum through the opening to pay out portions of the cable from the drum while bulk non-used portions of the cable remain stored in the drum. The cable is further axially displaceable inwardly of the drum through the opening to retract portions of the cable into the drum for storage when not in use. The cable follower member is configured to engage the cable and is supported for movement in a first direction relative to the drum as the cable is payed out of the drum and in a second direction relative to the drum as the cable is retracted into the drum. The electronic cable monitoring system includes first sensor portions on the drum and second sensor portions on the cable follower member, for sensing the relative movement between the drum and the cable follower member in the first and second directions. A processor is in operative communication with the first and second sensor portions for detecting an amount of the cable payed out from the drum and for generating a signal representative of the detected amount.

In another preferred embodiment, an electronic cable monitoring system is provided which is adapted for use with an associated drain cleaning apparatus of the type including a frame, a drum supported relative to the frame for rotation about a first axis, a flexible drain cleaning cable or snake carried by and rotatable with the drum, and a cable follower member configured to engage the cable and support the cable for relative movement with the drum in a first direction as the cable is payed out of the drum and in a second direction as the cable is retracted into the drum. The electronic cable monitoring system includes a first sensor portion disposed on the drum and a second sensor portion disposed on the cable follower member. The first sensor portion on the drum and the second sensor portion on the cable follower member sense relative movement between the drum and the follower member. A processor of the cable monitoring system is in operative communication with the first sensor portion on the drum and the second sensor portion on the cable follower member for detecting an amount of the cable payed out from the drum and for generating a signal representative of the detected amount.

In another preferred embodiment, the first sensor portion includes a magnet disposed in a first sensor housing carried on one of the drum and the cable follower member. The second sensor portion includes a reed switch disposed in a second sensor housing carried on the other of the drum and the cable follower member.

In another preferred embodiment, the processor is disposed in one of the first and second sensor housings.

Still further, in another preferred embodiment, the electronic cable monitoring system includes a display device including a display configured to display information readable by a human operator of the drain cleaning apparatus, and a signal transmission portion configured to transmit the signal representative of the amount of cable payed out from the drum from the processor to the display device.

In accordance with another preferred embodiment, the signal transmission portion includes a radio frequency (RF) link configured to transmit the signal from the processor to the display device. The display device includes a display housing mounted in a fixed relationship relative to the frame of the associated drain cleaning apparatus.

In yet another preferred embodiment, the signal transmission portion includes one of an infrared (IR) link and a slip ring link configured to transmit the signal from the processor to the display device.

In still another preferred embodiment, the first and second sensor portions include one of first and second optical sensor portions, first and second infrared (IR) sensor portions, and Hall Effect sensor portions for sensing the relative movement between the drum and cable follower member in the first and second directions.

In yet another preferred embodiment, a drain cleaning apparatus is provided as previously explained and includes an electronic cable monitoring system. The electronic cable monitoring system includes first and second sensor portions on the drum, the cable follower member, and also mounted on other components or at other locations on the drain cleaning apparatus.

And, in still another preferred embodiment, an electronic cable monitoring system is provided which is adapted for use with an associated drain cleaning apparatus as previously described. The cable monitoring system includes one or more various sensor portions disposed on the drum, the cable follower member, and also on other components or at other locations on the drain cleaning apparatus.

These preferred embodiments and other preferred embodiments along with their various details, and associated methods of use, are all described herein.

One advantage of the present invention is that a working length of a pipe cleaning cable can be conveniently measured and displayed. Another advantage of the present invention is that the working length of the pipe cleaning cable can be measured and displayed while the bulk cable and non-working portion thereof is rotated during use of the drain cleaning apparatus. These and other advantages of the present invention are noted in the following detailed description.

Reference is made herein to various sensor assemblies. Generally, a "sensor assembly" as that term is used herein refers to (i) a marker, target, or other item or characteristic of interest, and (ii) a sensor or similar component which is adapted to recognize the presence, identity, or other characteristics of the marker. Examples of suitable sensor assemblies include for example, magnets, i.e. markers or targets, and corresponding magnetic pickups or like sensors. For ease in discussion, the various preferred embodiments described herein are grouped in two categories: (i) devices and systems utilizing a movable sensor array, and (ii) devices and systems utilizing a stationary sensor array. In the first category in which the embodiments utilize a movable sensor array, relative rotation between the outer drum and the inner drum (or depending upon the drain cleaning device, a cable follower or a cable guide member) is sensed by a collection of sensors or sensor components, all of which are located on the outer drum and the inner drum. In the second category in which the embodiments utilize a stationary sensor array, at least one of the sensors or sensor components is not located on the outer drum or the inner drum. Typically, in this second category of sensor configurations, one or more sensors are affixed or otherwise secured to a frame or mounting member of the drain cleaning device and are stationary with respect to the rotating drums. Each of these configurations is described below.

Movable Sensor Arrays

In one embodiment, the present invention electronic cable monitoring system includes one or more sensor assemblies that are mounted on an inner drum, and one or more sensor assemblies that are mounted on a corresponding outer drum or machine component. One of these is affixed to a rotatable inner drum, and the other is affixed to a rotatable outer drum of the device or machine component. The components are positioned such that as a drum or component rotates, a magnet, i.e. a marker, affixed thereto passes its corresponding pickup, i.e. a sensor, affixed to the other drum or component. With each pass between a magnet and a pickup, a signal is transmitted from the pickup to an electronic monitoring and/or processing device. Preferably, a set of sensors are provided for the inner drum, and a set of sensors is provided for the outer drum. The electronic monitoring system can total the number of passes, and compare the relative number of rotations between the two drums to arrive at a value of the total length of the flexible member extended from the device. Furthermore, the signal strength from one or more markers and orientation of the markers enables the direction of rotation and the instantaneous velocity to be determined.

Alternately, instead of mounting sensor(s) on the drums, components or sensors could be mounted on the shafts of such drums to sense rotation. For example, a disc with teeth or a series of apertures could be utilized which rotates in conjunction with its corresponding drum. It is also contemplated that these aspects could be combined with the previously noted magnets such that a disc with magnets is provided to rotate in conjunction with a corresponding drum.

In all of the embodiments described herein, resolution can be increased by using multiple sets or pairs of sensors, such as multiple magnets and multiple corresponding magnetic pickups. Each magnet is preferably equidistant from other magnets around the periphery of the drum or disc, for example. In this strategy, a single pickup can be used to detect passing of each of the magnets. It will be appreciated that multiple pickups could also be utilized.

With reference now to the drawings, wherein the showings are for purposes of illustrating the preferred embodiments of the invention only and not for purposes of limiting the invention, a portable drain cleaning apparatus 10 is shown in FIGS. 1-3*a* as comprising a wheeled frame assembly 12 supporting a rotatable cable drum 14, a drum driving arrangement 16, a cable feeding mechanism 18, and an electronic cable monitoring system 20. Frame assembly 12 is provided with a pair of wheels 22 by which the machine 10 is adapted to be supported for wheeled movement from one location to another along an underlying surface S, and drum unit 14 contains a flexible plumbers snake or cable 24 which extends outwardly through the feed mechanism 18 and which is adapted to be rotated and displaced inwardly and outwardly relative to the drum unit while the electronic cable monitoring system 20 determines an amount of cable 24 payed out from the drum or retracted into the drum during operation of the machine, and other operational parameters as set forth more fully hereinafter.

Frame assembly 12 is basically of tubular construction and includes a bottom member having a laterally extending leg 26 at the front end of the machine 10 and a pair of rear upwardly extending legs 28 and 30 terminating at the rear end of the machine in upwardly extending legs 32 and 34 (not visible), respectively. The rear portion of the frame assembly further includes a pair of upstanding legs 36, 38 respectively secured at their lower ends to legs 28 and 30, such as by welding. The upper ends of legs 36 and 38 are interconnected by a suitable handle system 40. The front of frame assembly 12 includes an upstanding channel-shaped member 42 which is notched adjacent its lower end to receive frame leg 26 and which is secured to the latter frame leg such as by welding.

Figure 2:
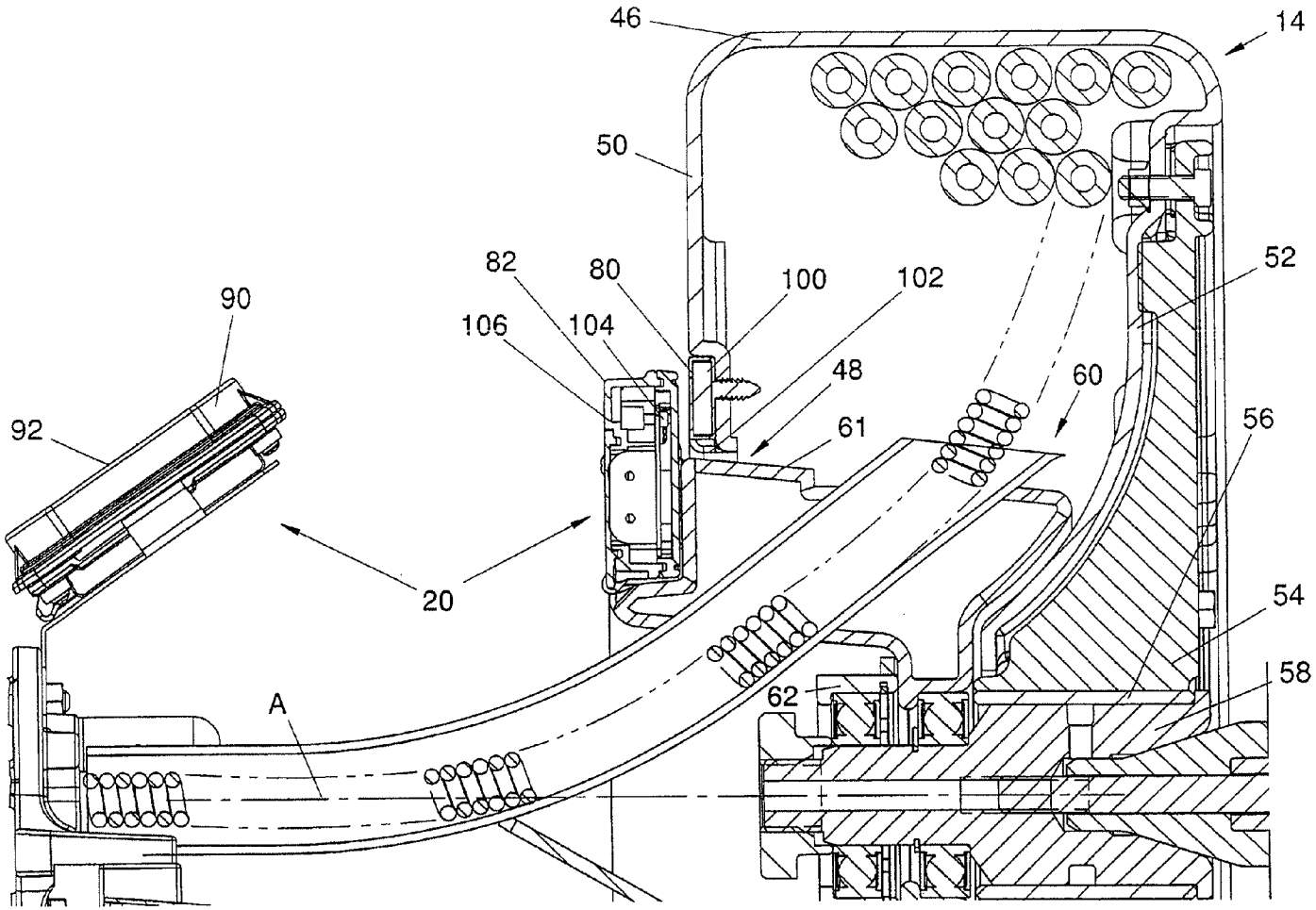
FIG. 2 is a partial cross-sectional view taken along line 2-2 of FIG. 1.

As best seen in FIGS. 1 and 2 of the drawings, the cable drum unit 14 includes a drum housing 46 having an opening 48 in a front wall 50 thereof and having its rear wall 52 contoured to receive a hub member 54 to which the housing is secured by means of a plurality of suitable fasteners or the like. The drum unit 14 further includes a hollow drum shaft 56 carried on an elongate member 58 secured to the frame 12 by which the drum shaft 56 and drum assembly 14 are rotatable about an axis defined by the elongate member 58. A cable follower member 60 preferably in the form of an inner drum 61 is secured to the outer end of the elongate member 58 for rotational displacement about its axis by means of a suitable mounting bracket 62 or the like using suitable bearings and fasteners. As is well known, the drum housing 46 holds the non-used section of the coiled cable member 24, and the cable follower member 60 serves to guide displacement of the cable into and out of the opening 48 and drum housing 46 while operating the drain cleaning apparatus 10 and in a manner which provides for the cable to be coiled and uncoiled during its displacement relative to the housing. While the cable follower member 60 is illustrated and described herein as being a part of the drum unit, this is merely a preferred arrangement and the guide tube could be supported adjacent its axially outer end for rotation, in which case it would be free of a mounted interconnection with the drum unit. Further, while the drum housing and hub are preferably separate components assembled as described herein above, the drum housing could be constructed so as to provide a hub portion integral therewith.

As best seen in FIG. 1 of the drawings, drum driving arrangement 16 includes an electric drive motor 64 which is adapted to drive an endless belt 66 which engages about the outer periphery of the drum housing 46 to achieve rotation of the latter. The cable feeding mechanism 18 is located on the upper end of the channel shaped member 42 and is located adjacent the axis of rotation A of the drum 14 and cable follower member 60 and includes a feed housing 70 having an opening 72 therethrough coaxial with the axis A and through which the cable 24 extends and about which both the drum housing 46 and the cable follower member 60 rotate. The cable feeding mechanism 18 includes a plurality of cam members and movable members which selectively engage the cable 24 as it rotates thereby drawing the cable from its coiled configuration within the drum 14 to pay out cable and, conversely, pushing the cable back into the drum 14 for storage of the non-used portion a coiled arrangement substantially as shown.

It is to be appreciated that the cable follower member 60 is movable relative to the drum housing 46. More particularly, it is rotatable about the axis A in a first direction relative to the drum housing 46 a manner corresponding with the unwinding of the cable 24 from its coiled configuration and, conversely, in a second direction relative to the drum housing 46 corresponding with the winding of the cable to restore it in its winded bulk storage configuration within the drum housing 46. The cable follower member 60 thus rotates one complete revolution relative to the drum housing 46 for each wrap or turn of cable taken from or restored into the bulk cable coiled within the drum housing 46 during use of the subject drain cleaning apparatus. This is easy to visualize when the drum 14 is stationary. However, this relationship also holds true when the drum 14 rotates during use of the drain cleaning apparatus 10. The electronic cable monitoring system 20 utilizes this relationship and, generally, senses the relative rotational movement between the drum housing 14 and cable follower member 60 in order to detect relative rotational movement therebetween. The cable monitoring system 20 further determines a direction of the relative rotational movement, determines an amount of relative rotational movement and, thus, an amount of cable payed from or retracted into the drain cleaning apparatus, and displays on a suitable human readable interface an amount of cable extending from the drain cleaning apparatus during use thereof. The cable monitoring system further maintains a log of usage of the cable in a time of use measure and in a length of use measure. Each of these are maintained on a per job basis as well as on an overall aggregate or lifetime basis. In addition, the cable monitoring system 20 is scalable for application in drain cleaning apparatus having drums 14 of various sizes. Any or all of this information may then be presented by use of one or more visual and/or audible indicators, or by human recognizable or readable means.

Figure 3A:
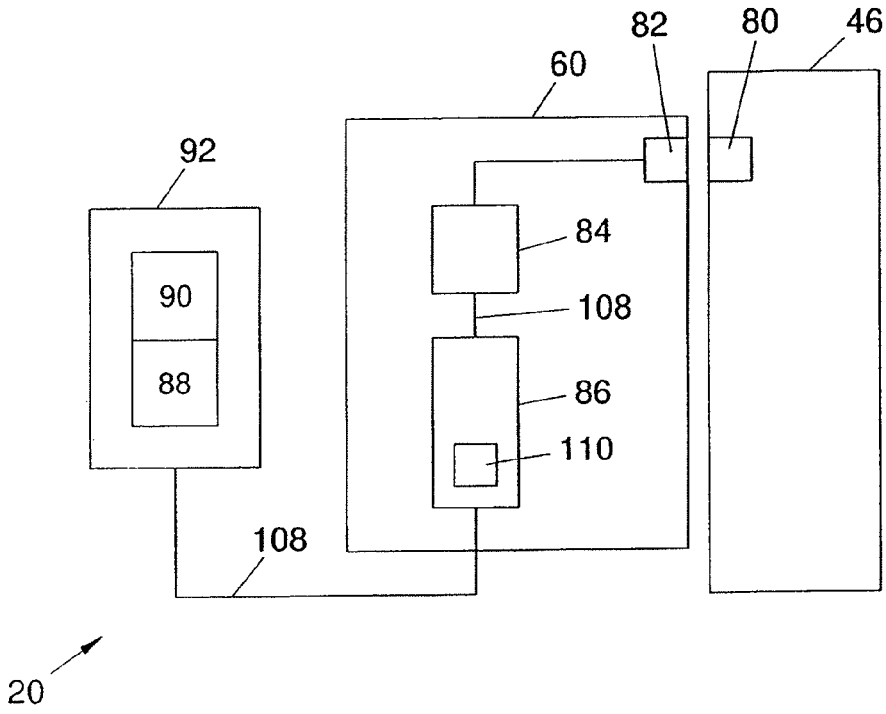
FIG. 3*a* is a schematic diagram of an electronic cable monitoring system in accordance with a preferred embodiment and of the type shown in FIGS. 1 and 2.

In accordance with a first preferred form as shown in FIGS. 1, 2, and 3*a*, the electronic cable monitoring system 20 includes, generally, a first sensor portion 80 mounted in a fixed relationship relative to the drum housing 46, a second sensor portion 82, mounted in a fixed relationship relative to the cable follower member 60, a processor 84 in operative communication with the first and second portions 80, 82 for determining an amount of said relative movement, a signal transmission portion 86 configured to transmit the signal from the processor to a receiver portion 88 having a human interface portion 90 with various input means and a readable display configured to generate human readable characters representative of the signal of the amount of cable payed from the drum generated by the processor 84 and other operating parameters of the apparatus as will be described in greater detail below.

In the first preferred form illustrated in FIGS. 1, 2, and 3*a* and as best shown in FIG. 2, the electronic cable monitoring system 20 includes a set of magnets 100 disposed in a first sensor housing 102 carried on the drum housing 46 for relative rotational movement together with the drum housing about axis A. The second sensor portion 82 includes a corresponding set of Hall Effect sensors 104 disposed in a second sensor housing 106 carried on the cable follower member 60 for rotational movement together therewith about the axis A. In that way, the magnets 100 rotate together with the drum housing 46 while the Hall Effect sensors 104 rotate with the cable follower member 60 whereby the processor 84 (FIG. 3*a*) contained within the second sensor housing 106 senses pulses or switch closures as the magnets pass adjacent thereto during use of the subject drain cleaning apparatus. In addition, the signal transmission portion 86 includes a radio frequency (RF) link 110 configured to transmit a signal 108 generated by the processor 84 to the associated receiver portion 88. In the embodiment illustrated in FIGS. 1-3*a*, the RF link 110 is disposed in the second sensor housing 106 and, therefore, rotates together with the cable follower member 60 during use of the drain cleaning tool. In its preferred form, the RF link 110 includes an integrated circuit IC 112 connected with a suitably disposed wire loop or other antenna 114 (FIG. 7) disposed in or on the second sensor housing 106.

Figure 3B:
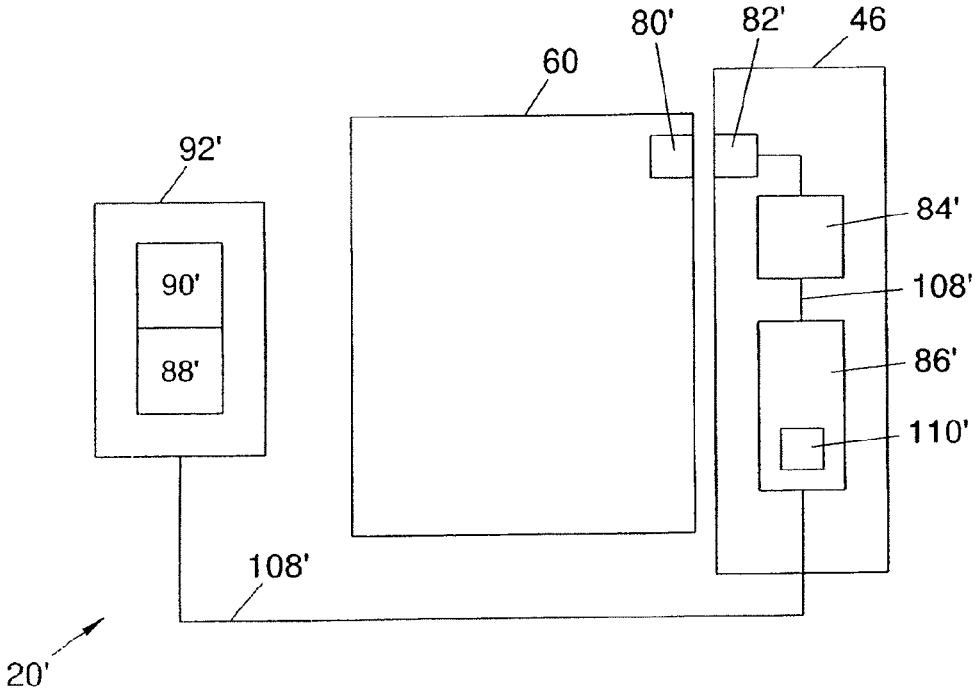
FIG. 3*b* is a schematic diagram of an electronic cable monitoring system in accordance with another preferred embodiment of the present invention.
Figure 4:
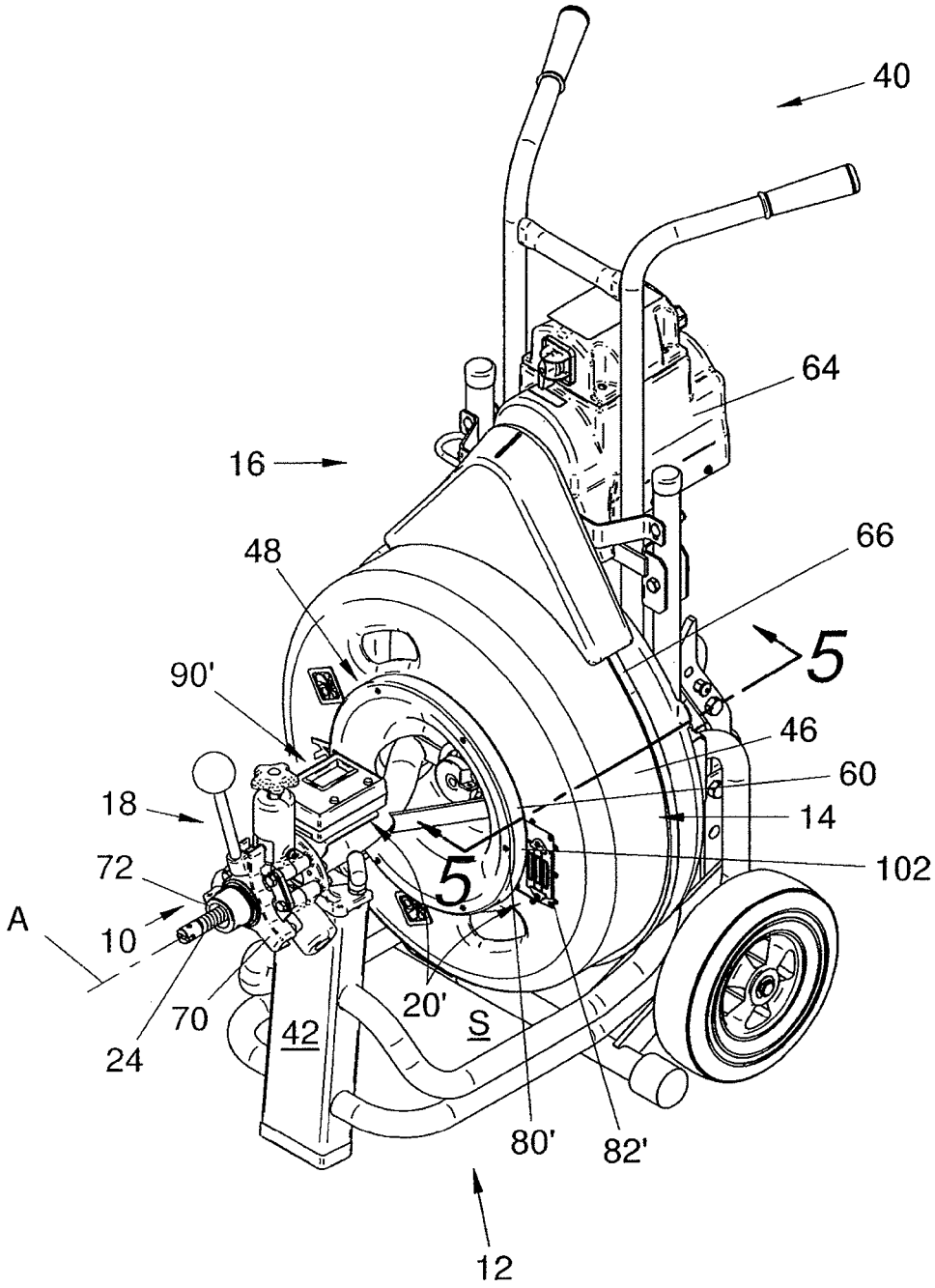
FIG. 4 is a perspective view of a drain cleaning apparatus with an electronic cable monitoring system in accordance with a preferred embodiment and of the type depicted in FIG. 3*b*.
Figure 5:
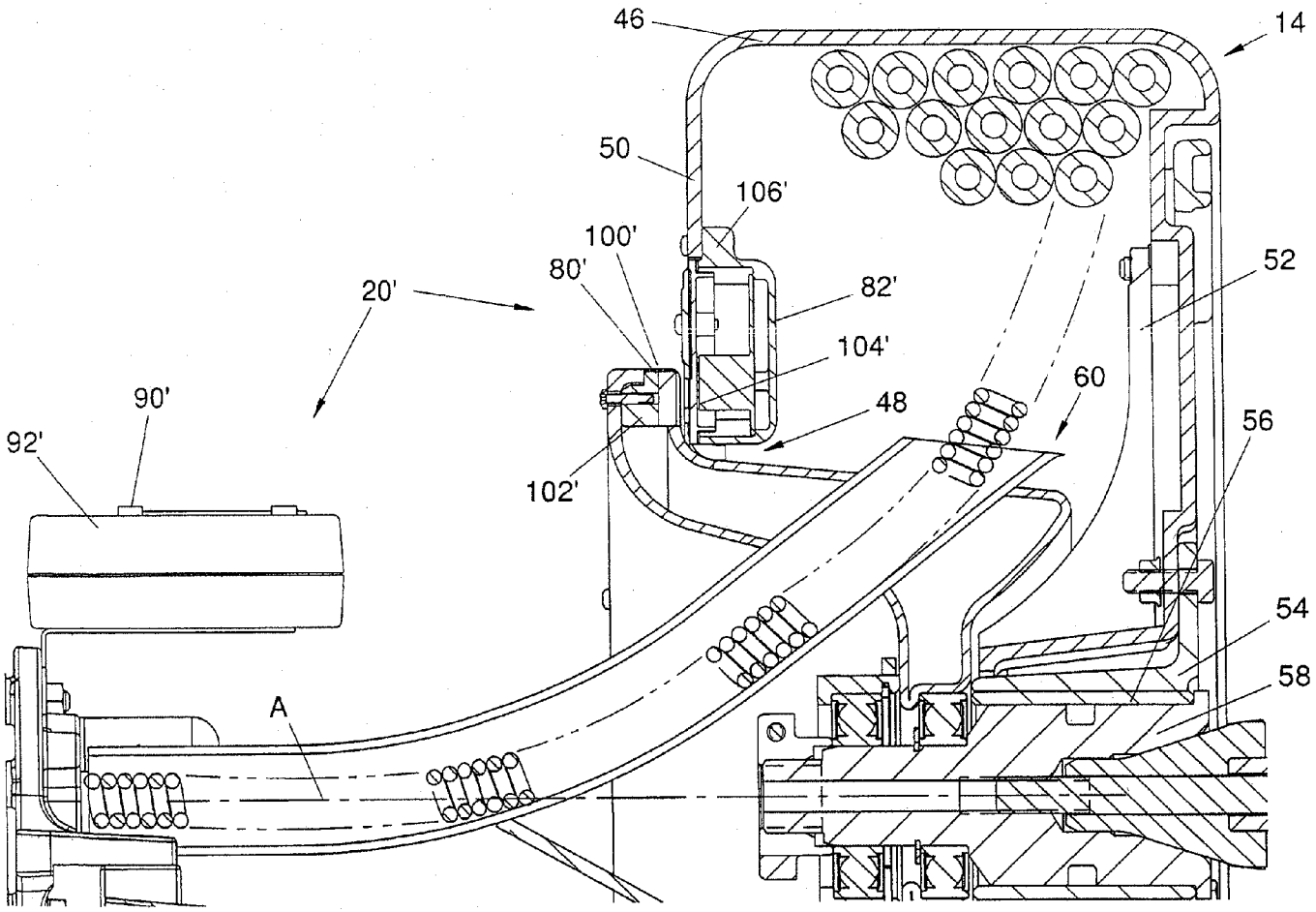
FIG. 5 is a partial cross-sectional view taken along line 5-5 of FIG. 4.

In a second preferred embodiment illustrated in FIGS. 3*b*, 4, and 5, similarly, the first sensor portion 80' includes a set of magnets 100' disposed in a first sensor housing 102' carried on the cable follower member 60. The second sensor portion 82' includes a corresponding set of sensors 104' disposed in a second sensor housing 106' carried on the rotatable drum housing 46. Preferably, for each magnet two sensors are provided. In certain embodiments, a total of six magnets are used. In a preferred embodiment, the processor 84' is disposed in the second sensor housing 106' and generates a signal 108' representative of the relative movement between the first and second sensor portions 80', 82' whereby the signal transmission portion 86' includes an RF link 110' configured to generate a radio frequency signal provided for reception by the receiver portion 88' carried in a housing 20' disposed on the frame 12.

In the first and second preferred embodiments illustrated in FIGS. 1, 2, 3*a* and 3*b*, 4, 5, respectively, the receiver portion 88, 88' and the human readable display portion 90, 90' are mounted in a fixed relationship relative to the frame 12 adjacent the cable feeding mechanism 18 in a suitable housing 92, 92'. This enables an operator to suitably adjust the cable feeding mechanism 18 while observing the human readable display portion 90, 90' which device is in convenient close proximity with the cable feeding mechanism 18.

It is to be appreciated that although the first and second sensor portions preferably include magnets and Hall Effect sensors, other sensor portions or technologies can be used as well such as, for example, optical sensor portions, infrared sensor portions, and other sensor portions for sensing the relative movement between the cable follower member 60 and the drum housing 46. And, as described herein, the sensors may utilize RFID tags. In addition, although the preferred form of the signal transmission portion 86 uses a radio frequency link 110, 110' in the preferred embodiments, other signal transmission portions can be used as well such as, for example, an infrared transmission portion and, one or more electromechanical slip rings or the like configured to transmit the signal 108 from the processor portion 84 to the receiver portion 88 for display on the human readable display portion 90.

Figure 6:
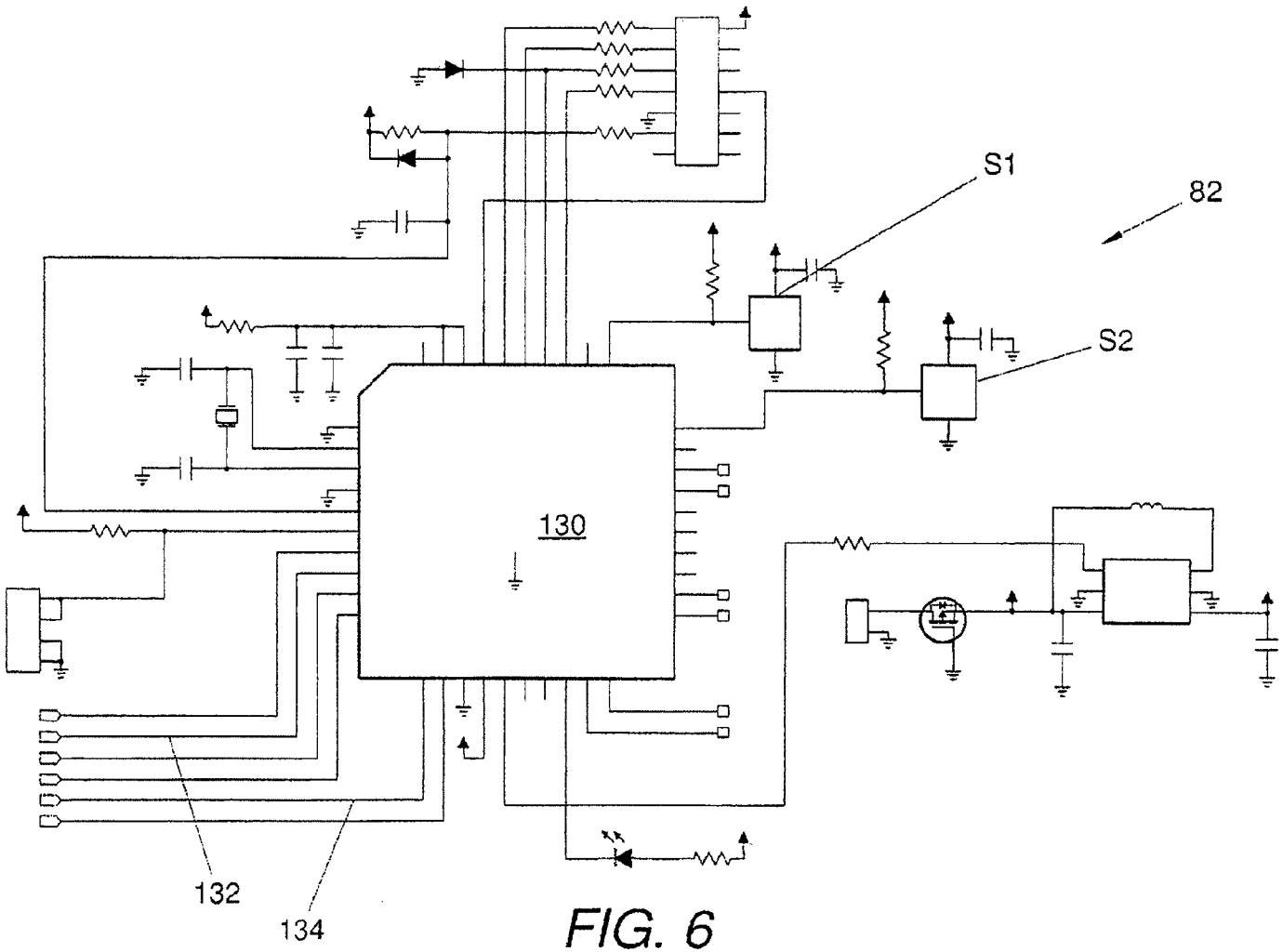
FIG. 6 is an electronic circuit diagram showing an input sensor and processor portion of the electronic cable monitoring system circuits of FIGS. 3*a* and 3*b*.
Figure 7:
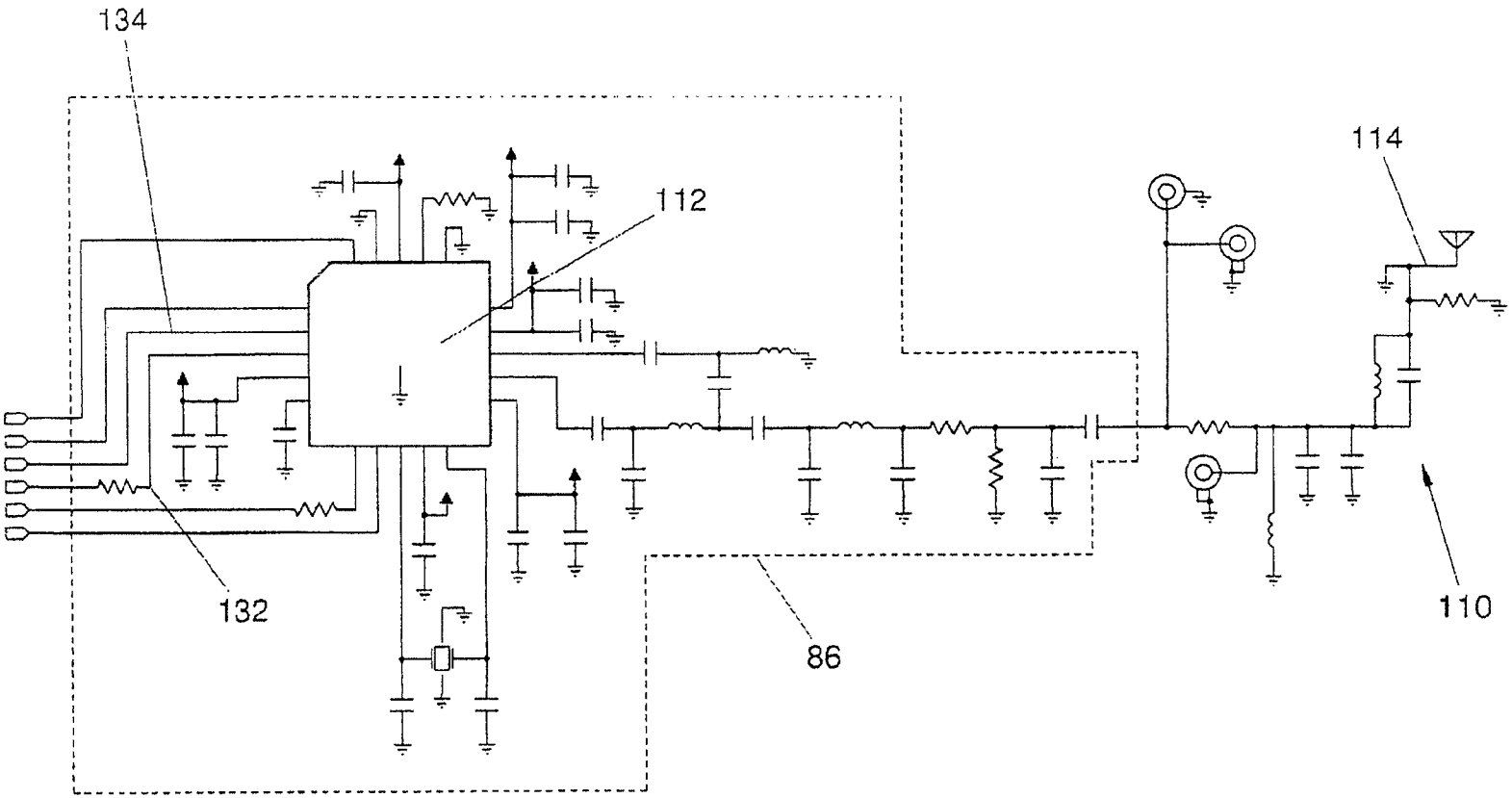
FIG. 7 is an electronic circuit diagram showing a transmitter/receiver portion of the electronic cable monitoring system circuits of FIGS. 3*a* and 3*b* and coupled with the circuit of FIG. 6.

FIGS. 6 and 7 show electronic circuit diagrams of the components carried within the second sensor housing 106 in accordance with the preferred embodiment of the subject electronic cable monitoring system 20. With reference first to FIG. 6, the second sensor portion 82 includes first and second switches S1, S2 in operative communication with a processor element 130. Preferably, the switch pair S1, S2 are low voltage, high sensitivity, bipolar hall switches, although other forms of switches may be used as well such as reed switches or the like. The preferred switches S1, S2 are commercially available from various suppliers under the designation US4881. Typically, these switches are normally opened and closed as the first sensor portions 80 pass in close proximity thereto. The processor element 130 shapes or otherwise forms the raw signals generated by the Hall Effect switches S1, S2 to generate a first signal such as depicted as 132 for example, representative of the direction of relative rotation between the cable follower member 60 and the drum housing 46. In addition, the processor element 130 generates a pulse signal such as depicted as 134 for example, representative of an amount of said relative rotational movement between the cable follower member 60 and the drum housing 46. In that way, the processor element 130 generates both direction and length signals 132, 134 representative of an amount of the cable 24 payed from or retracted into the drum housing 46 during use of the drain cleaning apparatus 10. In its preferred form, the processor 130 is a mixed signal microcontroller available from Texas Instruments under part number MSP430F2252IRHA, although other processors, microcontrollers, and/or discrete components can be used as desired.

FIG. 7 shows an electric circuit diagram of the signal transmission portion 86 of the subject electronic cable monitoring system 20. The signal transmission portion 86 receives the direction signal 132 and pulse signal 134 into an integrated circuit 112 adapted to encode the direction and pulse signals onto a suitable carrier frequency for transmission to the receiver portion 88 (FIGS. 8 and 9) using well known electronic techniques. In its preferred form, the integrated circuit 112 is a low power radio frequency (RF) transceiver available from Texas Instruments under part number CC2500. Preferably, the circuit 112 is configured to transmit and receive RF signals at in the 2400-2483.5 MHz ISM (Industrial, Scientific and Medical) and SRD (Short Range Device) frequency band, and, more preferable, at 2.4 GHz. However, other transmission rates and modalities are possible as desired. A wire loop or another form of antenna 114 is provided using well known techniques to transmit the radio frequency signal from the RF link 110 portion of the transmission portion 86 into the space surrounding the electronic cable monitoring system 20.

Figure 8:
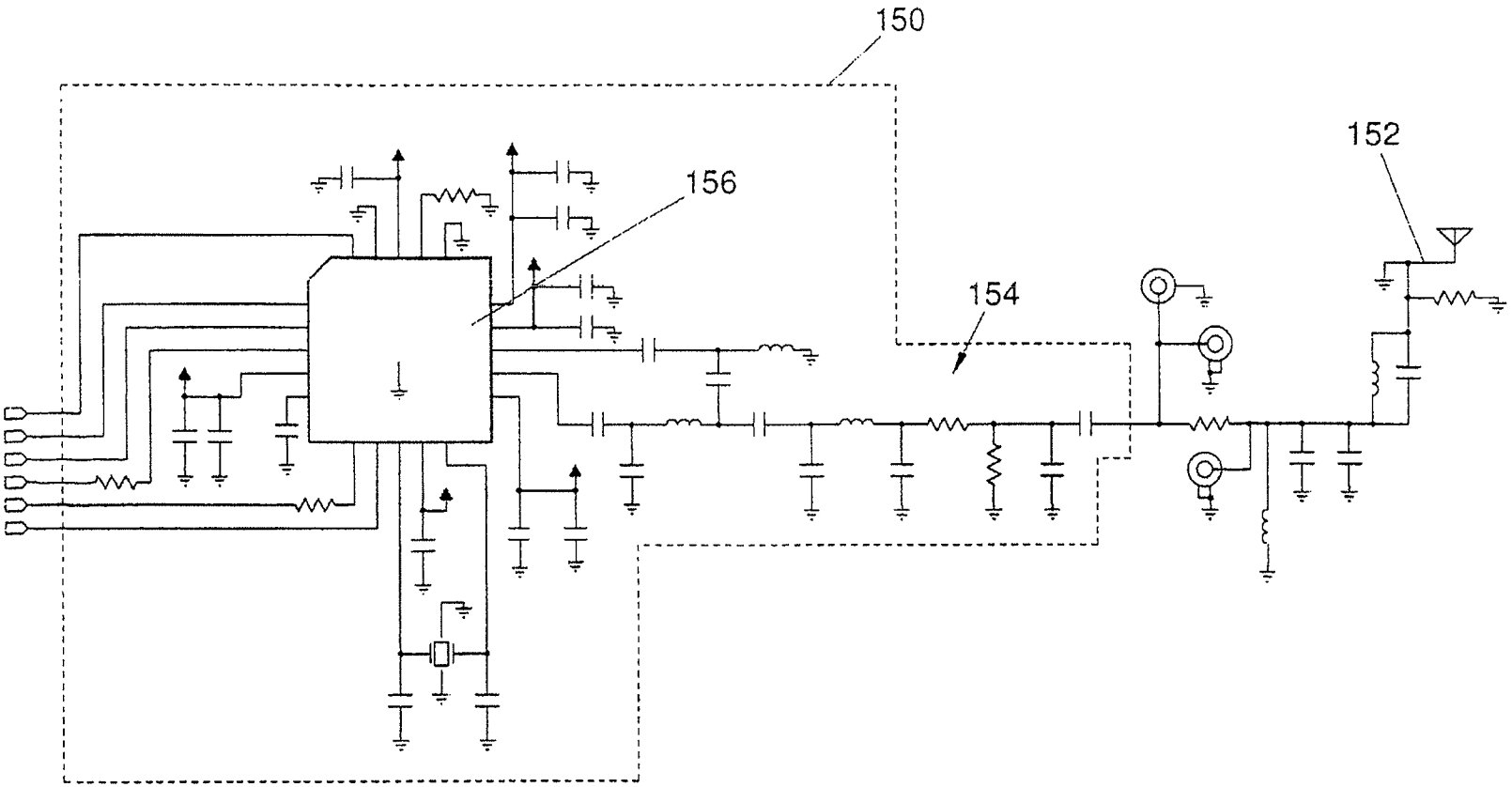
FIG. 8 is an electronic circuit diagram showing a transmitter/receiver portion of the electronic cable monitoring system circuits of FIGS. 3*a* and 3*b* and coupled with the circuit of FIG. 9.
Figure 9:
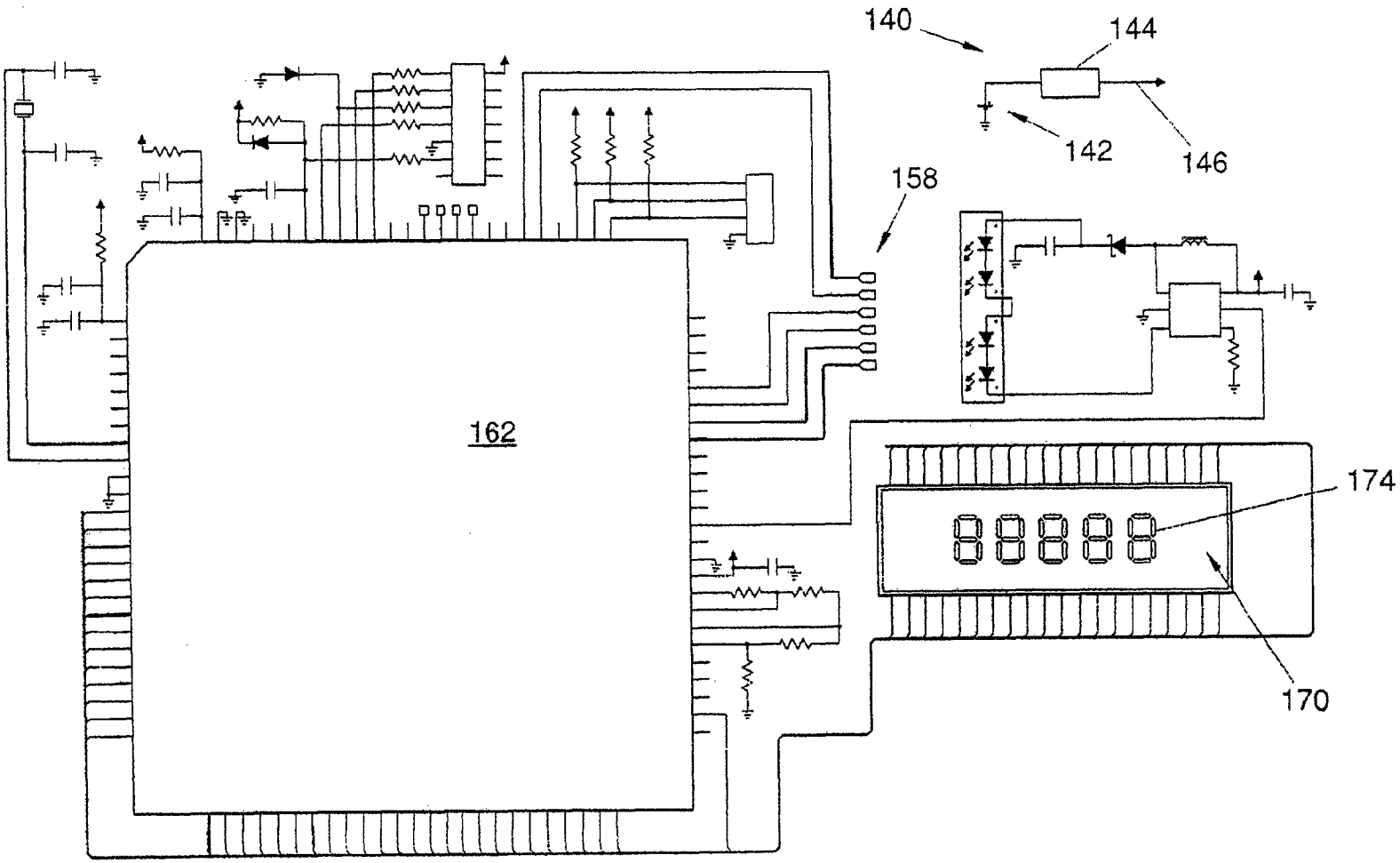
FIG. 9 is an electronic circuit diagram showing a processing portion of the electronic cable monitoring system of FIGS. 3*a* and 3*b* and coupled with the circuit of FIG. 8.

FIGS. 8 and 9 show electronic circuit diagrams of the receiver portion 88 and human interface (readable display) portion 90 contained within the receiver housing 120 in accordance with the preferred embodiments. A power supply 140 includes a battery 142 connected with suitable electronics including a switching integrated circuit device in the form of a field effect transistor (FET) 144 and a voltage regulator (not shown 146) such as available from LinearTech at catalog number LTC3525LESC6. The power supply circuit 140 preferably generates a regulated 3 volt DC signal 146 for use in the processing portion 162 shown in FIG. 9. The signal reception portion 150 includes an antenna 152 configured to receive the radio frequency signal generated by the antenna 114 from the signal transmission portion 86. A saw filter 154 is interposed between the antenna 152 and a transceiver 156 in the form of an RF receiver CC2500 available from Texas Instruments. The RF receiver is surrounded by suitable support electronics arranged in a manner well known in the art.

FIG. 9 shows an electronic circuit diagram of the preferred form of the display driver portion of the subject electronic cable monitoring system 20. As shown there, the display driver portion includes a further integrated circuit 162 in the form of a MSP430F4361IPZ microcontroller available from Texas Instruments. The integrated circuit 162 is configured to receive a display value signal such as depicted by 158 for example, generated by the transceiver 156 in the signal reception section for display in a human readable form on a display portion 170. Preferably, the display module 170 is in the form of a LCD-VI508-DP-FC-S-V100 five digit seven segment integrated driver and display module such as available from Varitronix. The display module 170 provides for display of one or more alpha-numeric characters or symbols 174.

Figure 10:
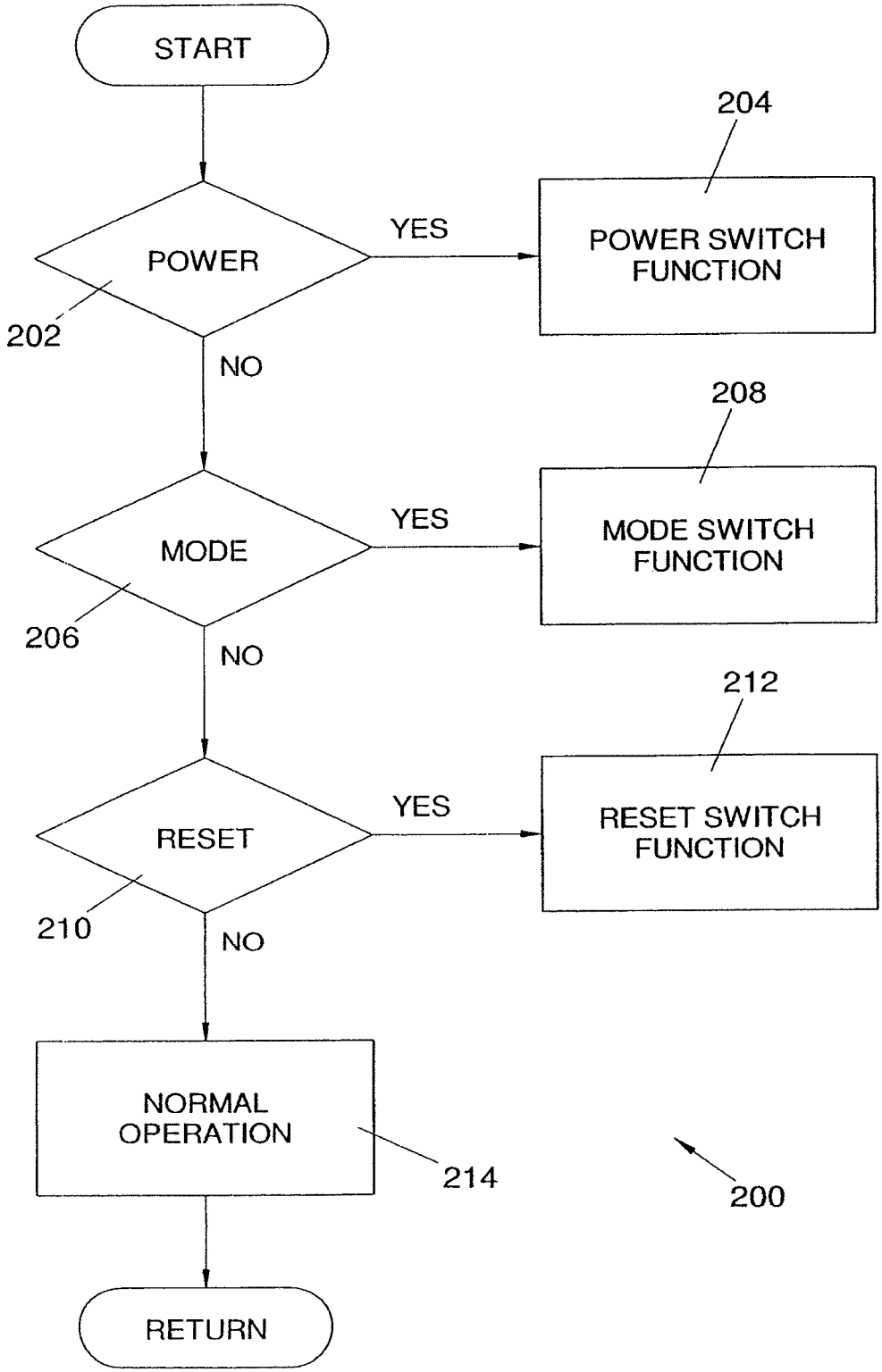
FIG. 10 is a flow chart illustrating a preferred control method of operating the subject device.
Figure 11:
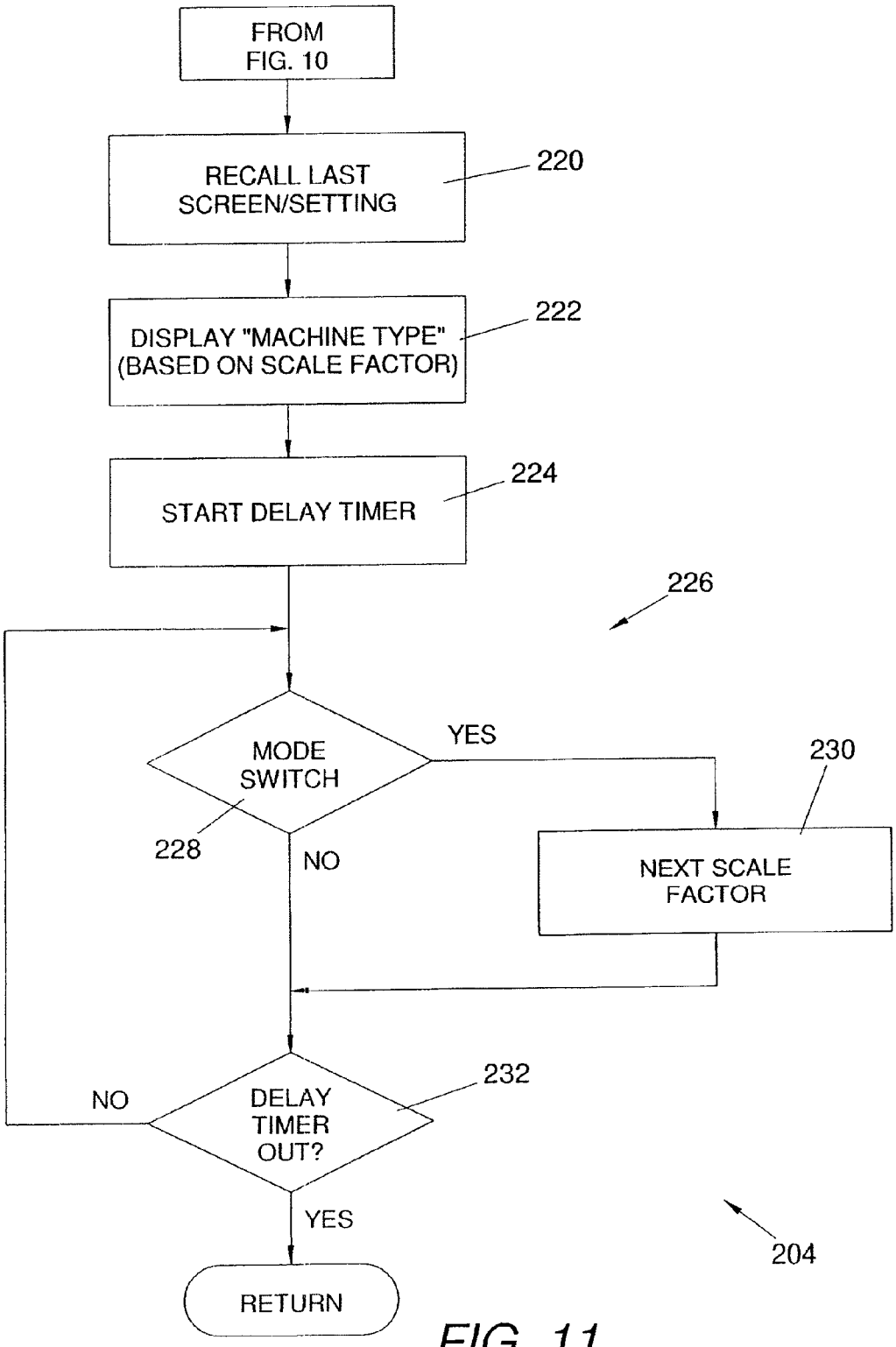
FIG. 11 is a flow chart illustrating a preferred subroutine of the control method of FIG. 10.
Figure 12:
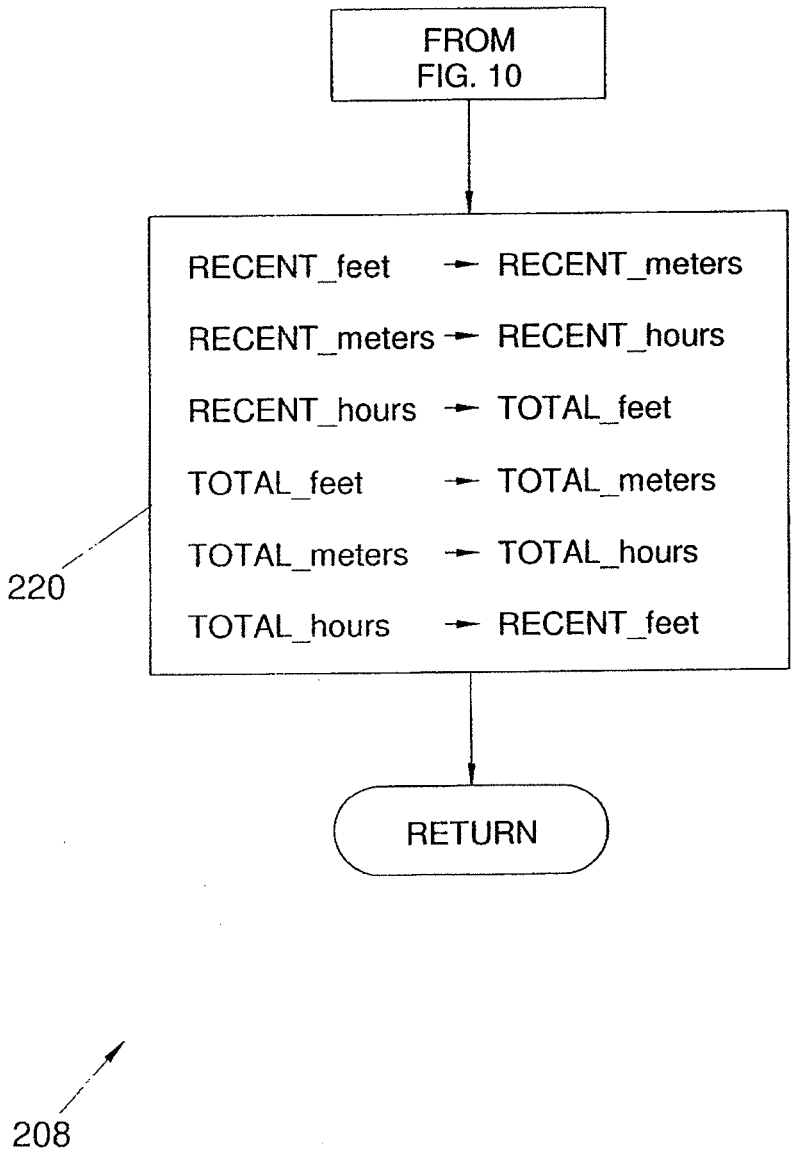
FIG. 12 is a flow chart illustrating a further preferred subroutine of the control method of FIG. 10.
Figure 13:
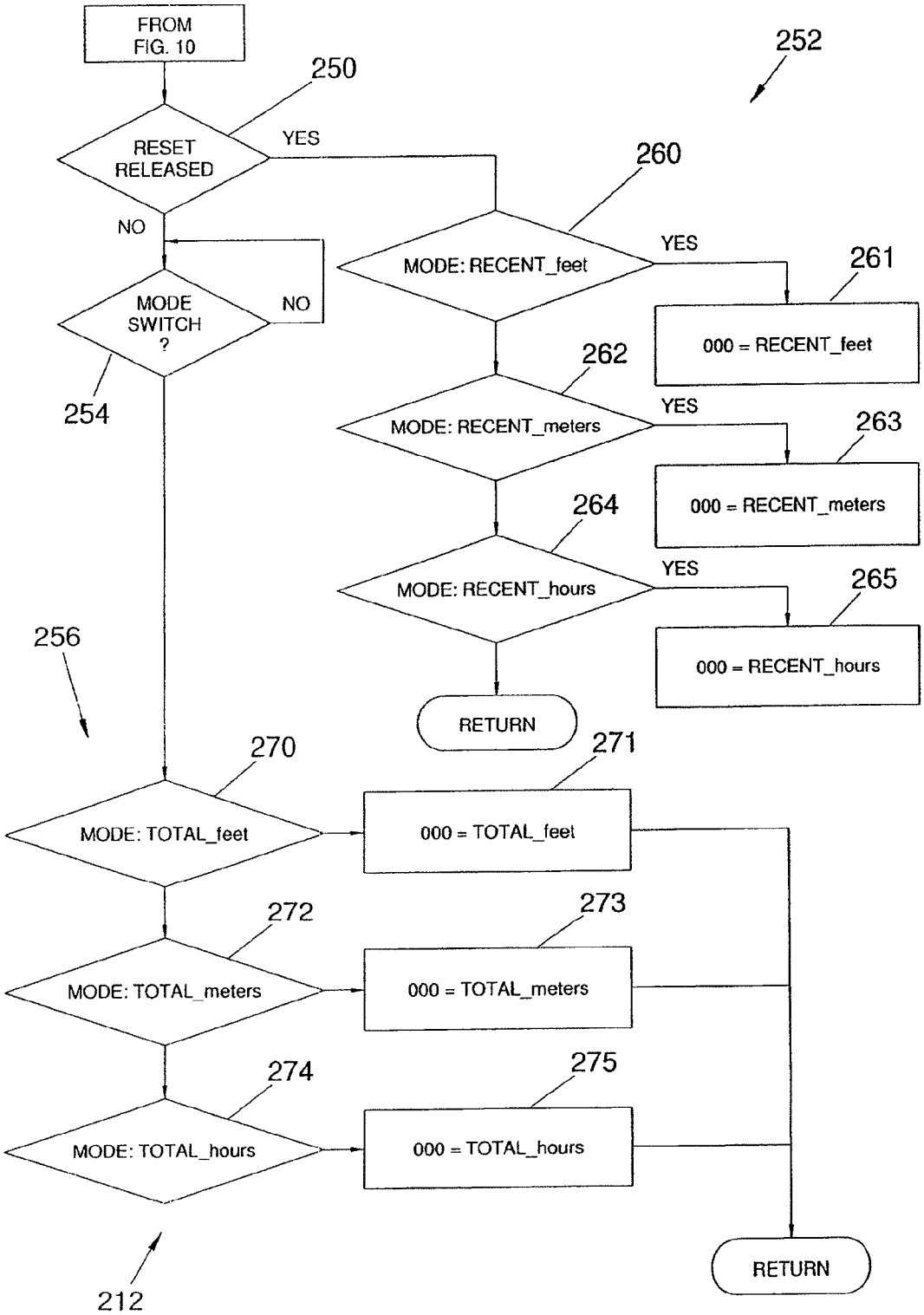
FIG. 13 is a flow chart illustrating yet a further preferred subroutine of the control method of FIG. 10.

Referring next to FIG. 10, a flow chart illustrating a preferred method 200 of operating the subject cable monitoring system 20 in connection with the drain cleaning apparatus 10 shown by way of example will be described. FIGS. 11-13 are flow charts showing various subroutine steps executed in the overall method 200 of FIG. 10. More particularly, FIG. 11 is a flow chart illustrating the method steps executed in a power switch function 204 of the overall method 200. FIGS. 12 and 13 are flow charts illustrating a mode switch function 208 portion and a reset switch function 212 portion of the overall method 200, respectively. The method steps will be described with reference to FIGS. 14*a*-19*b* which show the human interface portion 92 of the subject cable monitoring system 20 in various modes of operation corresponding to selected steps set out in FIGS. 10-13.

In step 202, the method 200 determines whether an operator of the subject device has actuated a POWER input switch 306 on an input area 304 of an operator interface panel 300 (FIGS. 14*a*-19*b*) provided on the receiver 90. Similarly, the method 200 detects in step 206 whether the operator has actuated a MODE input switch 308 on the input area 304. As well, in step 210, the method determines whether a human operator has actuated a RESET input switch 310 on the input area 304 of the operator interface panel 300. In the preferred basic function of the method 200, a power switch function 204 is executed when the power input switch 306 is actuated. Similarly, a mode switch function 208 is executed when an operator actuates the MODE input switch 308 and a RESET switch function 212 is executed when the operator actuates the RESET input switch 310. It will be understood that the sequence of steps or processing in any of the illustrated flow charts can be different.

Initially, the subject apparatus is initiated into a power on state by actuating the POWER input switch 306 whereupon the steps of the power switch function 204 shown in FIG. 11 are executed. The processor first recalls in step 220 the last screen displayed in step 222 on the output area 302 of the operator interface panel 300. A "machine type" is displayed on the output area 302 for purposes of alerting the user of a scale factor stored in the processor. As described above, the scale factor is used for purposes of scaling the counting of the relative rotational movement between the cable follower member and the drum housing. As noted above, the linear measure of cable payed from the drum is based on the circumference of the drum and, thus, its size. Accordingly, the subject preferred embodiment is configured to store a plurality of scale factors in the processor for purposes of adapting the subject device for use in a wide variety of drain cleaning apparatus of different sizes.

In step 224, a delay timer is initiated whereupon the power switch function method 204 enters into a delay loop 226 essentially waiting for the operator to actuate the MODE input switch 308. A test is performed at 228 to determine whether the operator actuated the MODE switch and, if so, the next scale factor is retrieved in step 230 from the processor and displayed on the output area 302 of the operator interface panel 300. However, if the delay loop 226 expires as determined by the delay timer test 232, the scale factor is not adjusted and the POWER switch function 204 returns to the overall control method 200 illustrated in FIG. 10.

Figure 14A:
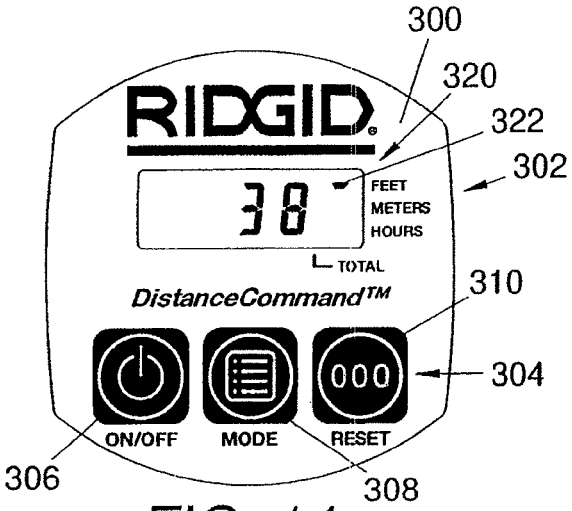
FIGS. 14*a*, 14*b* are schematic illustrations of the subject device in a RECENT_feet mode of operation.
Figure 15A:
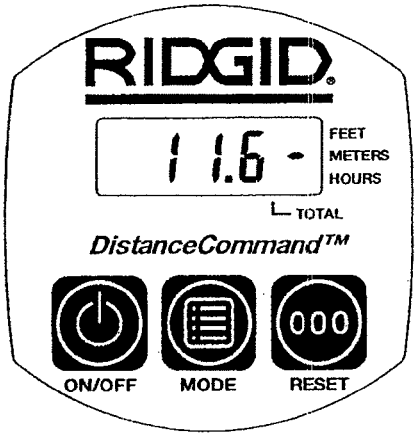
FIGS. 15*a*, 15*b* are schematic illustrations of the subject device in a RECENT_meters mode of operation.
Figure 16A:
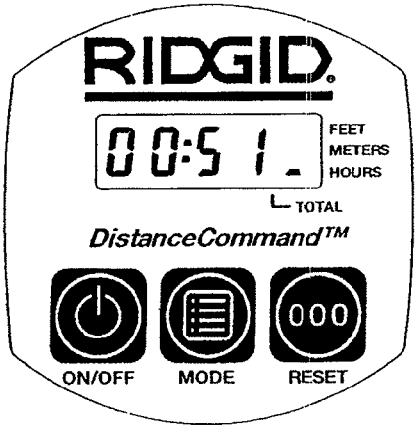
FIGS. 16*a*, 16*b* are schematic illustrations of the subject device in a RECENT_hours mode of operation.

In the event that the MODE input switch 308 is actuated by a user, the test 206 is satisfied whereupon the method 200 enters into the MODE switch function 208. With reference then to FIG. 12, the MODE switch function is configured to modify the mode state of the subject device between a plurality of predetermined states collectively depicted as 220. As shown in FIG. 14*a*, the output area 302 displays a value "38" and indicia 320 or other symbol or information such as in the form of a light bar 322. In the position shown in FIG. 14*a*, the light bar 322 is displayed in a position adjacent a legend indicative of a particular mode of operation of the subject device. More particularly, in FIG. 14*a*, the device is in a mode for displaying a linear measurement of the amount of cable 24 payed out from the device in units of feet. This is represented in FIG. 12 as "RECENT_feet." In this mode, as the operator actuates the MODE input switch 308, the MODE switch function 208 transitions from a RECENT_feet mode to a RECENT_meters mode which is displayed to the user on the output area 302 substantially as shown in FIG. 15*a*. A further actuation of the MODE input switch 308 transitions the subject device from a RECENT_meters mode to a RECENT_hours mode and displayed to the user substantially as shown in FIG. 16*a*. In the first two modes, the user of the subject device can simply read the output area 302 in order to determine an amount cable payed out from the machine and, ideally, routed into the working area such as a clogged drain or the like. In the third mode the user can read the time that the unit has been in use. This is convenient for the operator because the MODE input switch can be used to toggle the display area to show the amount of cable payed out in feet measure, metric measurement, and an amount of time that the device is in use.

Figure 17A:
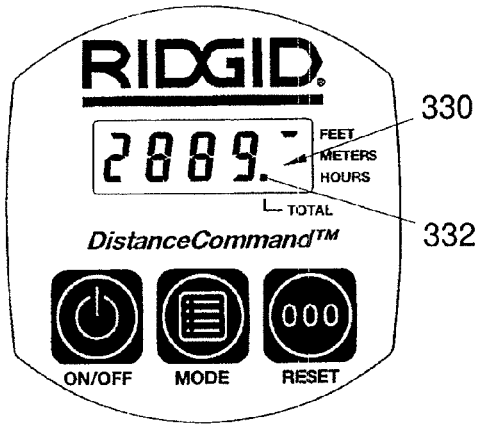
FIGS. 17*a*, 17*b* are schematic illustrations of the subject device in a TOTAL_feet mode of operation.
Figure 17B:
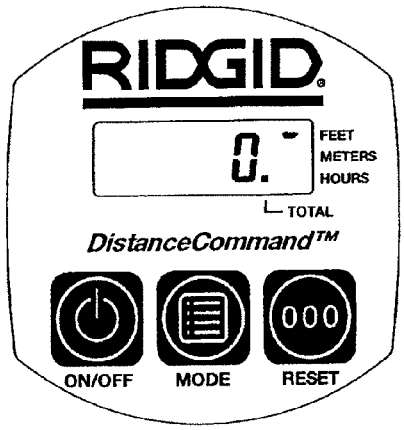
Figure 18A:
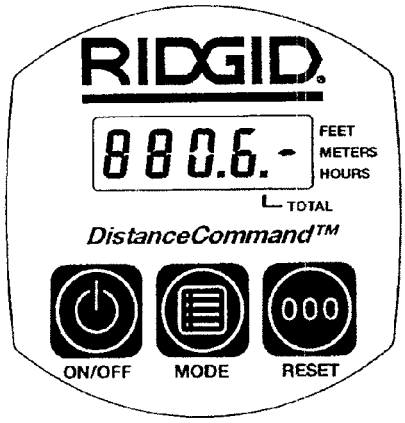
FIGS. 18*a*, 18*b* are schematic illustrations of the subject device in a TOTAL_meters mode of operation.
Figure 18B:
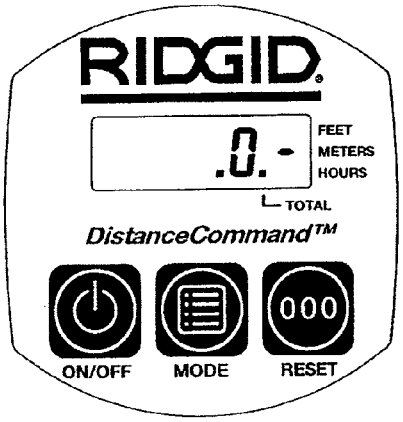
Figure 19A:
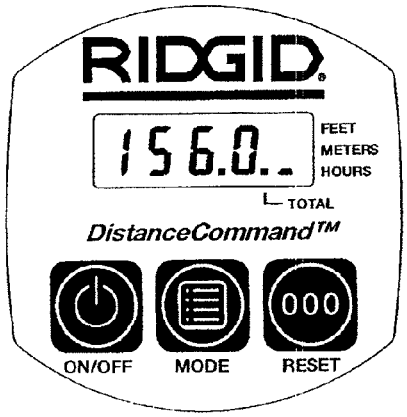
FIGS. 19*a*, 19*b* are schematic illustrations of the subject device in a TOTAL_hours mode of operation.

A further actuation of the MODE input switch 308 by the operator from a condition shown in FIG. 16*a* causes the device to transition from a RECENT_hours mode to a TOTAL_feet mode. As shown in FIGS. 17*a*-19*a*, a further indicia 330 is provided in the form of a dot 332 representative of the apparatus in an accumulated mode of counting and representation to the operator. More particularly, as shown in FIG. 17*a*, in the TOTAL_feet mode, the dot indicia 332 informs the operator that the numerical value "2889" displayed on the output area 302 is representative of an aggregate amount of linear measurement of cable pay out during use of the device on a historical basis beginning at a predetermined point in time selected by the operator in a manner to be described in greater detail below. Similarly, FIG. 18*a* shows a representation of the TOTAL_meter mode indicating that the device payed out "880" meters of cable 24 from a particular point in time selected by the user. A further actuation of the MODE input switch 308 causes, as shown in FIG. 12, the subject device to toggle or otherwise transition from a TOTAL_meters mode to a TOTAL_hours mode such as shown in FIG. 19*a*. There, as shown, the subject device was in use a total of 156 hours from a predetermined selected point in time. Essentially, therefore, the mode of the subject device is selectable by actuating the MODE input switch 308 in succession to cause the device to transition substantially in sequence from FIGS. 14*a*, 15*a*, 16*a*, 17*a*, 18*a*, 19*a*, and back again to FIG. 14*a*.

Figure 14B:
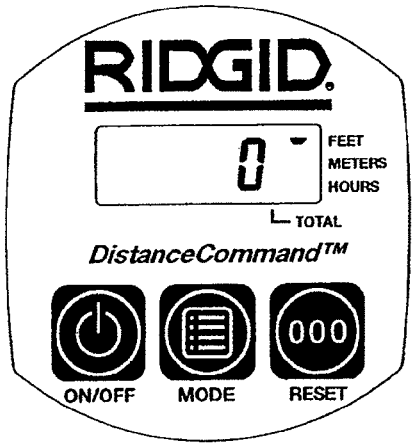
Figure 15B:
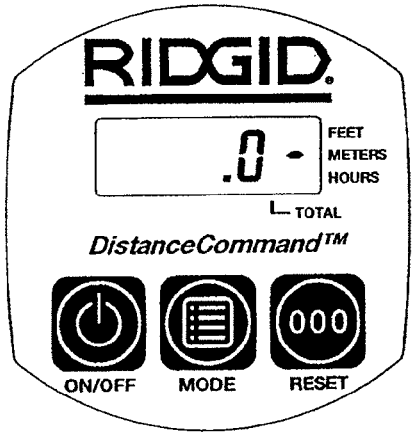
Figure 16B:
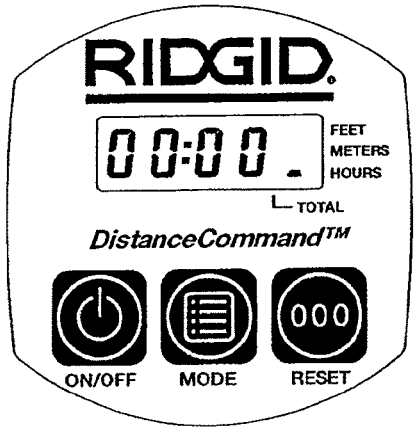
Figure 19B:
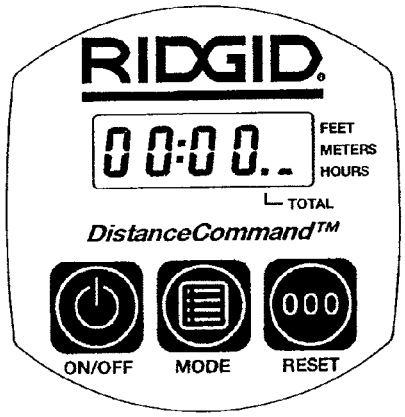

The parameter values accumulated and stored in the subject device can be reset by the operator as necessary or desired by actuating the RESET input switch 310. As shown in FIG. 10, the reset switch function 212 is initiated upon a test block 210 which receives the RESET input switch command. In FIG. 13, a test is made at step 250 whether the RESET input switch 310 is immediately released. If it is, the mode is adjusted substantially as shown in block steps 252 and as illustrated in FIGS. 14*b*, 15*b*, and 16*b*. However, if the RESET input switch 310 is not released as determined at step 250 and the unit is in the TOTAL_feet, TOTAL_meters, or TOTAL_time mode, and the MODE input switch 308 is actuated prior to releasing RESET input switch as determined at step 254, the step blocks at 256 are executed to adjust the mode of operation of the subject device substantially as shown in FIG. 13 and as illustrated in FIGS. 17*b*, 18*b*, and 19*b*. Essentially, the blocks 252 adjust the "short term" memory of the subject device while the blocks 256 adjust the "long term" memory of the device.

If it is determined at step 260 that the mode of the device is RECENT_feet, such as shown in FIG. 14*a*, the RECENT_feet parameter is reset at step 261 and as displayed in FIG. 14*b*. However, if the mode is RECENT_meters as determined at step 262, the parameter therefore is reset at step 263 and as illustrated in FIG. 15*b*. Lastly, if it is determined at step 264 that the mode of the device is RECENT_hours, the parameter is reset at step 264 and as displayed in FIG. 16*b*. Alternately, if the RESET input switch is actuated as determined at step 250 and the apparatus is in none of the first two modes identified immediately above, the RECENT_hours parameter is reset at step 265 and as illustrated in FIG. 16*b*.

When the operator actuates the RESET input switch simultaneously with the MODE input switch such as determined at steps 250 and 254, it is determined in step 270 whether the subject device is in a TOTAL_feet mode. Based upon that determination, the TOTAL_feet parameter is reset at step 271 and as shown in FIG. 17*b*. Similarly, as determined at step 272, when the apparatus is in a TOTAL_meters mode, the TOTAL_meters parameter is reset at step 273 and is illustrated in FIG. 18*b*. Lastly, as determined at step 274, when the apparatus is in a TOTAL_hours mode, the TOTAL_hours parameter is reset at step 275 and is shown in FIG. 19*b*. Alternately, when the subject device is in none of the first two above-noted "long term" memory modes, the TOTAL_hours parameter is reset at step 275 and as illustrated in FIG. 19*b*.

Figure 20:
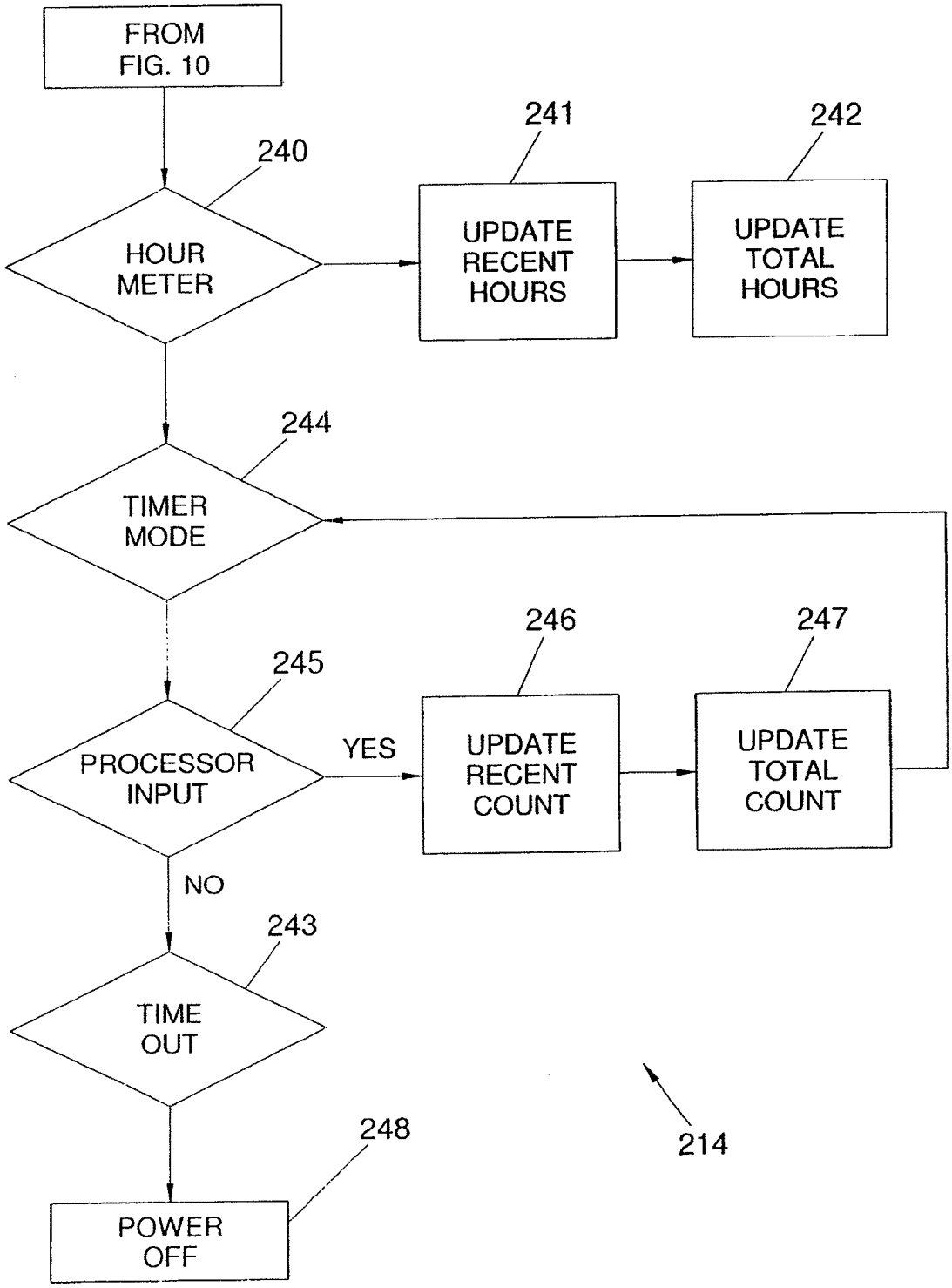
FIG. 20 is a flow chart illustrating a typical operation of the subject device.

FIG. 20 illustrates a typical normal operation 214 of the preferred apparatus in the overall method of FIG. 10. Upon initiation of normal operation 214 shown in FIG. 10, the hour meter function is initiated at 240 whereby cumulative updates for RECENT_hours and TOTAL_hours are determined and retained at blocks 241 and 242, respectively. The processor input 245 if registering a change in length signal, such as previously noted length signal 134, updates RECENT_feet and RECENT_meters and also TOTAL_feet and TOTAL_meters at blocks 246 and 247, respectively. Changes to these amounts reset a timer as depicted at block 244, thereby indicating that the apparatus is in use. If changes to these amounts do not occur, a time out signal is generated such as at block 243 whereby a power off 248 or shut down is initiated. For most applications, a time out signal is generated from block 243 after expiration of a period of from about 5 minutes to about 15 minutes, with 10 minutes being preferred. It will be understood that the present invention includes the use of time out time periods less than or greater than these amounts.

Stationary Sensor Arrays

As previously noted, the present invention also provides various embodiments which utilize a stationary sensor array which senses corresponding sensor portions or markers that are affixed to the outer drum, the inner drum, or components thereof. In this configuration, the position, movement, velocity, changes in any of these, and/or identity of one or more markers on each of the outer drum and the inner drum (or guide member or follower member), is sensed by a stationary sensor array.

More specifically, in accordance with the present invention, at least one sensor such as in a sensor array, is mounted to the frame of a drain cleaning machine such that the sensor is fixed relative to the inner and outer drums. In a preferred embodiment in accordance with the present invention, one or more markers such as magnets are mounted to or otherwise affixed to the outer drum, and one or more similar markers are similarly mounted to the rotating support structure which turns with and relative to the outer drum and serves to guide the cable from the outer drum, i.e. the cable follower, cable guide member, or inner drum.

The magnets on the inner support structure, in a preferred embodiment, are so mounted as to be approximately orthogonal to those mounted on the outer drum. This preferred orthogonal orientation is with respect to the orientation of the axes of the magnets. Thus, in this preferred orthogonal orientation, the axes of each of the magnets disposed on the outer drum extend transversely or substantially so, to the axes of each of the magnets disposed on the inner support structure. In the preferred embodiment, these magnets are strong dipole magnets. The stationary sensor or sensor array can distinguish a magnet attached to and rotating with the outer drum from a magnet attached to and rotating with the inner support structure that rotates relative to the outer drum as the cable is fed out of or into the drum.

A processing device in communication with the stationary sensor or sensor array stores and processes digital representations of the events detected by the sensor or sensors. The processing device stores parametric values describing the cable diameter, drum diameter, and the timing and sequence of impulses indicating the outer drum magnet or the inner support tube magnet are passing a sensor. A display unit provides visual and audio information to the system operator and accepts control inputs and provides display selections. Data may be transmitted wirelessly or by wired connection and may be transferable to external devices such as a laptop computer or the like. Alternative methods of detecting cable motion during operations are also contemplated.

One or more markers, such as magnets or other electromagnetic devices, are preferably embedded in, or otherwise attached to, a rotating support structure in the drain cleaning machine. One or more similar markers are also attached to the rotating cable drum that cooperates with the rotating support structure. An adjustably fixed (relative to the drum and support structure) sensor array is positioned in such a manner so as to detect the presence of one or more corresponding markers. For example, for embodiments in which one or both markers on the inner drum and the outer drum are magnets, the sensor array is positioned so that it can sense the magnetic fields, strengths, and/or angles of such, emitted by each of the magnets. A digital processor translates detections from the sensor array into useable information which is communicated to the user by means of an integrated display and control unit.

Figure 21:
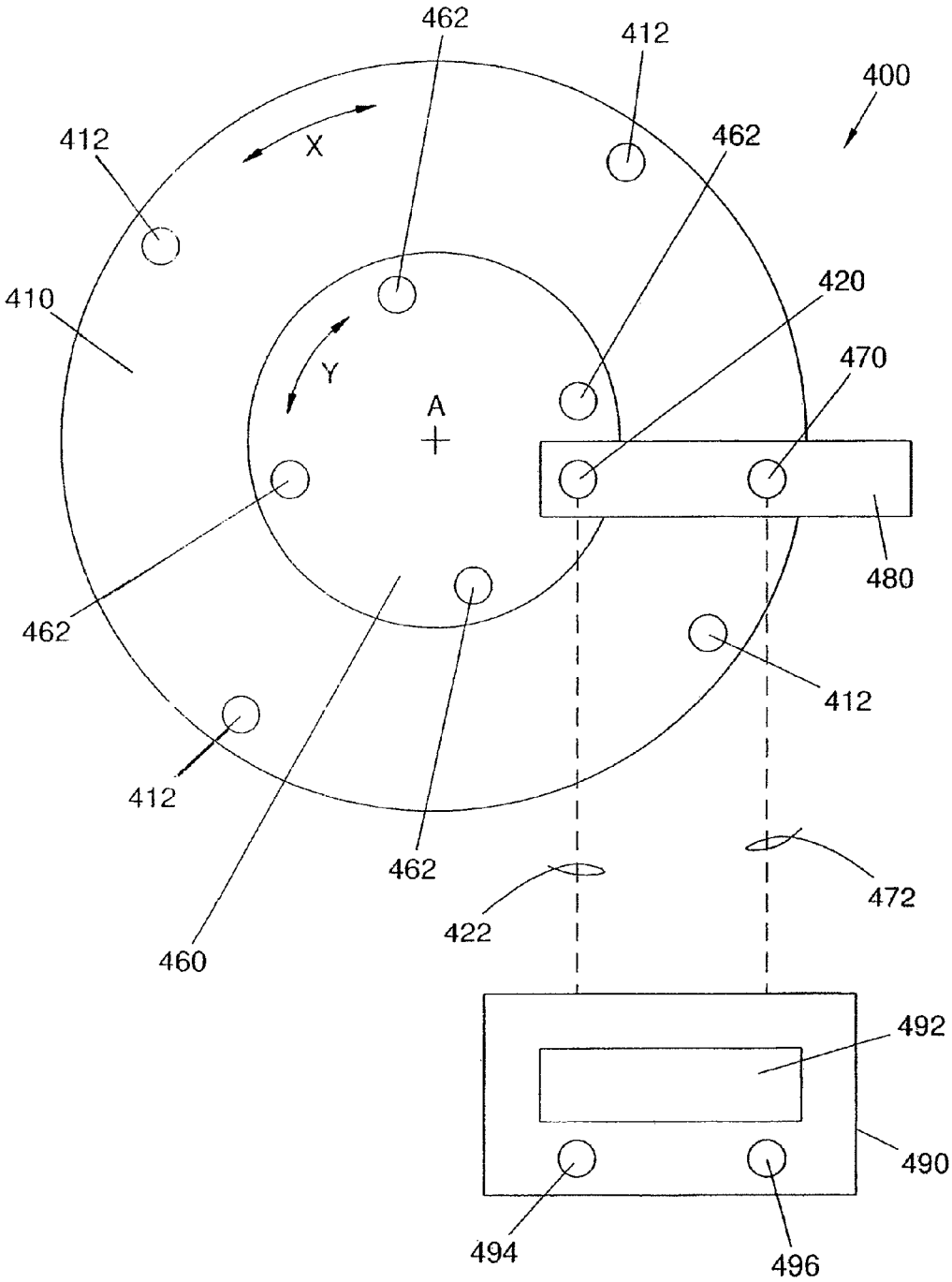
FIG. 21 is a schematic illustration of another preferred embodiment electronic cable monitoring system of the present invention.

FIG. 21 schematically illustrates another preferred embodiment in accordance with the present invention. In this aspect, a system 400 is provided comprising one or more magnets 412 affixed to an outer drum 410 of a drain cleaning device as described herein. A corresponding magnetic pickup 470 is positioned on a support member 480 and located so as to register or sense a corresponding magnet 412 passing thereby as the drum 410 rotates. The outer drum 410 rotates in directions shown by arrow x, about an axis of rotation A. Similarly, one or more magnets 462 are affixed to an inner drum 460. A corresponding magnetic pickup 420 is positioned on the support member 480 and located so as to register or sense a corresponding magnet 462 passing thereby as the drum 460 rotates. Inner drum 460 rotates in directions y, about the axis of rotation A. Electronic signals 422 and 472 are transmitted from the pickups 420 and 470, respectively to an electronic processor and indicator module 490. The module 490 calculates relative rotations between the drums 410 and 460 and then indicates the corresponding length of flexible member or snake that has been payed out, at indicator 492. The module 490 may include a reset and/or power switch 494 and a calibration mode switch 496 to adjust the indication of cable length payed out, to a specific drain cleaning device. The signals 422 and 472 may be transmitted wirelessly, such as by RF or IR, or may be transmitted by cables between the pickups and the module.

Figure 22:
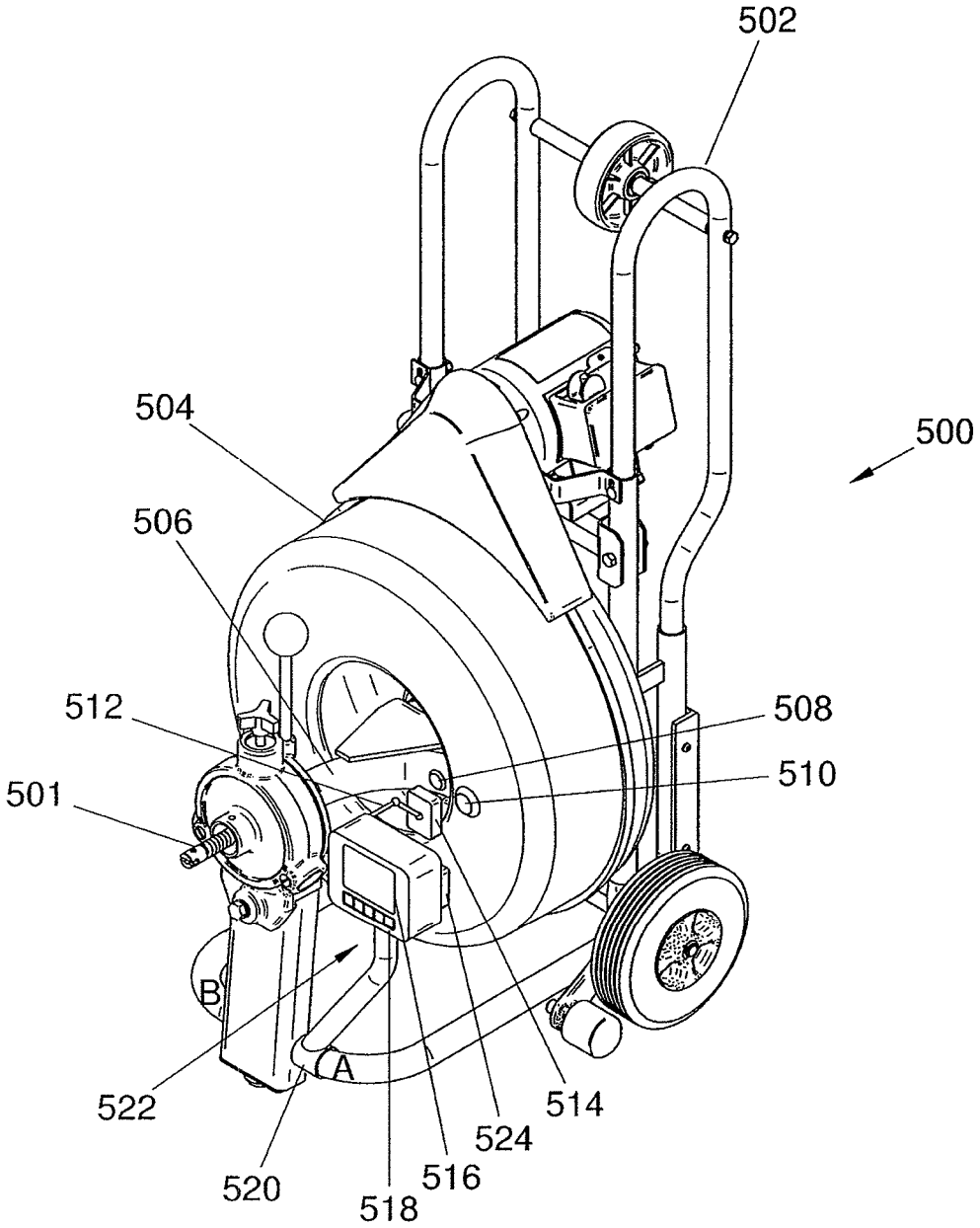
FIG. 22 is a perspective view of a drain cleaning apparatus with an electronic cable monitoring system in accordance with another preferred embodiment of the present invention.

Turning to FIG. 22, another preferred embodiment drain cleaning device of the present invention is illustrated. A drain cleaning apparatus 500 comprises a rigid frame 502. A rotating circular drum 504 stores a resilient flexible cable 501 having an outer sheathing typically formed from steel winding. The cable 501 passes through an independently rotating support structure 506. The support structure 506 serves to guide the cable 501 from the drum 504 as the cable 501 is displaced from the apparatus. The support structure 506 tends to be rotated by the forward motion of the cable 501 as it unwinds from the drum 504 and is drawn into a linear path. The cooperation of the rotating drum 504 and the rotating support structure 506 significantly reduces the occurrence of loops of the cable 501 from exiting the drum 504, formation of kinks, jamming, and other undesirable conditions in the drum.

Preferably, one or more electromagnetic markers 508 such as a neodymium-boron high strength magnet, for example, are mounted on the rotating support structure 506. And, one or more like markers 510 are mounted on the outer surface of the rotating storage drum 504. An adjustable arm 512 joins a sensor array 514 with a control and display unit 522 which comprises, in turn, a display screen 516, a control panel 518 and a rigid support tube with an adjustable attachment clamp 520. Because the arm 512 which positions the sensor array 514 is adjustable, the display and control unit 522 can be located at the operator's convenience, for example at location A or location B. The sensor array 514 may be contained inside unit 522. The sensor or array of sensors is capable of distinguishing between a marker rotating with the drum 504 and a marker attached to and rotating with the support structure 506. The resilient flexible cable 501 of the drain cleaning system permits the attachment of various heads for inspecting, cutting, jetting, auguring or otherwise addressing obstructions discovered down-pipe as known in the art.

Further in FIG. 22, a wireless node 524 is incorporated in the preferred embodiment, and which is capable of receiving sensor information such as motor current information wirelessly. The wireless node 524 may also transmit operational data to a wireless receiver associated with an external computing device. Sensor array 514 may incorporate programmable digital magnetic sensors.

In another embodiment of the present invention, the wireless node and processing unit are coupled to a wired access, such as a USB, Ethernet or Firewire port through which the device may download stored data. In one embodiment, the wireless node may send data to, and receive data from, a pipe-inspection camera system. The cable feed measuring device may also include a signal transmitter (not shown) capable of placing a traceable signal onto the cable for the purpose of locating the cable using an industry standard locator.

In a preferred embodiment of the present invention, the cable monitoring system is integrated into a newly assembled drain cleaning machine. In an alternative embodiment of the present invention, the cable monitoring system and control and display unit may be configured as a retrofit unit or kit adaptable for addition to existing drain cleaning machines. The measuring system may be battery powered, and the internal battery may be recharged by the measuring device drawing energy from the changing magnetic field caused by magnets attached to the rotating drum. In an alternative embodiment, one or more LED work lights or other sources of illumination may be integrated or removeably attached.

Figure 23:
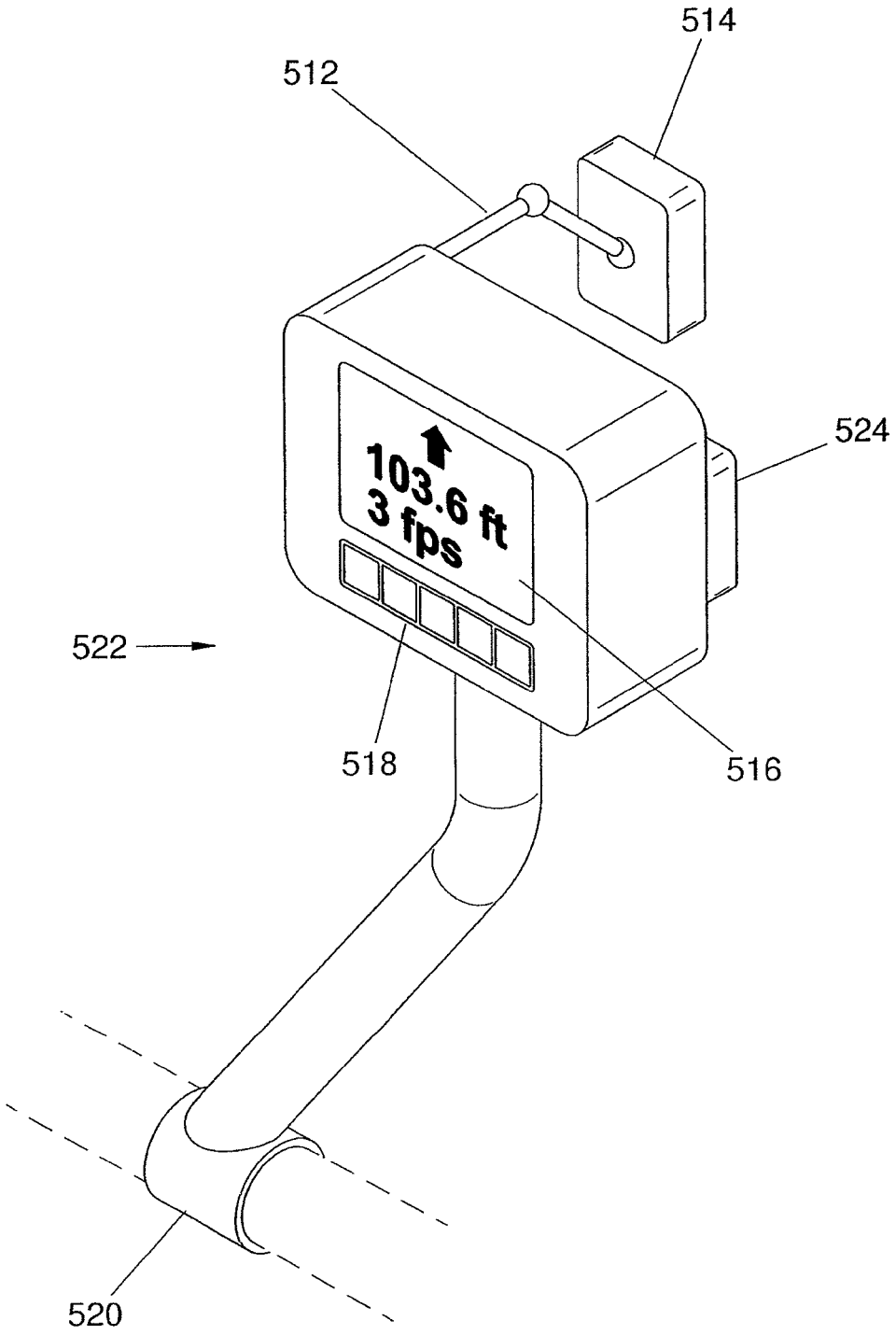
FIG. 23 is a perspective view of an embodiment of a control and display unit used in one version of the cable monitoring system in accordance with the present invention.

Turning to FIG. 23, the control and display unit 522 is shown in greater detail. A control panel 518 comprises one or more buttons or actuation members allowing an operator to zero the counter, set operating parameters, define selected distance start points, and the like. In an alternative embodiment, a single push button or actuator is used to power on and zero the measuring device, and a single long push, such as greater than 1 second, used to power the device down. The measuring device may use an induced current signal due to a changing magnetic field to automatically power on and set a session zero point. Further in FIG. 23, a display panel 516 is associated with a processing device. Information displayed may be set to metric or English units as desired. Panel 516 displays distance, as well as direction, rate of feed, rate of rotation, date and time information, etc., as selected for display by the operator. The control unit is joined by an adjustable arm 512 to a sensor node 514, which in the preferred embodiment may be a two-axis or three-axis magnetic sensor or an array of magnetic sensors selected for compatibility with the marker devices used. The tubular support of the control and display unit 522 includes an adjustable clamp 520 so situated as to allow convenient location of the sensor and display system to the drain cleaning machine, such as by attachment to the tubular frame of the machine. As previously noted, a wireless node 524 may be provided in conjunction with the unit 522.

In another embodiment of the present invention, the marker units are dipole magnets, oriented such that the drum marker and the support structure marker are approximately orthogonal. Preferably, the magnets on the outer drum are disposed or approximately so, within a common plane transverse to the rotational axis of the drum. And, preferably, the magnets on the inner support structure are disposed or approximately so, within a common plane transverse to the rotational axis of the support structure. These two planes are preferably parallel to one another and may in certain applications be coplanar or substantially so. Preferably, the magnets on the outer drum and on the inner support structure are aligned such that at least in the sensing vicinity of a corresponding stationary sensor or sensing array, the axes of the respective magnets are transverse to one another or at least substantially so. Thus, using this preferred configuration, the magnetic field lines emitted from the magnets passing near two separate sensors or a single two-axis or three-axis sensor have distinctly distinguishable orientations relative to one another, thereby enabling the processing unit to readily distinguish between the markers. The measuring device thereby can compute and display cable feed as well as the rotation rate and direction of rotation of the drum(s).

Figure 27:
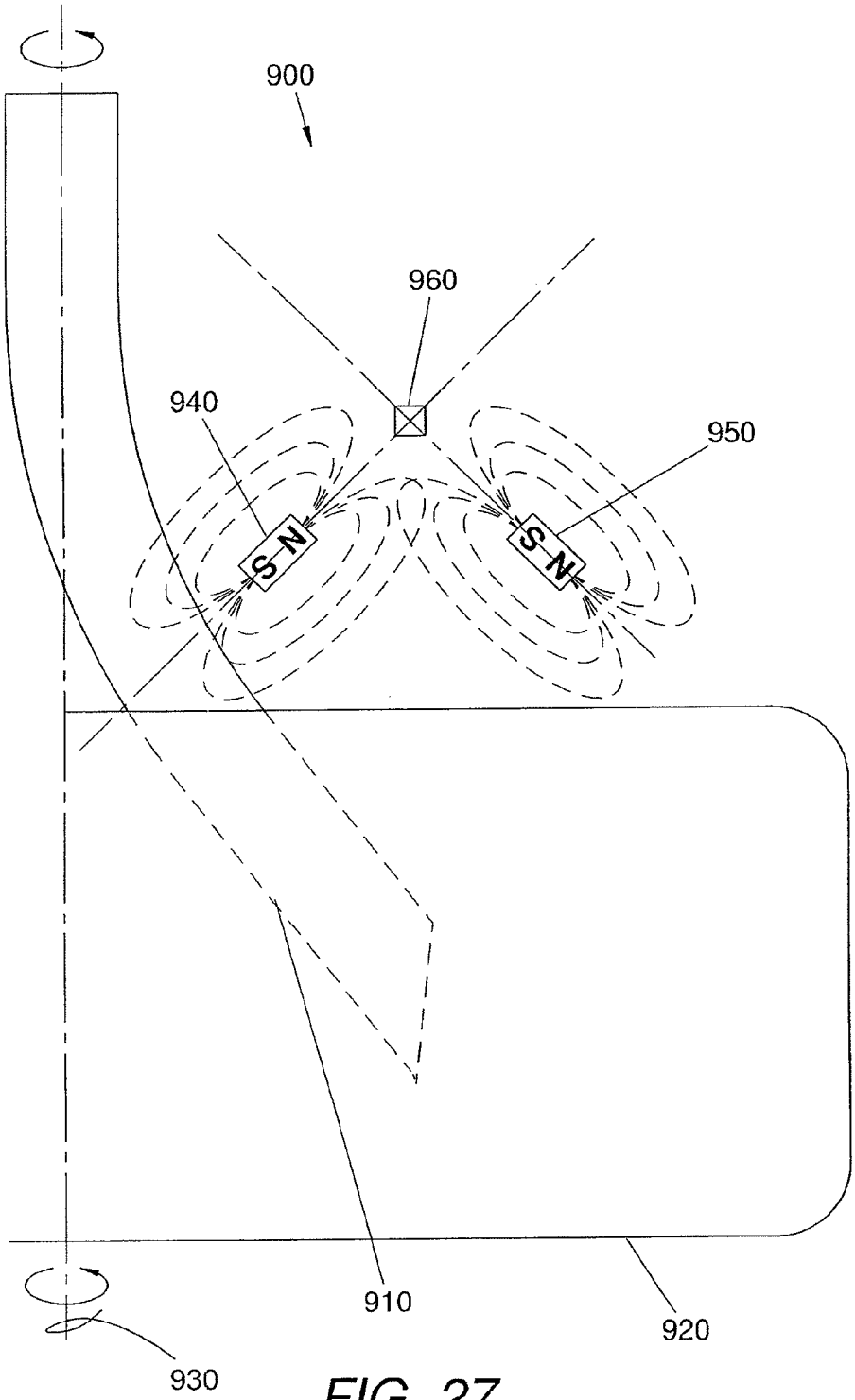
FIG. 27 is a schematic illustration of a preferred embodiment sensor and magnetic marker configuration in accordance with the present invention.

Referring to FIG. 27, a schematic illustration of another preferred sensor and marker configuration is shown. A preferred sensor system 900 is depicted comprising a first permanent magnet 940 affixed or otherwise attached to an inner cable guide member 910 or inner drum as described herein, a second permanent magnet 950 affixed or otherwise attached to an outer drum 920 as described herein, and a stationary sensor 960. The sensor or sensor array 960 preferably includes one or more three-axis magnetic sensors. The inner cable guide member 910 and the outer drum 920 are rotatable about a common axis of rotation 930. Preferably, the first magnet 940 is oriented such that one of the poles of the magnet 940 such as its north pole is directed towards the sensor 960. Preferably, the second magnet 950 is oriented such that one of its poles and preferably the pole opposite from the pole of the first magnet 940 directed toward the sensor 960, is also directed toward the sensor 960.

In a preferred embodiment, the operator may use the display control interface to set visual and/or audible announcements. Zero points or reset to zero, points of interest, such as designating the beginning of the pipe or a point of obstruction encountered down the pipe, from which relative advance may be reported. A predetermined feed length may be set by the operator and a visual and audible announcement of distance and/or visual and audible signal may be employed to alert the operator when the point of interest is approached.

Figure 24:
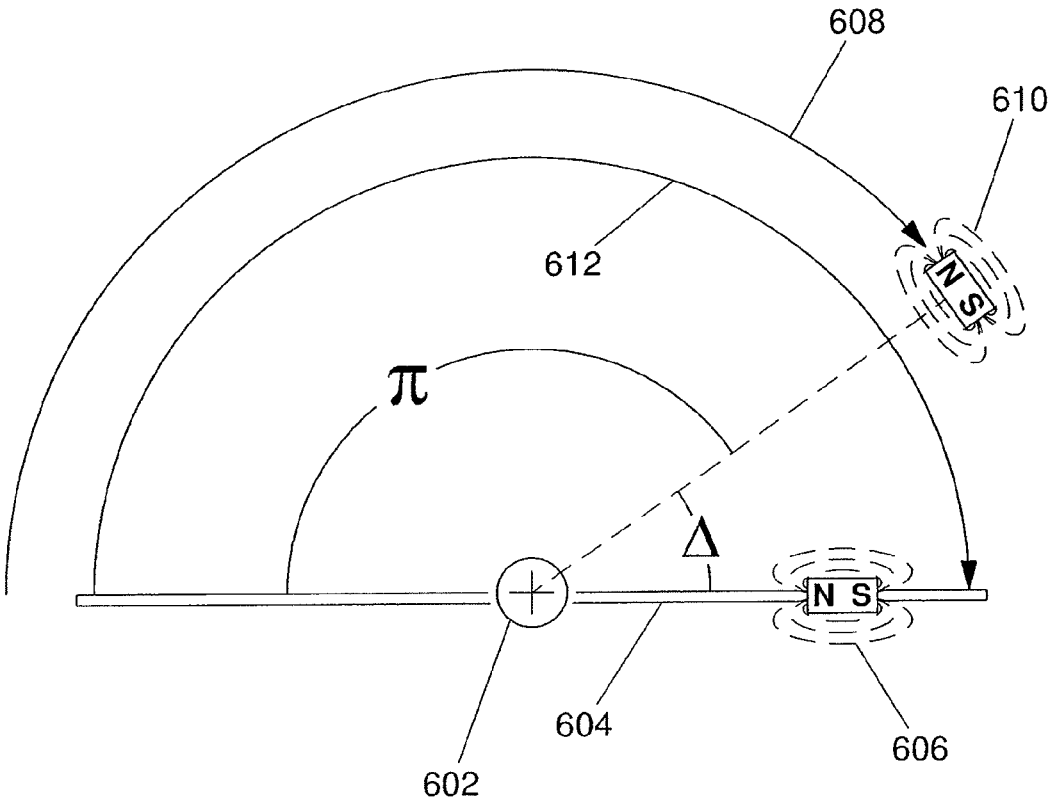
FIG. 24 is a schematic illustration of a preferred relationship of orthogonal marker fields associated with rotating components in accordance with the present invention.

Turning to FIG. 24, the relative motion of a collection of markers around an axis of rotation 602 of an outer drum and an inner support structure (i.e. an inner drum or cable follower) in one embodiment is illustrated. In FIG. 24, drum marker 610 is shown to have rotated through an angle of rotation 608 while the support structure 604 corresponding to marker 606 has traversed an angle of rotation 612. Because of the relative orientation of marker 610 and marker 606, it is possible for a sensor array to discriminate between the markers. It is also possible for the sensor to detect the angle at which each marker passes the sensor, and for angle $\pi$ and angle $\Delta$ to be computed and compared to the rotation of the support structure ($\pi+\Delta$) 612. As previously explained herein, by assessing and more specifically, determining the extent of relative rotation and other aspects between these two components, the electronic cable monitoring system can readily provide important information to an operator as to amount of cable payed out from a drain cleaning machine.

In an alternative embodiment of the present invention, the cable monitoring system uses a three-axis sensor to detect motion of the markers. Alternatively, a single two-axis sensor, or multiple single-axis sensors may be used. In a two sensor configuration, the axis of one sensor may be located orthogonal to the axis of the second sensor.

Markers

A wide array of markers may be used in the present invention such as, but not limited to, magnetic markers, radio frequency identification (RFID) tags, optical markers, infrared (IR) markers, ultrasonic markers, and combinations thereof. Each of these marker types is described in greater detail below. Although the use of a variety of marker types is described herein, it will be appreciated that in many of the preferred embodiments described herein, magnetic markers are preferred.

Magnetic Markers

As noted, a wide array of markers can be used in association with the various preferred embodiments described herein. Most preferably, the markers are magnets or magnetic markers. In such embodiments, appropriate sensors are used for detecting the magnetic field emitted by the magnet(s), which in turn can provide information as to the position, movement, velocity, changes in any of these, and/or identity of the magnetic marker(s). Magnetic markers are preferred, as magnetic sensors are relatively immune to dirt and debris which is typically encountered during use of drain cleaning machines.

A magnetic field is a vector quantity that has both magnitude and direction. Magnetic sensors measure this quantity in various ways. Some magnetometers measure total magnitude but not direction of the field (scalar sensors). Others measure the magnitude of the component of magnetization which is along their sensitive axis (omni-directional sensors). This measurement may also include direction (bi-directional sensors). Vector magnetic sensors have two or three bi-directional sensors. Some magnetic sensors have a built-in threshold and produce an output only when that threshold is passed. A variety of magnetic sensors can be used such as, but not limited to reed switches, Variable Reluctance Sensors, Fluxgate Magnetometers, Magneto-Inductor Sensors, and Hall Devices as well as solid state sensors including Anisotropic Magnetoresistive (AMR) Sensors and Giant Magnetostrictive (GMR) Sensors.

Most industrial sensors use permanent magnets as a source of the detected magnetic field. These permanent magnets can in certain applications magnetize, or bias, ferromagnetic objects close to the sensor. The sensor then detects the change in the total field at the sensor. Bias field sensors not only must detect fields which are typically larger than the Earth's field, but they also must not be permanently affected or temporarily upset by a large field. Sensors in this category include reed switches, InSb magnetoresistors, Hall devices, and GMR sensors which can detect fields down to the milligauss region. Magnetic sensors are commercially available from numerous suppliers such as for example from Honeywell, Inc.

A reed switch generally includes a pair of flexible, ferromagnetic contacts hermetically sealed in an inert gas filled container. The magnetic field along the long axis of the contacts magnetizes the contacts causing them to attract one another thereby closing the circuit. There is usually considerable hysteresis between the closing and releasing fields so they are quite immune to small fluctuations in the field.

Reed switches are maintenance free and have a high immunity to dirt and contamination. Rhodium plated contacts insure long contact life. Typical capabilities are 0.1 to 0.2 A switching current and 100 to 200 V switching voltage. Contact life is measured at $10^6$ to $10^7$ operations at 10 mA. Reed switches are available with normally open (NO), normally closed (NC), and class C (SPDT) contacts. Latching reed switches are also available. Mercury wetted reed switches can switch currents as high as 1 A and have no contact bounce.

Low cost, simplicity, reliability, and zero power consumption make reed switches popular in many applications. A reed switch together with a separate small permanent magnet make a simple proximity switch often used in security systems to monitor the opening of doors or windows. The magnet, affixed to the moveable part, activates the reed switch when it comes close enough.

A Hall sensor or Hall Effect sensor predominantly uses n-type silicon when cost is of primary importance and GaAs for higher temperature capability due to its larger band gap. In addition, InAs, InSb, and other semiconductor materials are gaining popularity due to their high carrier mobilities which result in greater sensitivity and in frequency response capabilities above the 10 to 20 kHz of Si Hall sensors. Hall sensors are commercially available such as from Melexis USA.

It is also contemplated that instead of utilizing magnets or magnetic markers as described herein, the present invention may employ a strategy in which one or more select regions of an outer drum and/or an inner drum are magnetized. The select magnetized regions can then serve as magnetic field emitting regions which provide information to a corresponding sensor or sensor array as to the rotational position, velocity, or acceleration of the rotating component.

A wide array of permanent magnets can be used in the present invention. Preferred permanent magnets include, but are not limited to neodymium (NIB) magnets, and Alnico magnets.

A neodymium magnet or NIB magnet, a variety of a rare earth magnet, is a permanent magnet made of an alloy of neodymium, iron, and boron—$Nd_2Fe_{14}B$. They are generally considered the strongest type of permanent magnets.

Alnico is an acronym referring to alloys which are composed primarily of aluminum (Al), nickel (Ni) and cobalt (Co), hence al-ni-co, with the addition of iron, copper, and sometimes titanium, typically 8-12% Al, 15-26% Ni, 5-24% Co, up to 6% Cu, up to 1% Ti, and the balance of Fe.

Although not wishing to be limited to any particular configuration when using magnetic markers and one or more magnetic sensors, it is preferred that the magnetic sensor be positioned such that as the one or more magnetic markers pass near the sensor, the markers are at least within about 4 inches from the sensor. More preferably, the markers should pass within at least 3 inches of the sensor. Relative close proximity between the sensor and magnetic markers is particularly desirable for assessing instantaneous velocity of the marker and the component to which it is affixed, i.e. an inner drum or an outer drum.

It is also contemplated that when using a plurality of magnetic markers such as magnets spaced equidistant about a peripheral region of an outer drum and/or an inner drum, that the magnets be oriented such that their poles are alternating relative to the poles of neighboring magnets immediately adjacent thereto. For example, for an outer drum having four magnets affixed about its periphery, each separated by 90°, it is preferred that a pair of oppositely situated magnets have their north poles directed towards one another, and the remaining pair of oppositely situated magnets have their south poles directed towards one another. This arrangement strategy can assist in providing additional information to the processor as to rotational position of the drum.

RFID Markers

In yet another aspect, the present invention includes the use of RFID tag(s) and reader(s) as the markers and sensors, respectively, for assessing rotation of either or both of the inner and outer drums. That is, in this preferred aspect, one or more radio frequency identification (RFID) tags are secured to the inner and outer drums, and one or more corresponding RFID reader(s) are used to sense the rotation(s) of each drum. A significant feature of this aspect is the relatively low cost and widespread availability of RFID tag systems.

Most RFID tags contain at least two parts. One is an integrated circuit for storing and processing information, modulating and demodulating a (RF) signal, and other specialized functions. The second is an antenna for receiving and transmitting the signal. Chipless RFID allows for discrete identification of tags without an integrated circuit, thereby allowing tags to be printed directly onto assets at a lower cost than traditional tags.

RFID tags come in three general varieties: passive, active, or semi-passive, also known as battery-assisted. Passive tags require no internal power source, thus being pure passive devices since they are only active when a reader is nearby to power them. In contrast, semi-passive and active tags require a power source, usually a small battery. To communicate, tags respond to queries from generated signals that should not create interference with the readers, as arriving signals can be very weak and must be differentiated. Besides backscattering, load modulation techniques can be used to manipulate the reader's field. Typically, backscatter is used in the far field, whereas load modulation applies in the nearfield, within a few wavelengths from the reader.

In a preferred embodiment, passive RFID tags are utilized. Passive RFID tags have no internal power supply. The minute electrical current induced in the antenna by the incoming radio frequency signal provides just enough power for the CMOS integrated circuit in the tag to power up and transmit a response. Most passive tags signal by backscattering the carrier wave from the reader. Typically, the antenna collects power from the incoming signal and also transmits the outbound backscatter signal. The response of a passive RFID tag is not necessarily just an ID number, the tag chip can contain non-volatile, possible writable EPROM for storing data.

The preferred embodiment RFID tags and corresponding readers are commercially available from numerous sources such as, but not limited to Remote Identity of Erie, Colo.; Omni-ID of Menlo Park, Calif.; Sokymat S.A.; and Intermec Technologies of Everett, Wash.

Incorporating RFID tags into the preferred embodiment systems provides additional advantages over the use of magnets or like sensor sets. Since each RFID tag can be configured with a unique identifier, only a single reader is necessary. Thus a single RFID reader can be used to register movement, i.e. rotation, of RFID tags on both inner and outer drums. In addition, the RFID reader could be housed within the cable monitoring system indicator module or other existing component of the drain cleaning apparatus.

Figure 37:
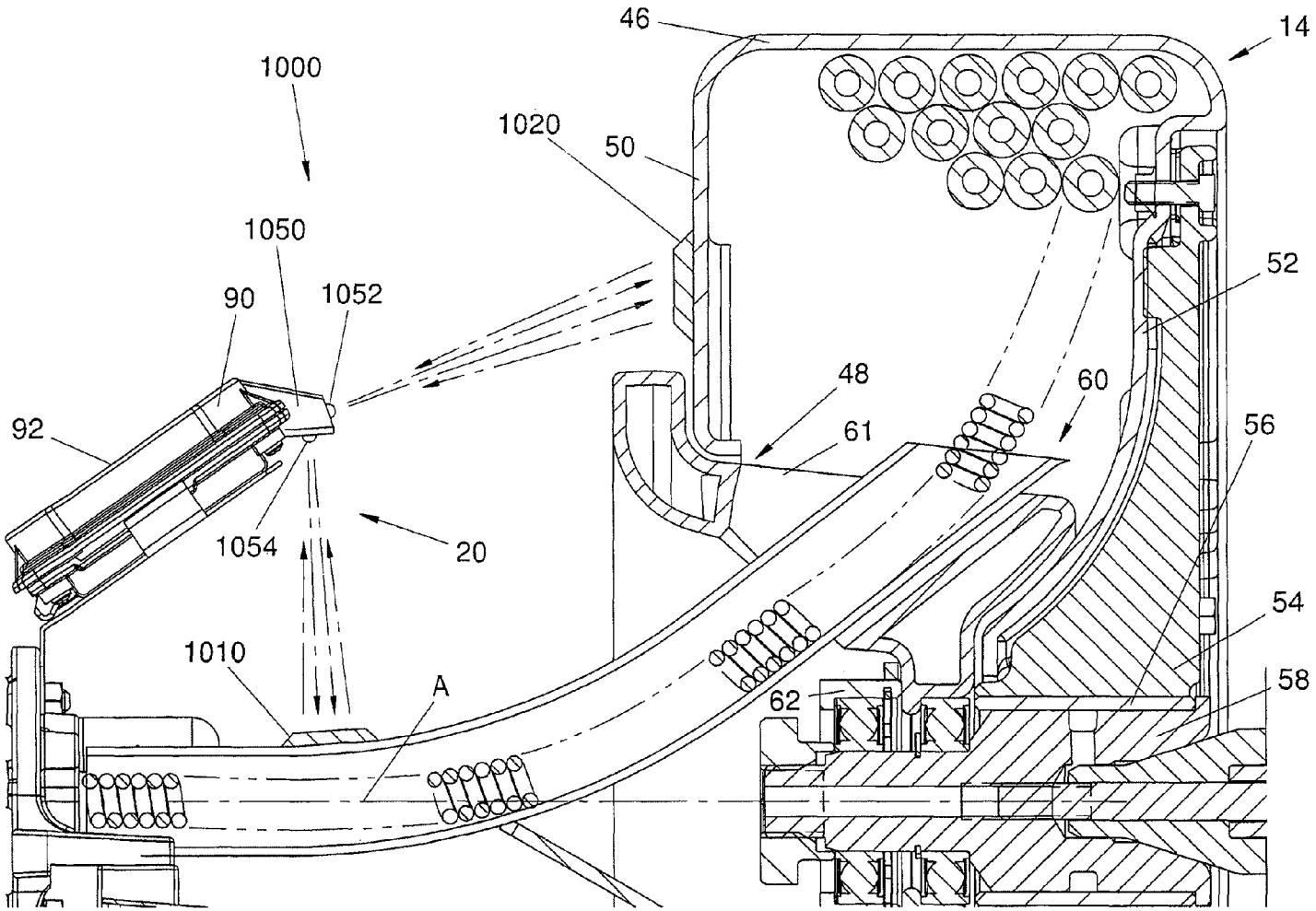
FIG. 37 is a partial cross-sectional view of a drain cleaning device with another preferred embodiment electronic cable monitoring system in accordance with the present invention.

FIG. 37 illustrates a representative mounting arrangement for an RFID-based sensing system, denoted as system 1000. Specifically, FIG. 37 is a partial cross sectional view of a drain cleaning device having an outer drum and a cable guide member as previously described in association with FIG. 2. And so, many of the various reference numbers in FIG. 37 are described in conjunction with the previous description of FIG. 2. FIG. 37 schematically depicts an RFID-based sensing system 1000 incorporated in the drain cleaning device. The system 1000 comprises a stationary RFID sensor array 1050. One or more RFID markers are affixed to appropriate regions of an outer drum and a cable guide member. Specifically, a plurality of passive RFID markers 1020 are equidistantly spaced along and affixed to an outer region of the drum 14. And, a plurality of passive RFID markers 1010 are equidistantly spaced along and affixed to an outer region of the cable guide member 60. The RFID sensor array 1050 emits an RF signal to the markers 1020 on the drum 14. In response to that signal, the markers 1020 emit a return signal which can be sensed by sensor 1052 of the array 1050. Similarly, the RFID sensor array 1050 emits an RF signal to the markers 1010 on the cable guide member 60. In response to that signal, the markers 1010 emit a return signal which can be sensed by sensor 1054 of the array 1050. Analysis of the sensed signals from the markers 1010 and 1020 provides information as to the relative rotations of the drum 14 and the guide member 60, and thus the change in cable payed out or retracted.

It is also contemplated that a collection of RFID markers could be used in which each RFID marker is unique, or rather emits a unique signal. This strategy enables ready determination of the direction of rotation of an inner and/or outer drum. That is, by inputting information to a processor as to the arrangement or order of RFID markers about the periphery of a drum, upon sensing rotary motion of the drum, the processor can assess the direction of rotation of the drum by identifying the sequence of RFID markers passing a sensor.

It is also contemplated to incorporate other information into RFID markers, which information may be provided to the processor of the sensing system and/or to the operator of the drain cleaning machine. For example, information may be included in RFID tag(s) affixed to outer drums that includes information concerning the cable within the outer drum. Thus, upon changing outer drums, an operator would not have to input information into the processor or drain cleaning machine as to cable length, cable diameter, cable type . . . etc.

Other Markers

It will be appreciated that a wide array of markers, marker types, and combinations of markers and marker types can be used in accordance with the present invention. In addition to the previously noted magnetic markers and RFID markers, the marker or marker device may also be a tuned circuit and frequency sensor, capacitative devices, digital magnetic sensors, variable reluctance devices or other electro-magnetic markers or combinations thereof. Capacitative proximity switches detecting molded protuberances in the drum and support structure may also be used. Additional examples of markers are described in greater detail herein.

In an alternative embodiment, optical markers and optical detectors are used capable of responding to optical changes caused by the rotary or linear motion of a component or marking on a component, such as, for example, a bar-code marking on the surface of the drum. The present invention includes the use of a wide array of optical-based sensing components and configurations. For example, a slotted, light-blocking configuration can be used to assess rotational speed and/or position. Light reflective sensors can also be used.

Figure 38:
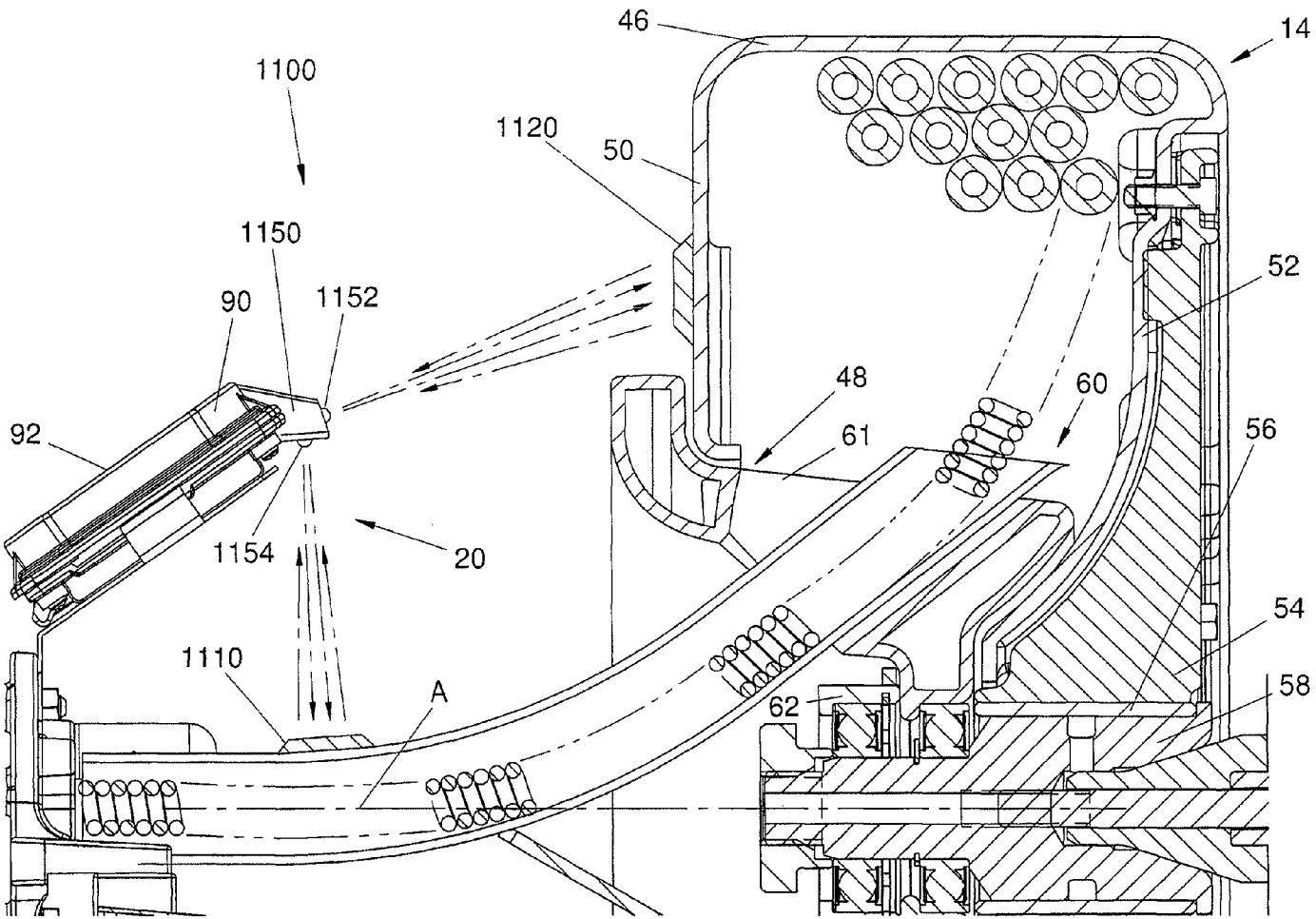
FIG. 38 is a partial cross-sectional view of a drain cleaning device with another preferred embodiment electronic cable monitoring system in accordance with the present invention.

FIG. 38 illustrates a representative configuration for an optical based sensing system 1100. FIG. 38 corresponds to previously described FIG. 2 and so reference to many of the item numbers in FIG. 38 is provided in the description of FIG. 2. The markers 1110 and 1120 can be in the form of light-reflective markers which return a light signal emitted from a light-based sensor array 1150. Corresponding light sensors 1152 and 1154 detect light reflected from the markers 1120 and 1110, respectively.

Infrared (IR) markers and corresponding IR sensors can also be used. Sensing systems using infrared emissions, i.e. electromagnetic radiation having a wavelength of from about 1 mm to about 750 nm, are well known and commercially available. A mounting configuration for an IR system is similar as that depicted in FIGS. 37 and 38 except that the markers may either be mounted on or constitute transversely extending ribs or other projections in the outer drum and/or the cable guide member. The changing orientation of the outer surfaces of the outer drum and/or cable guide member and ribs, enable detection of ribs or other regions of the rotating components moving past an IR sensor.

It is also contemplated that ultrasonic markers and corresponding ultrasonic sensors could be used. Ultrasonic based sensing systems utilize acoustic waves having a frequency greater than the upper limit of human hearing, i.e. greater than about 20,000 Hz. A wide array of ultrasonic sensing and detection systems are known and commercially available. A mounting configuration for an ultrasonic system is similar to that for an IR system, and can utilize transversely extending ribs or other outwardly projecting members to alter the outer surface of a rotating component and thereby provide detection as to its angular position and/or velocity.

The various markers may be attached to the outer drum and the inner drum (or cable guide member, cable follower, or inner support structure) in various ways. For example, the markers can be affixed to the respective component by mechanical means such as by threaded fasteners, brackets, and other coupling assemblies. Alternately or in addition, the markers can be affixed by use of adhesives. It is also contemplated that the markers may be molded in-situ with the respective component so long as the marker can withstand the molding conditions. It is known that many magnets are sensitive to high temperatures and so this should be considered. In a preferred aspect, one or more recessed receiving regions are formed in each of the respective components, such as during molding, which then receive the markers via an interference press fit.

The number of markers affixed to each rotatable component may also vary. Preferably, from about 1 to about 10 markers are used in association with each of the outer drum and the inner drum or equivalent component(s). More preferably, from 1 to 6 markers are used for each component. It will be appreciated that the present invention includes greater numbers of markers. Typically, the higher the number of markers, the higher the resolution that can be achieved in assessing relative rotation between the two rotating members. Preferably, in certain embodiments, the markers are spaced equidistant from one another about each component, such as along a peripheral outer surface region. It is also contemplated that in other embodiments, it may be preferred to position the collection of markers in a non-uniform fashion. Using such a non-uniform spacing between markers enables the determination of the direction of rotation of the rotating component.

Additional Features

It is also contemplated that the sensor unit, such as the sensor array in many of the preferred embodiments described herein, be easily removable from the drain cleaning device. This feature enables the unit to then be readily interfaced or placed into communication with one or more other devices such as a computer or data storage device.

As will be appreciated, in view of the typical harsh environments associated with most drain cleaning operations, the cable monitoring system described herein is preferably highly resistant to vibration. Also, it is preferred that the components be designed for use in wet or humid environments. Component design should also anticipate use in temperatures of from 0° F. to 120° F., and storage temperatures of about −20° F. to about 150° F. The various operator displays can be LCD displays having a minimum of 16 characters per line and at least 2 lines, utilizing 5 mm high characters. A 122×32 graphic display is also acceptable. User interface buttons or actuation members are preferably of the membrane type.

Additional Operational Features

Regardless of whether a movable sensor array configuration or a stationary sensor array configuration is used, the electronic cable monitoring system can utilize one or more of the following aspects.

Figure 25:
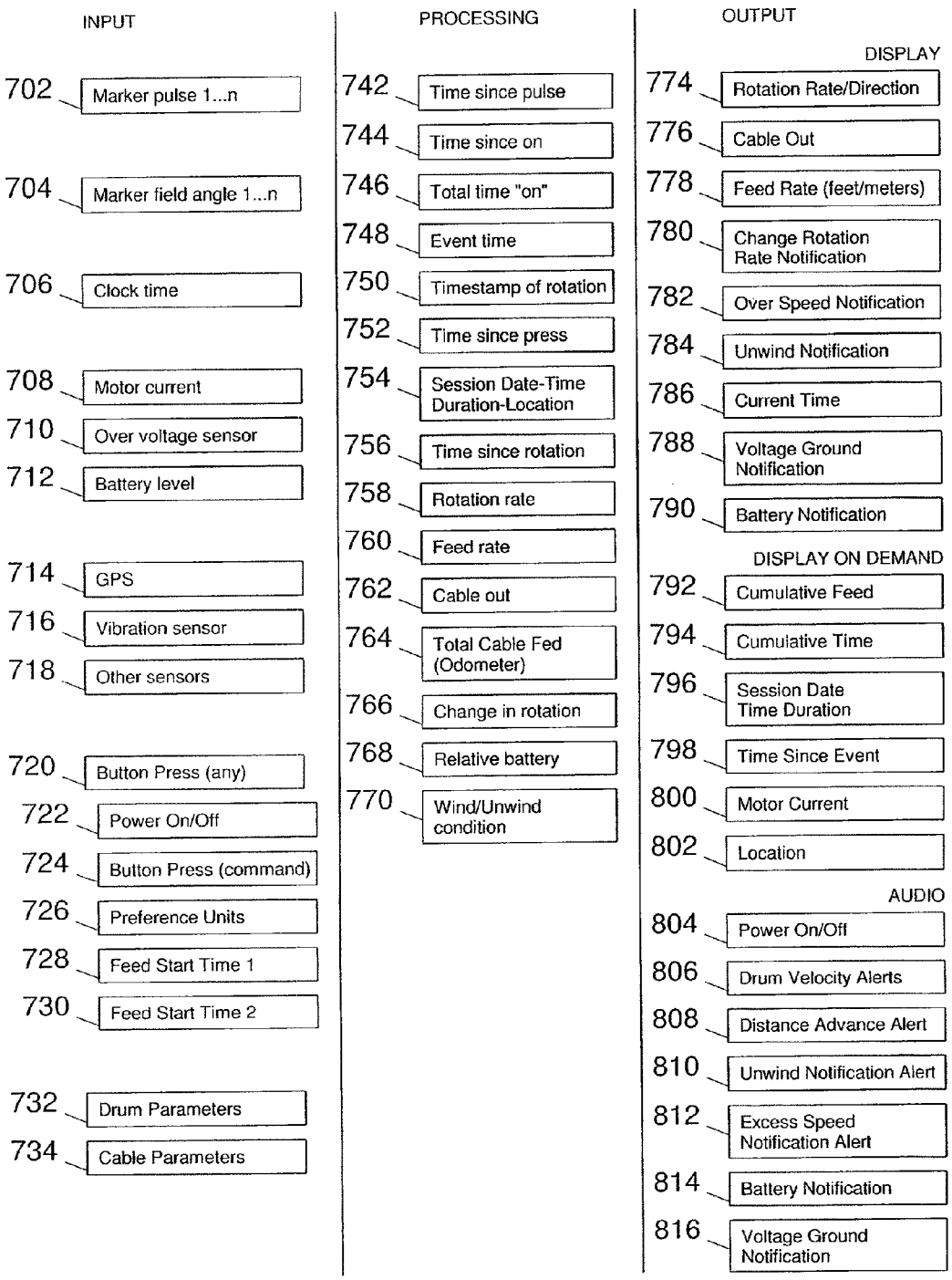
FIG. 25 is a diagram of various processor functions associated with another preferred method of the present invention.

In one embodiment of the present invention, marker detection pulses, and sensor information at various points in the system, are used as processor inputs to allow the system to compute, store and display information of interest. In such a configuration, the device, for example, may indicate a notification if one or both of the outer drum and the inner drum suddenly changes rotation rate, or rotates too rapidly. Referring to FIG. 25, a schematic of inputs, processing routines and display options is provided. Processor inputs include marker pulses 702 as previously described and detected marker field angles 704 as well as a system clock signal 706. Electrical sensors provide inputs reflecting motor current 708, overvoltage 710, battery level 712, vibration 716, acoustic levels 718, and other inputs such as GPS data 714, inertial navigation data, etc.

Inputs from the control panel or user interface include, but are not limited to, button presses or actuator signals 720, power switch presses 722, commands 724, input preference choices as to display units 726, tags marking a specific start point for measuring (728, 730) and parameters defining the drum size 732 and cable diameter and length 734. Vibration data from the sensor 716 may be used to determine if the unit is off-balance, or in need of service. Acoustical data from the sensor 718 may be similarly used. As will be clear to one versed in the art, additional sensor and computations may be added according to design or need.

In another preferred embodiment, these inputs can be stored in memory or written to permanent data storage in a commonly used device such as a hard disk, thumb drive or SD card (not shown). User data files written to such storage means may include time and date and duration of each usage as well as any other designated parameters that the system can measure. Based on these stored data, computations of interest can be algorithmically executed. These can include time since the last pulse 742 from a marker, time since power was switched on 744, total time on (cumulative) 746, time of a flagged event 748 or since last rotation 750, time since last button press 752, a date-time stamp for the session 754, time since rotation 756, computed rate of rotation 758, computed feed rate 760, length of cable fed out 762, total cable fed (cumulative odometer) 764, change of rotation direction 766, battery strength remaining 768, and detection of a potential unwind condition 770. Referring still to FIG. 25, system audio or visual display signals and data derived from the above computations are used to provide operating data to the user. Depending on configuration and the condition of operation, these may include an indicator of rotation rate and direction 774, a display of cable out 776, rate of feed in feet or meters 778, a notification if rotation change rate exceeds a designated maximum 780 or of excessive rotational speed 782.

Notifications as appropriate may be displayed for a state in which the cable is unwinding 784. Current data/time 786 is normally displayed. Notifications may be displayed for a sensed voltage/grounding fault 788, or a low-battery condition 790. Audible signals indicating length of cable feed may also be used to inform the system operator while his/her attention is not on the display. An auto-shutdown capability based on elapsed time since the last control input, or the last rotation, is incorporated in the preferred embodiment.

In another aspect of the current invention, selected data is available on user demand which would not be normally displayed in operation, such as cumulative totals of cable fed 792, time in operation 794, session duration 796, time since a designated flagged event 798, or present motor current level 800. In one embodiment of the present invention, the system is equipped with a GPS chip which can provide location 802.

In another aspect of the present invention, audio notification signals are controlled algorithmically to indicate important conditions or events. These may include, for example, power on or off 804, audible signals alerting the operator to drum velocity 806, timed audible signals indicating distance-advance of the cable 808, a predefined alert tone for an unwind condition 810 or excessive speed 812, low battery 814, or a voltage/grounding alert 816.

Figure 26:
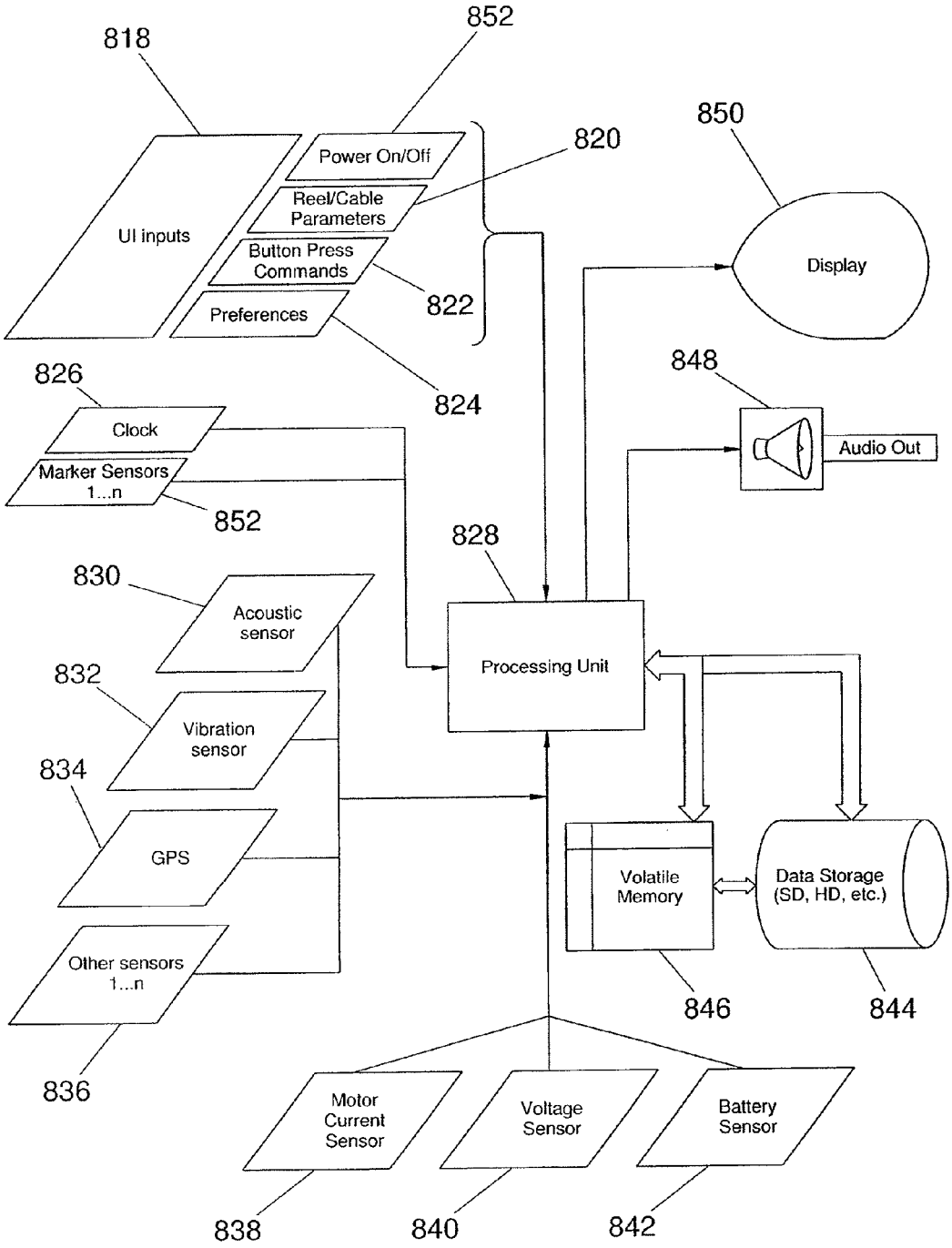
FIG. 26 is a block diagram of various aspects of a preferred embodiment system in accordance with the present invention.

Turning now to FIG. 26, a block diagram of various functions in accordance with the present invention is provided. In FIG. 26, a central processor 828 receives inputs from the User Interface 818 including power on/off events 852, input parameters describing reel and cable dimensions 820, button press or other actuator information 822, and preference inputs 824. The central processing unit 828 receives clock signals 826 and signals of marker events from the one or more marker sensors 852.

Additional sensors whose information is provided to the central processing unit 828 may include acoustic sensors 830, vibration sensors 832, GPS information 834, and other sensors 836 as may be known to one skilled in the art. Electrical state data is provided to the central processing unit 828 by motor current sensor 838, voltage/ground fault sensors 840 and battery level sensor 842.

Further in FIG. 26, volatile memory 846 is used for dynamic data processing by central processing unit 828 while system and session history may also be written to permanent memory 844 in the form of a hard disk, removable SD card, thumb drive or similar storage device. Display of user information is formatted by the central processing unit 828 and displayed on the system's display unit 850 which may be an LCD or other similar means of visual display. Audible alerts generated algorithmically by the central processing unit 828 are sent to an audio speaker 848 to provide operator audible alerts as described in FIG. 25.

Figure 39:
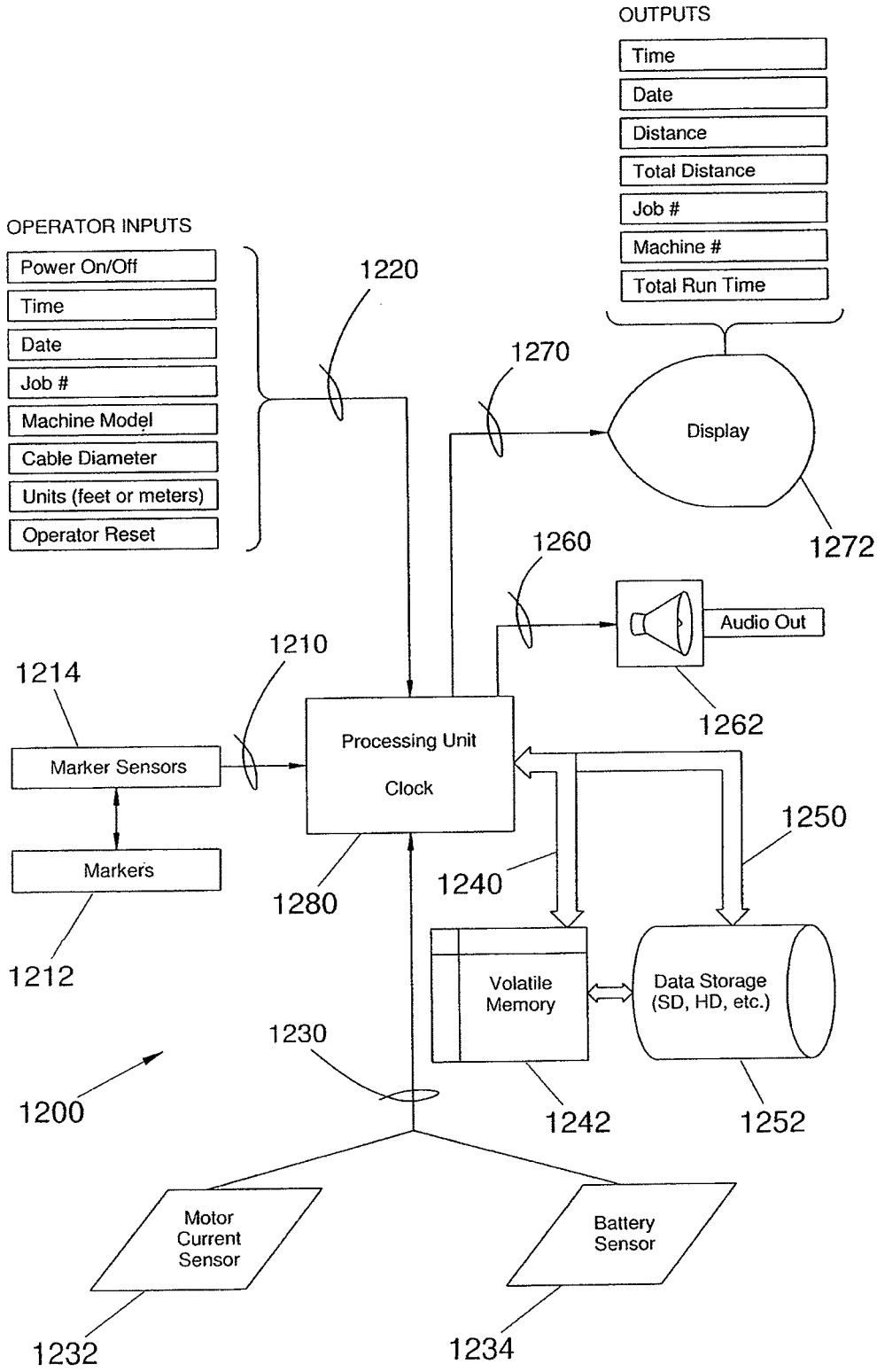
FIG. 39 is a block diagram of various aspects of another preferred embodiment cable monitoring system in accordance with the present invention.

FIG. 39 is a block diagram illustrating another preferred configuration for a cable monitoring system as described herein. FIG. 39 illustrates a cable monitoring system 1200 comprising one or more markers 1212 and corresponding sensors 1214. The sensor(s) 1214 provide signals 1210 to a processing unit 1280. As previously explained herein, the signals 1210 provide information as to the relative rotation between an outer drum and an inner drum or cable guide member. One or more operator inputs or other external inputs represented by item 1220 are also provided to the processor 1280. Examples of operator inputs include, but are not limited to, a power on/off selector, input for setting the time, input for setting the date, input for inputting a job number or other job parameters, input for entering the machine model or other calibration factors, input for entering cable diameter and like properties, input for units for indication such as English or metric units, and input for operator initiated resets. The system 1200 may also accept inputs 1230 relating to other aspects of the drain cleaning machine or the cable monitoring system. Such as for example, input 1232 may provide information concerning the motor current sensor and input 1234 can provide information relating to remaining battery life. Both inputs can be directed to the processing unit 1280.

The system 1200 also preferably includes provisions for data storage and processing generally depicted as items 1240 and 1250, which can be facilitated by a volatile memory 1242. The system 1200 also preferably includes one or more non-volatile memories such as depicted by 1252.

The processor 1280 determines one or more parameters such as total time of the current job, total distance of cable payed out, cumulative distance of payed out cable over a selected basis such as job or time period, and the like. These parameters are then output as outputs 1270 which can be visually indicated by display 1272. Other information may also be indicated at the display 1272 such as for example, current time and date, job number, machine number, etc. The processor 1280 may also provide one or more outputs 1260 for notification or activating notification devices or indicators, such as an audible alarm 1262.

Additional preferred functional features of the various cable monitoring systems include, but are not limited to, a cable length indicator which preferably indicates length of cable that is extended from the drain cleaning machine. The system should provide indication in either English or metric units, and have provisions for storing and displaying date and time, and job number or other reference information. As noted, it is preferred that the sensor array and/or corresponding processing unit have sufficient memory and/or data storage provisions to facilitate data storage for at least about 50 jobs while still retaining additional memory for another 10 to 20 typical jobs. The sensor unit is preferably battery powered and has provisions for automatic shut off during periods of non-use.

Detection of Reverse Rotation of Cable

An undesirable situation that can be readily detected by the present invention cable monitoring system is prolonged improper rotation of the cable. As will be appreciated by those skilled in the art, instances may occur when a drain cleaning cable becomes bound during operation. Frequently, operators may reverse the direction of rotation of the cable in an attempt to dislodge or free the cable. This practice is well known and can effectively free an otherwise bound cable. However, sometimes an operator will continue to use the drain cleaning machine while the cable is being rotated in a direction that is opposite from the direction of rotation intended for use of the cable. This can result in damage to the cable. Accordingly, the present invention cable monitoring systems can provide a notification or other indication that the cable is being rotated in reverse. Specifically, in a preferred method of detecting a cable reverse rotation condition, data is input to a processor such as a processor of a cable monitoring system as described herein. The data includes information as to the direction of cable rotation during normal use of the device. The data may also include information as to the cable, its properties, and its intended direction of rotation. The method then involves sensing the direction of rotation of the inner and outer drums and providing this information to the processor. The system, i.e. the processor, then compares the sensed direction of rotation of the inner and outer drums to the normal direction of cable rotation. If the compared directions are different from one another, then the system outputs a signal indicating the existence of a cable reverse rotation condition.

It is also preferred that the notification signal be triggered only when reverse cable rotation is detected for a period of time greater than some preset or predetermined time period. This would allow the practice of operators to momentarily reverse direction of bound cables in order to dislodge the cable without causing a reverse rotation alarm. Preferred time periods include at least 10 seconds, preferably at least 20 seconds, and most preferably at least 30 seconds. The present invention includes a wide range of variations of this detection strategy.

The preferred embodiment cable monitoring system using magnetic markers can readily detect opposite rotation of the inner drum and the outer drum as would occur during reverse rotation of the cable. Most preferably, it is preferred to use a three-axis magnetic sensor array as it can not only sense passing of magnetic markers, but also the direction of their movement.

Detection of Cable Loading Condition

A condition that may occur when using a powered rotary drum drain cleaning device is "cable loading." In this condition, a rotating drain cleaning cable may encounter a blockage or other obstruction(s) which can suddenly restrict rotation of the cable. Upon binding of the cable end resulting in no rotation of the cable end, the machine-end of the cable is still undergoing rotation. As will be appreciated, this condition is undesirable.

Various techniques have been used to detect a cable loading condition such as excessive current draw of the motor. Other strategies do not attempt to detect such conditions and instead, use manual methods such as hand feeding the cable rather than applying power to prevent over-stressing of the cable.

In accordance with the present invention, various preferred embodiments are provided that enable early detection of cable loading conditions and in many instances, prediction of cable loading conditions before occurrence of such. The prediction, detection and analysis of cable loading in accordance with the present invention compares the rotation of the outer drum to that of the inner drum and depending upon the type of cable, its properties, and the length of cable payed out, indicates or signals a cable loading condition if the rotational velocity or rate of rotation of the inner drum, as compared to that of the outer drum, falls below a preselected or determined value. Most preferably, the instantaneous rotation rate differential between the outer drum and the inner drum is determined by a sensor system as described herein. The threshold value can originate from operator input or from communication with another device, or can be determined by the processor. For example, this threshold value may be calculated or otherwise determined during the particular job or operation of the drain cleaning device using information specific to that job or cable. The threshold value is preferably a permissible rotational difference between the outer drum and the inner drum. Preferably, the permissible rotation difference is an allowable rotational rate differential between the outer drum and the inner drum. A cable loading condition can be detected by comparing the instantaneous rotational rate differential between the outer and inner drums with the allowable rotational rate differential between the outer and inner drums. If the instantaneous rotational rate differential is less than the allowable rotational rate differential, then a cable loading condition is occurring or very likely will occur.

A cable loading condition is most preferably predicted and/or detected during a drain cleaning operation when the cable is being payed out at a fixed or constant rate. Typically, this condition, often referred to as a "fixed feed rate," is set by appropriate adjustment of the cable feeding mechanism, such as identified by item 18 in FIG. 1.

It is also preferred that prediction and/or detection of a cable loading condition be implemented in drain cleaning devices using a universal electric motor as opposed to an induction motor. A universal motor is predominantly used in drain cleaning machines. As will be appreciated, a universal motor enables change in motor speed and thus change in speed of cable rotation and cable pay out, depending upon the adjustment and setting of the cable feed mechanism. Once a constant cable feed or pay out rate is attained, the speed of a universal motor should be relatively constant. In the event of a distal end of the cable becoming bound during a drain cleaning operation, the stoppage or at least decrease in the rate of rotation of the cable will be transmitted along the length of the cable to the machine and will result in a reduction in the rate of rotation of the inner drum. The cable monitoring systems described herein can detect this change, i.e. reduction, in the rate of rotation of the inner drum. More preferably, a significant and reliable indicator of a cable loading condition is obtained by comparing the change in relative rates of rotation between the inner drum and the outer drum. A sudden decrease in the rate of rotation of the inner drum as compared to the rate of rotation of the outer drum can indicate a cable loading condition.

A prime reason why the cable loading prediction and/or detection method as described herein is not particularly preferred for use with drain cleaning machines using induction motors is because, as will be appreciated by those skilled in the art, output speeds of induction motors are relatively constant. Hence, even in a cable loading situation, the inner drum will continue to rotate at the same or substantially the same speed prior to binding of the cable distal end. Thus, for machines using induction motors, it is preferred to predict and/or detect a potential cable loading condition by monitoring electrical current draw of the motor and in particular, any sudden large increases in current consumption. However, it is to be appreciated that the present invention system may still find application in conjunction with drain cleaning machines using induction motors. For example, the present invention system can be used to detect, measure, and provide information concerning cable rotational speed in machines using induction motors. The present invention will find wide application and use in drain cleaning machines using a range of motors including induction motors and permanent magnet DC motors.

As noted, a cable loading condition can be predicted and/or identified by comparing the rotational velocities of the outer drum and the inner drum. Use of these values, their comparison, and potentially their cumulative summed values over a time period of interest may also provide indication as to a cable loading condition. The present invention in no way is limited to these prediction and/or detection strategies. That is, the present invention includes other techniques for predicting and/or identifying a cable loading condition.

In particular, for certain drain cleaning machines, upon occurrence of a cable loading condition, the outer drum rotational velocity changes relatively slowly due to the inertial mass of the drum and its contents, i.e. the cable coiled inside. An induction motor would strive to maintain a certain velocity of the outer drum. As a cable loading condition is occurring, it is likely that one or more sudden, quick, and very brief relative motions between the inner drum and the outer drum would occur, in which the motions would vary with torque loadings. Thus, a cable loading condition can be sensed by identifying relative accelerations (or decelerations) that occur both in the rotations of the drums as well as in the differences between the motions of the drums.

Upon detection of a cable loading condition, the drain cleaning device is preferably either shut down automatically, or an audible or visual notification signal is provided indicating this condition. Initiation of other actions or communications to an operator may also occur upon detection of a cable loading condition.

The present invention also includes strategies in which a device shut-down or operation termination is initiated by analysis or simple receipt of a combination of control signals, including a cable loading condition signal. For example, device shut down may occur upon occurrence of one or more of (i) a cable loading condition as described herein, (ii) excessive current draw by the motor, (iii) reduced drum speed, and (iv) prolonged reverse rotation of the cable. Other detection and shut down strategies are contemplated.

As will be appreciated by those skilled in the art, sometimes operators in the field may "hand strip" a cable from a drain cleaning machine. Generally, this involves the operator manually pulling cable from the machine. Manually pulling cable will cause the inner and outer drums to rotate. In view of this and the typically non-constant manner by which cable is pulled from the machine, it is likely that one or more notifications may be triggered indicating that a cable loading condition is occurring or about to occur. Such false alarm can be avoided by the control system or processor, checking the amount of current draw of the motor.

The present invention cable monitoring system can be incorporated with a wide array of drain cleaning devices. The primary characteristics of a drain cleaning device contemplated for use with or retrofitting with the cable monitoring system is that the device include a rotatable outer drum or equivalent component(s), and a rotatable inner drum or guide tube or equivalent component(s). Examples of drain cleaning devices that are suitable candidates for receiving or being retrofitted with the present invention cable monitoring system include, but are not limited to, ¾ inch drum machines such as model K-7500 available from Ridgid®. As will be understood by those skilled in the art, the term "¾ inch drum machine" refers to rotary drain cleaning machines typically utilizing a ¾ inch drain cleaning cable (which is associated with and generally stored in a dedicated drum member). Frequently, for a given size drum machine, a range of cable sizes may be used. For example, a ¾ inch drum machine may also use a ⅝ inch cable in certain instances. Additional examples of drain cleaning machines that are suitable candidates for receiving or being retrofitted with the present invention cable monitoring system include, but are not limited to ⅝ inch drum machines such as model K-6200 available from Ridgid®, and ½ inch drum machines such as model K-3800 available from Ridgid®. In addition to drain cleaning devices in which a belt is used to rotate a drum, the present invention is also applicable to drain cleaning devices free of belts, such as drain cleaning devices using direct drives to rotate drums.

Testing

A series of investigations were conducted to evaluate the parameters involved in measuring length of cable payed out and how such measurement can be made by monitoring relative rotation of rotating components of several commercially available drain cleaning devices. Specifically, three models of drain cleaning machines available from the present Assignee under the designations K-7500, K-6200, and K-3800 were analyzed as follows. Specifically, a total of six (6) identification scores corresponding to magnetic markers as described herein, were equidistantly spaced about the outer periphery of an outer drum component of each machine. Thus, for a drum equipped with markers located at the location of the scores, an angular displacement of 60° (since there were six scores equidistantly located about the outer drum) would be indicated by a single signal output from a sensor, i.e. a "count." For example, a total of three counts output from the sensor would indicate a change in angular displacement of 180° between the two rotating components. A single score was located on an outer surface of a guide tube or inner drum member of each machine. That single score represented a location of another marker or a sensor.

Example 1

Figure 28:
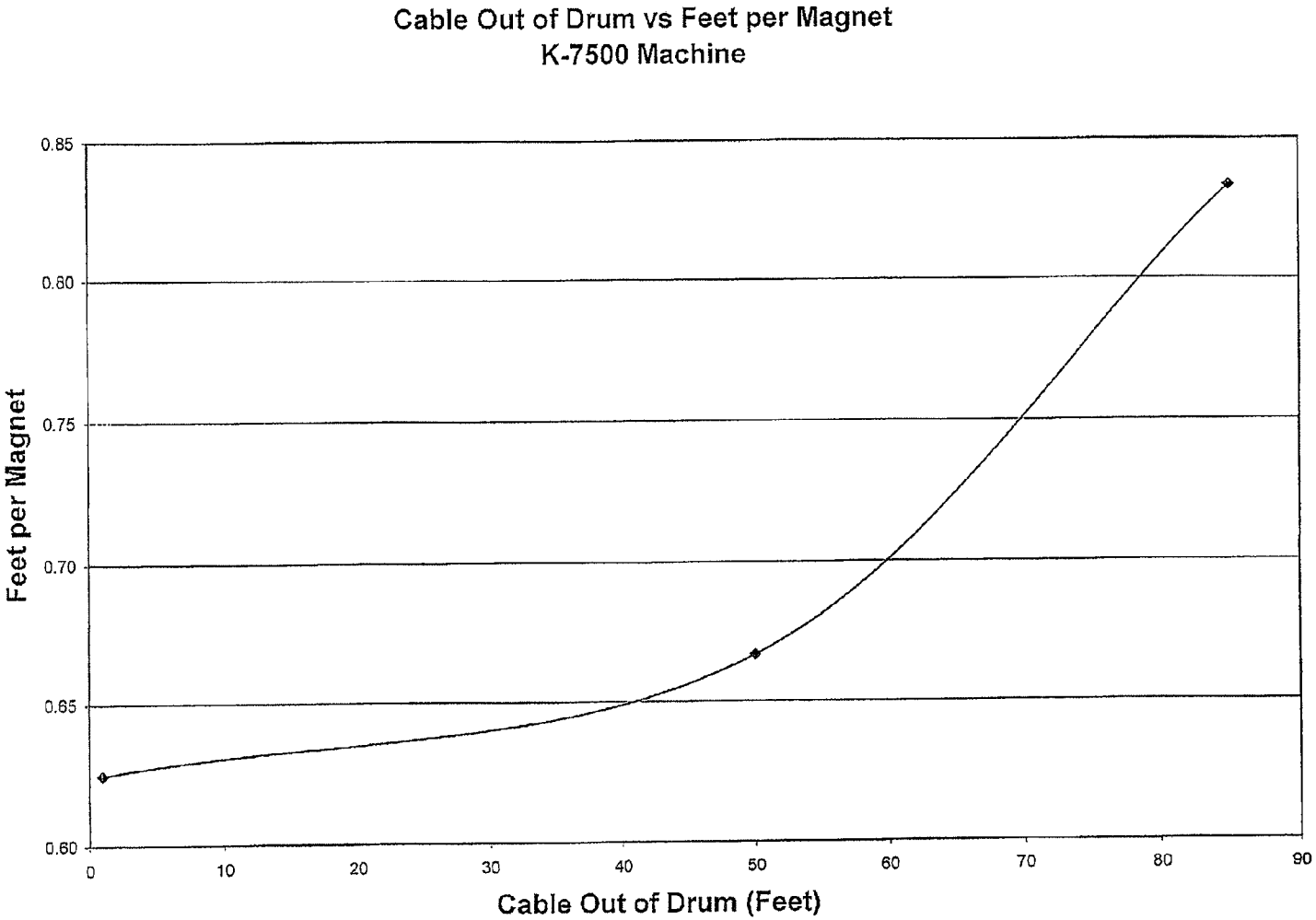
FIG. 28 is a graph illustrating change in linear feet of cable displacement per a particular angular displacement between two rotating components of a drain cleaning device, as the amount of cable payed out from the device changes.

In one trial, involving the K-7500 machine, the cable was first fully retracted into the machine. Then, cable was payed out from the machine. As will be understood, both the outer drum and the guide tube member underwent rotation during cable pay out. The relative rotation between these two components was then measured by monitoring the number of passes between a score on the outer drum and a score on the guide tube. At the beginning of cable pay out, the linear amount of cable pay out between scores was about 0.63 feet. At a cable pay out of 50 feet of cable, the linear amount of cable pay out between scores was about 0.67 feet. As cable was further payed out from the K-7500 machine, the amount of cable pay out between scores increased to about 0.83 feet after 85 feet of cable had been payed out of the machine. The change in linear displacement of cable per an angular displacement of 60° between the rotating components, as a function of total cable pay out is illustrated in FIG. 28.

Figure 29:
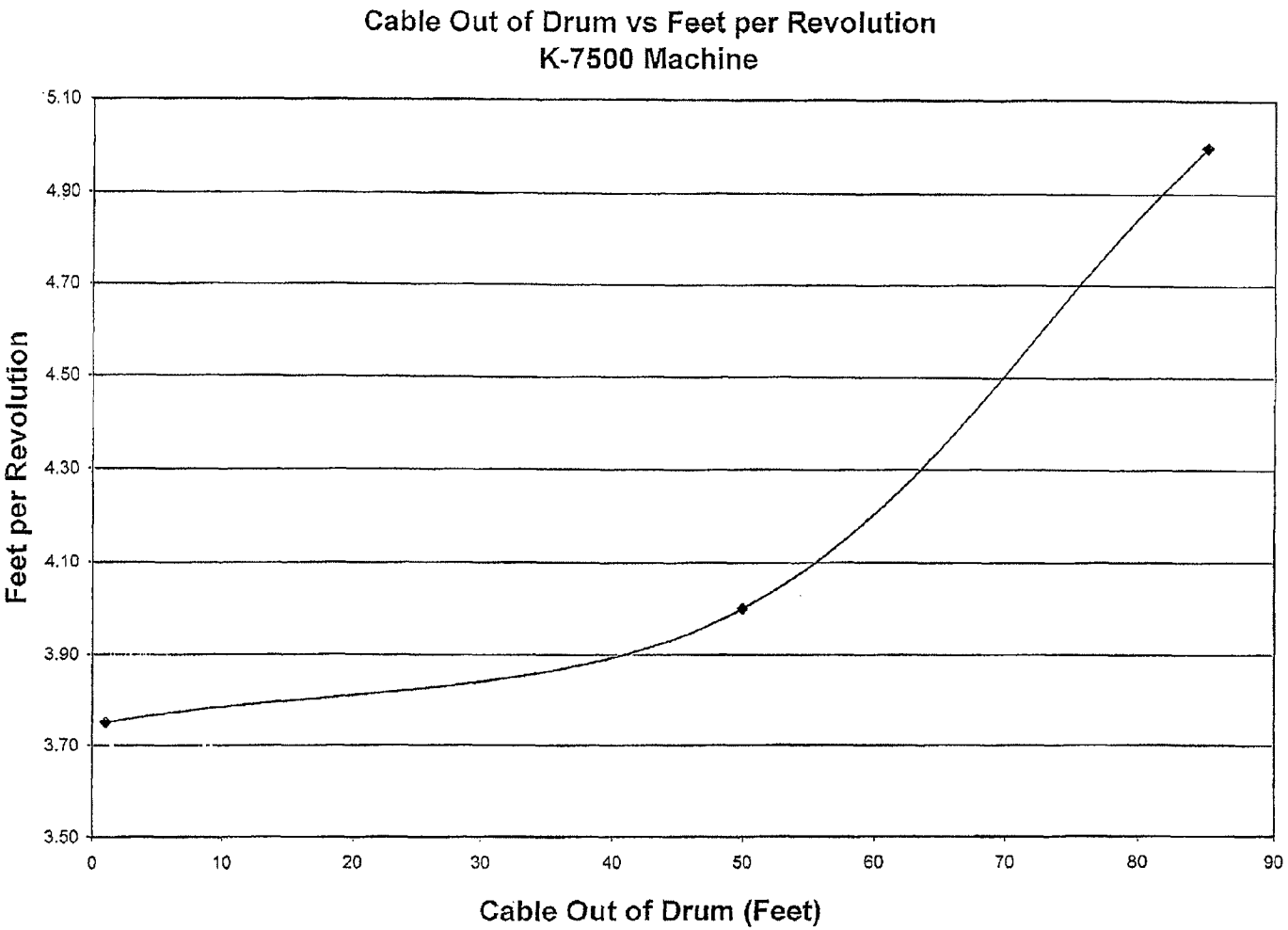
FIG. 29 is a graph illustrating change in linear feet of cable displacement per one rotational difference between two rotating components of the drain cleaning device referenced in FIG. 28, as the amount of cable payed out from the device changes.

Using the same K-7500 machine marked as previously described, another investigation was conducted. After fully retracting the cable into the rotary drum of the machine, the length of cable payed out per one rotation between the two components was then measured over the course of cable pay out. This investigation was similar to the previously described investigation; however instead of monitoring passes between scores, a single complete rotation of the guide tube relative to the outer drum was targeted. At the beginning of the trial, for every single rotation of the guide tube relative to the outer drum, approximately 3.75 feet of cable were payed out. At a cable pay out of about 50 feet, for a single relative rotation between the two components, about 4 feet of cable was payed out. Pay out of cable was continued and at approximately 85 feet of cable having been payed out, for a single relative rotation between the two noted components, 5 feet of cable was payed out. The change in linear feet of cable displacement per single rotational difference between outer drum and guide tube as a function of total cable pay out is illustrated in FIG. 29.

Figure 30:
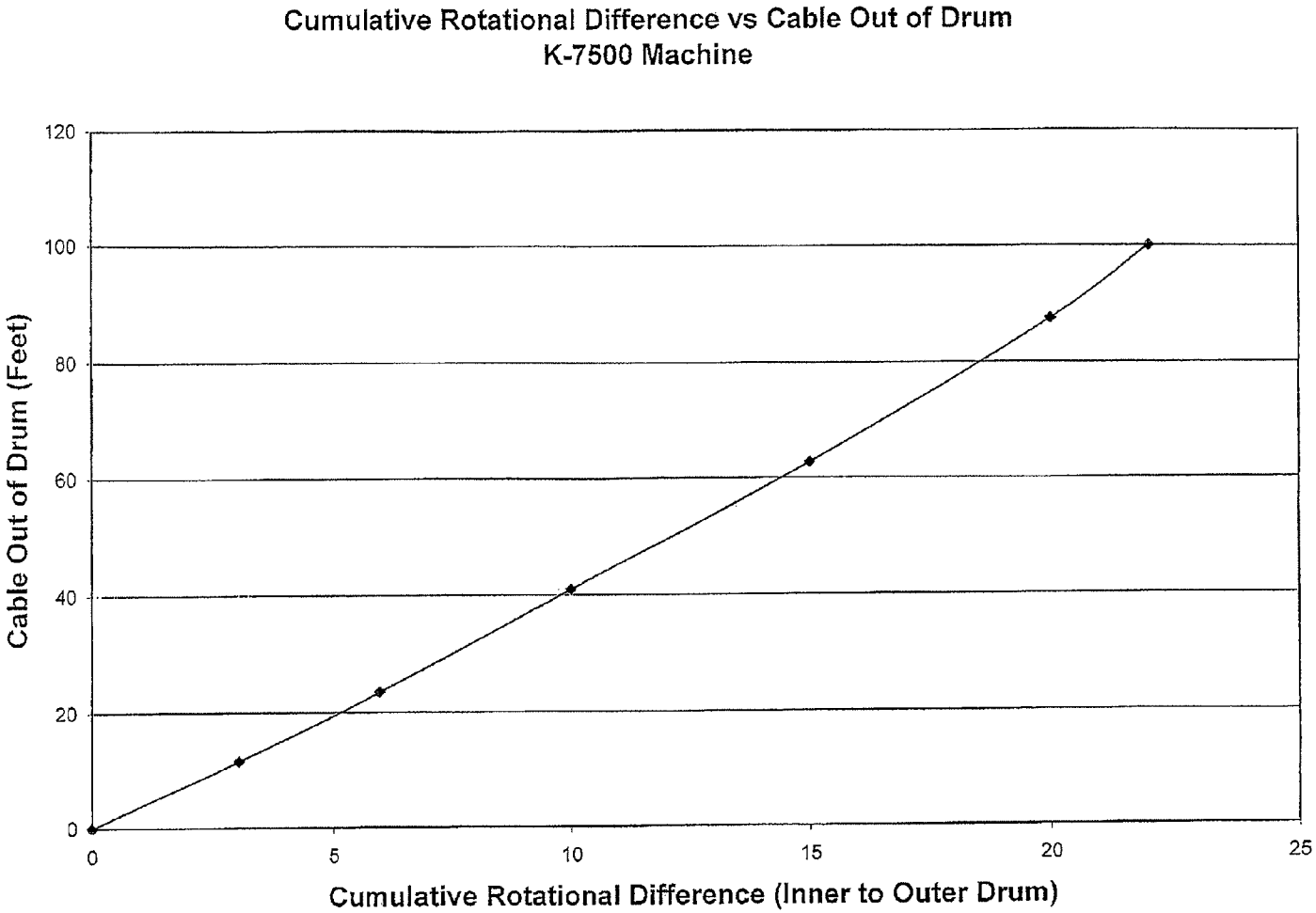
FIG. 30 is a graph illustrating the relationship between the amount of cable payed out and the cumulative rotational difference between two rotating components of the drain cleaning device referenced in FIGS. 28 and 29.

Yet another investigation conducted using the noted K-7500 machine. In this investigation, the cumulative rotational difference between the inner drum and the outer drum was measured over the course of cable pay out. At the beginning of the investigation, after about 3 cumulative rotations of the inner drum to the outer drum, approximately 11 feet of cable had been payed out from the device. After about 20 cumulative rotations of the inner drum to the outer drum, approximately 88 feet of cable had been payed out. The results of this investigation are illustrated in FIG. 30.

The various relationships between the relative rotation between the outer drum and the inner drum or guide tube, and length of cable pay out, and the change in these relationships over the course of cable pay out can be better understood by consideration of the following. When a cable is fully retracted into an outer drum, it is coiled about the interior of the drum and initially along an outer wall, as shown in FIGS. 2 and 5 for example. As cable is payed out of the outer drum, cable is drawn from the exposed interior of the coiled spool of cable. Thus, as cable is payed out and withdrawn from the spool, the span or diameter of the open interior, i.e. the "wrap diameter," increases. And so, as cable is payed out, the inner drum rotates less relative to the rotation of the outer drum because the effective diameter of the cable coil increases.

Example 2

Figure 31:
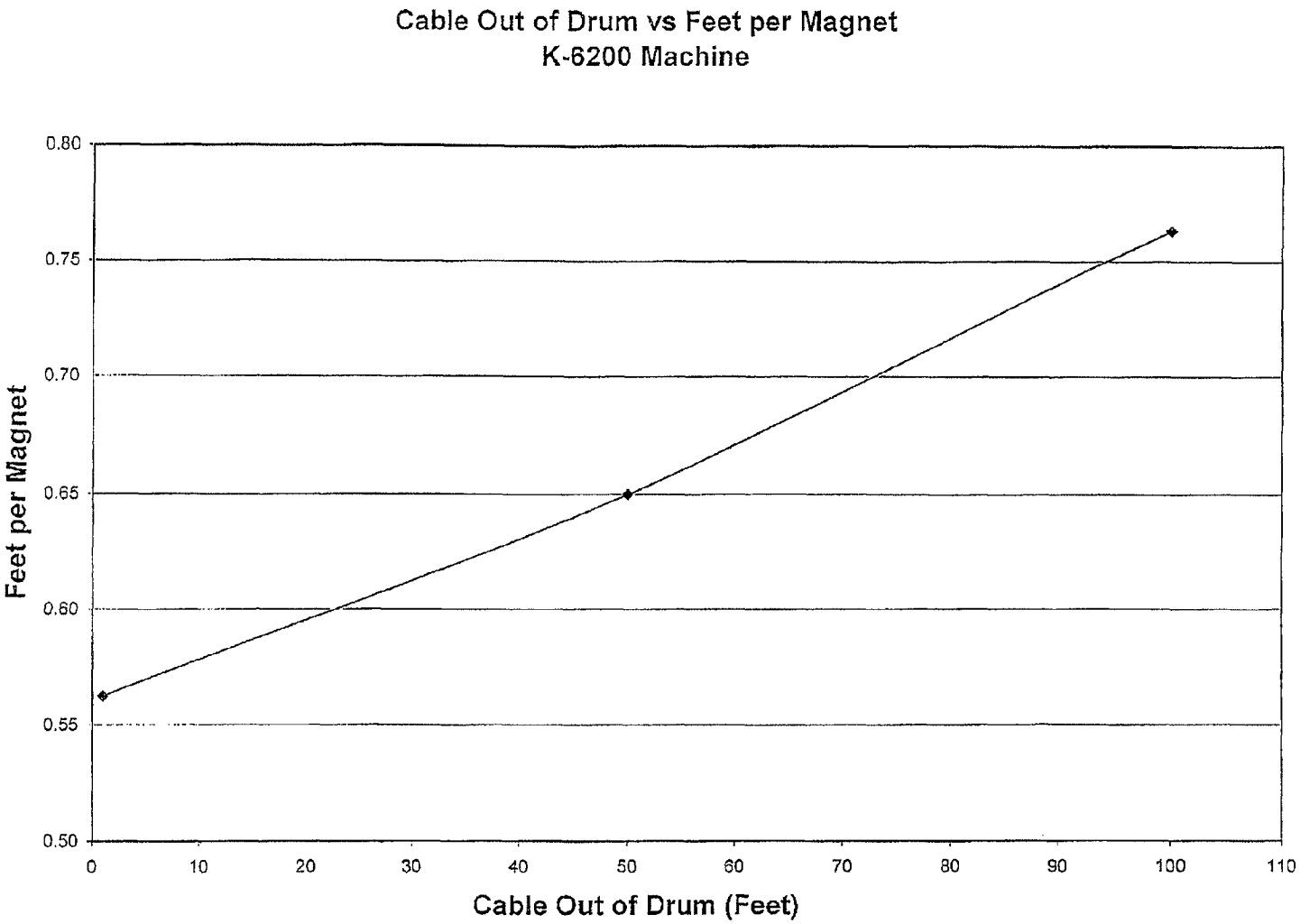
FIG. 31 is a graph illustrating change in linear feet of cable displacement per a particular angular displacement between two rotating components of another drain cleaning device, as the amount of cable payed out from the device changes.

In another trial, a K-6200 drain cleaning machine also available from the present Assignee, was scored as previously described with respect to the K-7500 machine. The cable was first fully retracted into the machine. Then, cable was payed out from the machine. As will be understood, both the outer drum and the guide tube member underwent rotation. The relative rotation between these two components was then measured by monitoring the number of passes between a score on the outer drum relative to a score on the guide tube. At the beginning of cable pay out, the linear amount of cable pay out between scores was about 0.56 feet. At a cable pay out of 50 feet of cable, the linear amount of cable pay out between scores was about 0.65 feet. As cable was further payed out from the K-6200 machine, the amount of cable pay out between scores increased to about 0.76 feet after 100 feet of cable had been payed out of the machine. The change in linear displacement of cable per an angular displacement of 60° between the rotating components, as a function of total cable pay out is illustrated in FIG. 31.

Figure 32:
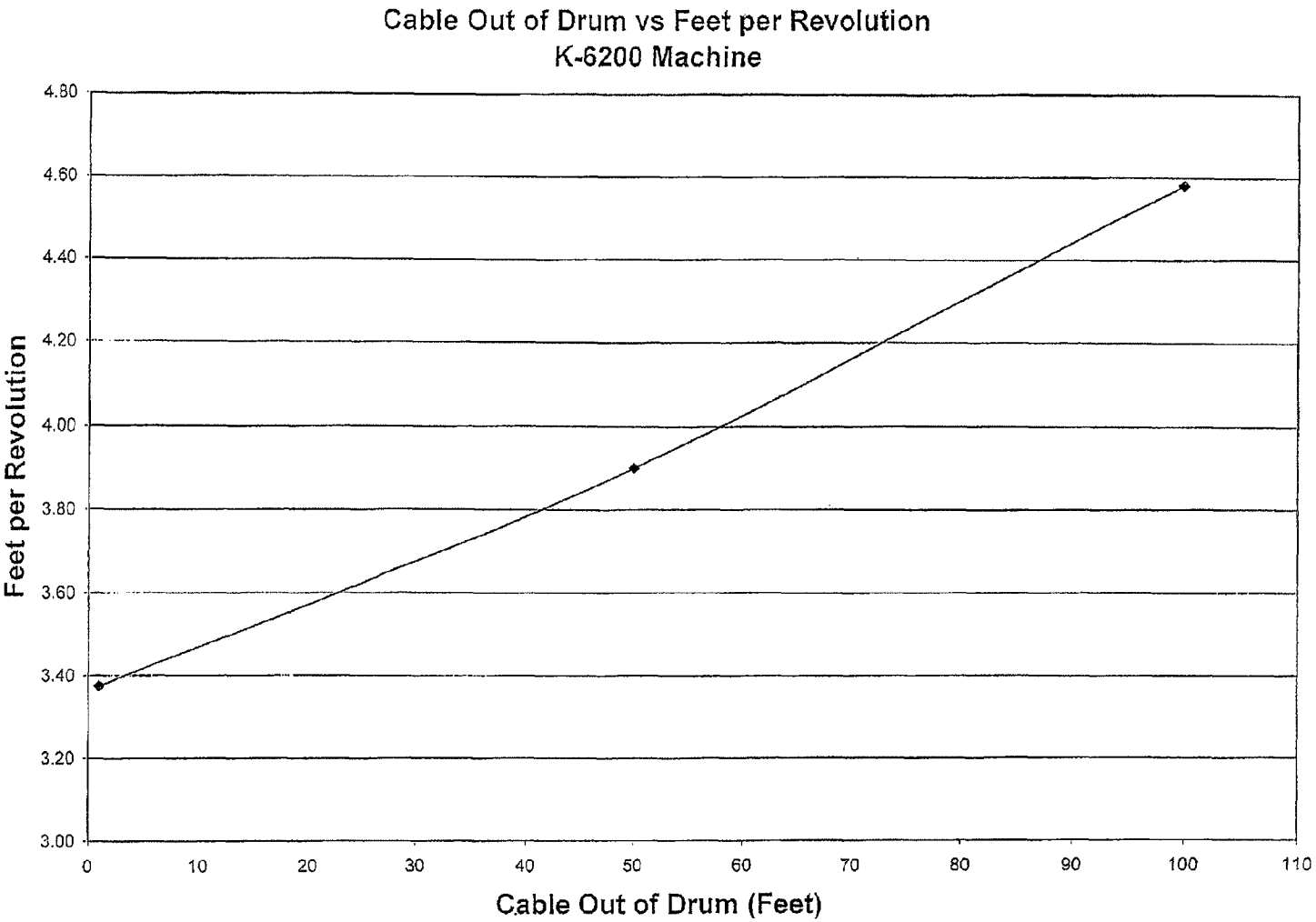
FIG. 32 is a graph illustrating change in linear feet of cable displacement per one rotational difference between two rotating components of the drain cleaning device referenced in FIG. 31, as the amount of cable payed out from the device changes.

Using the same K-6200 machine, another investigation was conducted. After fully retracting the cable into the rotary drum of the machine, the length of cable payed out per one rotation between the two components was then measured over the course of cable pay out. This investigation was similar to the previously described investigation using the K-7500 machine, however instead of monitoring passes between scores, a single complete rotation of the guide tube relative to the outer drum was reviewed. At the beginning of the trial, pay out of cable revealed that for every single rotation of the guide tube relative to the outer drum, approximately 3.38 feet of cable were payed out. At a cable pay out of about 50 feet, for a single relative rotation between the two components, about 3.9 feet of cable was payed out. Pay out of cable was continued and at approximately 100 feet of cable having been payed out, for a single relative rotation between the two noted components, 4.59 feet of cable was payed out. The change in linear feet of cable displacement per single rotational difference between outer drum and guide tube as a function of total cable pay out is illustrated in FIG. 32.

Figure 33:
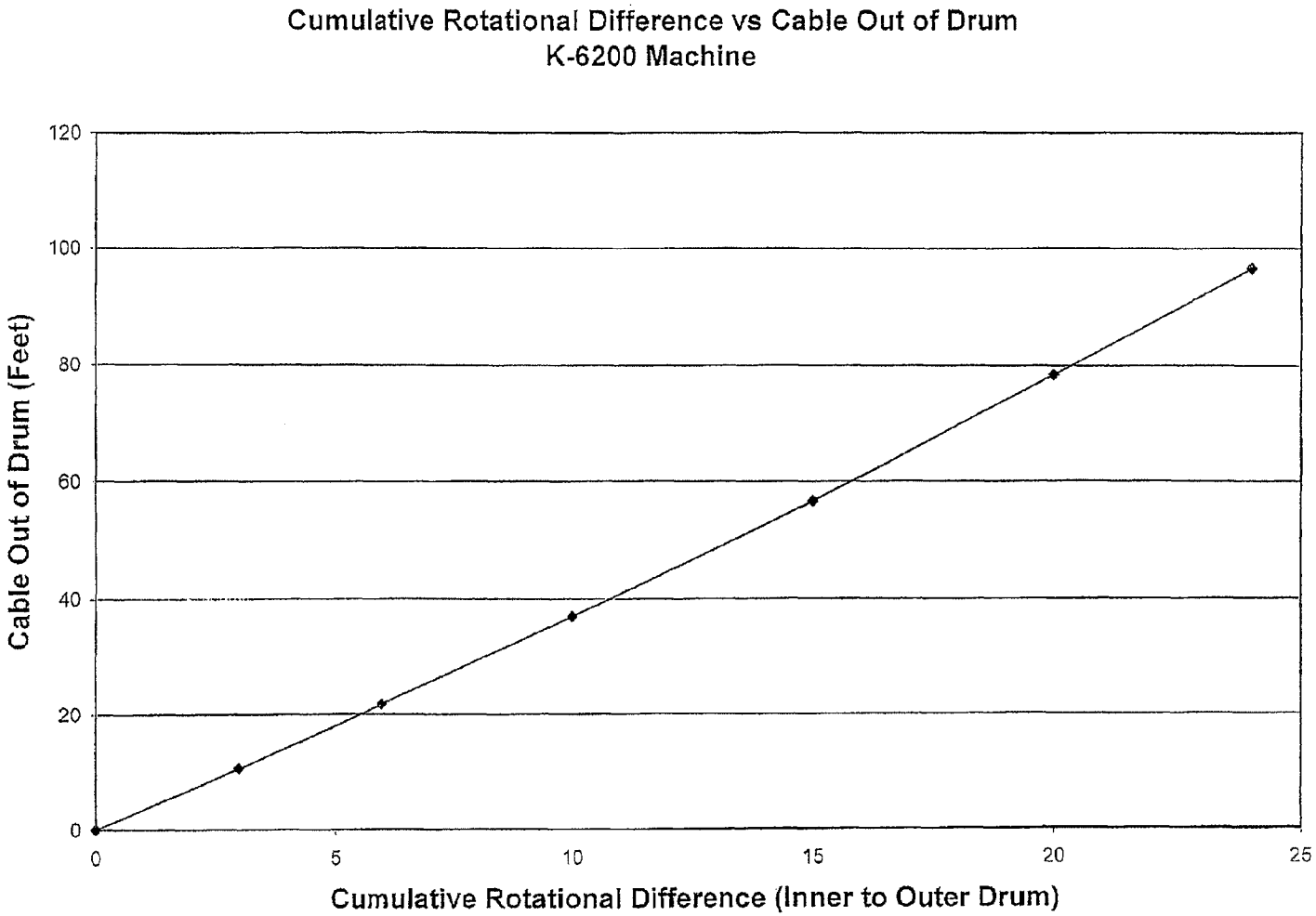
FIG. 33 is a graph illustrating the relationship between the amount of cable payed out and the cumulative rotational difference between two rotating components of the drain cleaning device referenced in FIGS. 31 and 32.

Yet another investigation conducted using the noted K-6200 machine. In this investigation, the cumulative rotational difference between the inner drum and the outer drum was measured over the course of cable pay out. At the beginning of the investigation, after about 3 cumulative rotations of the inner drum to the outer drum, approximately 10 feet of cable had been payed out from the device. After about 20 cumulative rotations of the inner drum to the outer drum, approximately 79 feet of cable had been payed out. The results of this investigation are illustrated in FIG. 33.

Example 3

Figure 34:
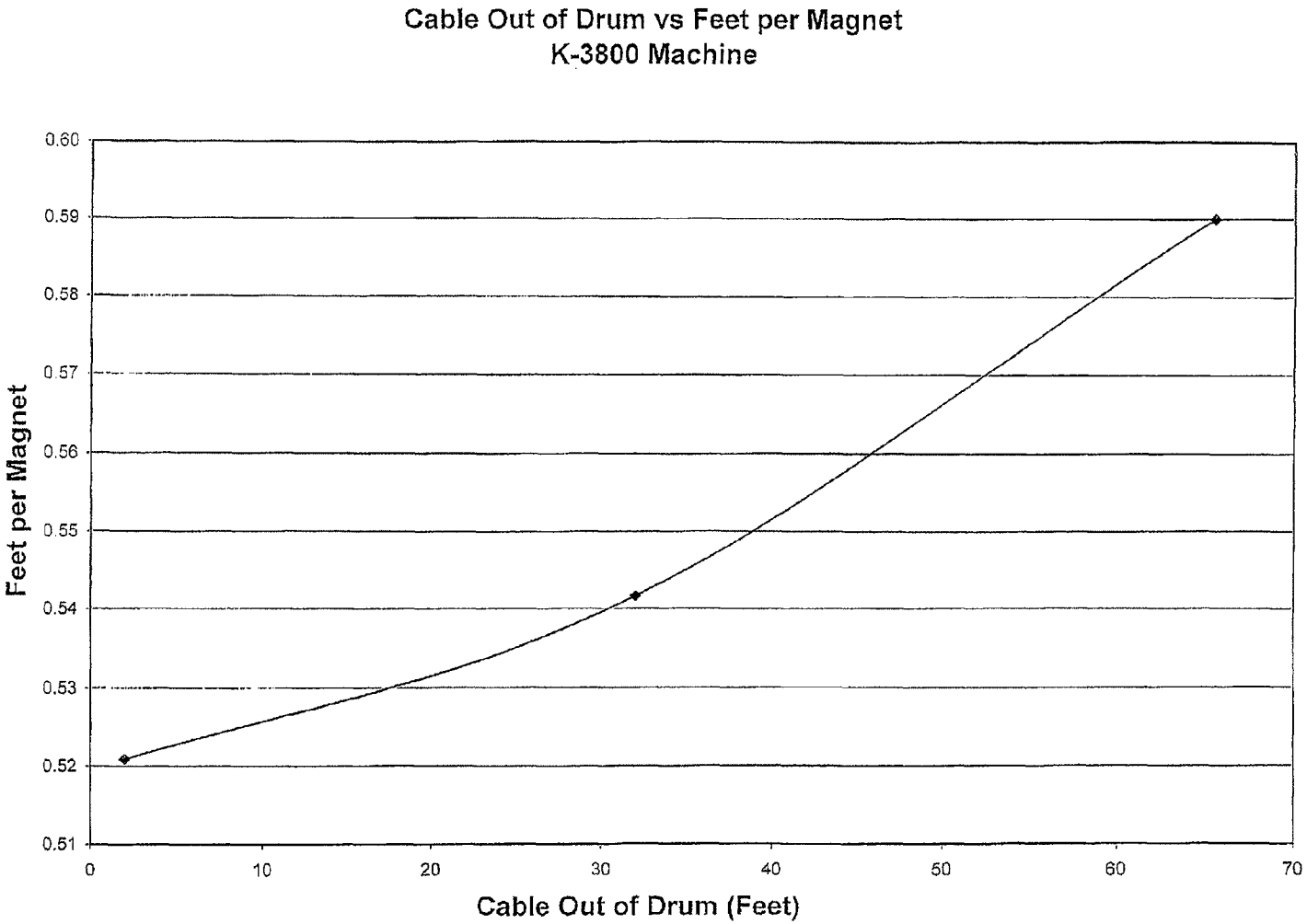
FIG. 34 is a graph illustrating change in linear feet of cable displacement per a particular angular displacement between two rotating components of another drain cleaning device, as the amount of cable payed out from the device changes.

In yet another trial, a K-3800 drain cleaning machine also available from the present Assignee, was scored as previously described with respect to the K-7500 and K-6200 machines. In this trial, the cable was first fully retracted into the machine. Then, cable was payed out from the machine. As will be understood, both the outer drum and the guide tube member underwent rotation. The relative rotation between these two components was then measured by monitoring the number of passes between a score on the outer drum relative to a score on the guide tube. At the beginning of cable pay out, the linear amount of cable pay out between scores was about 0.52 feet. At a cable pay out of about 32 feet, the linear amount of cable pay out between scores was about 0.54 feet. As cable was further payed out from the K-3800 machine, the amount of cable pay out between scores increased to about 0.59 feet after 65 feet of cable had been payed out of the machine. The change in linear displacement of cable per an angular displacement of 60° between the rotating components, as a function of total cable pay out is illustrated in FIG. 34.

Figure 35:
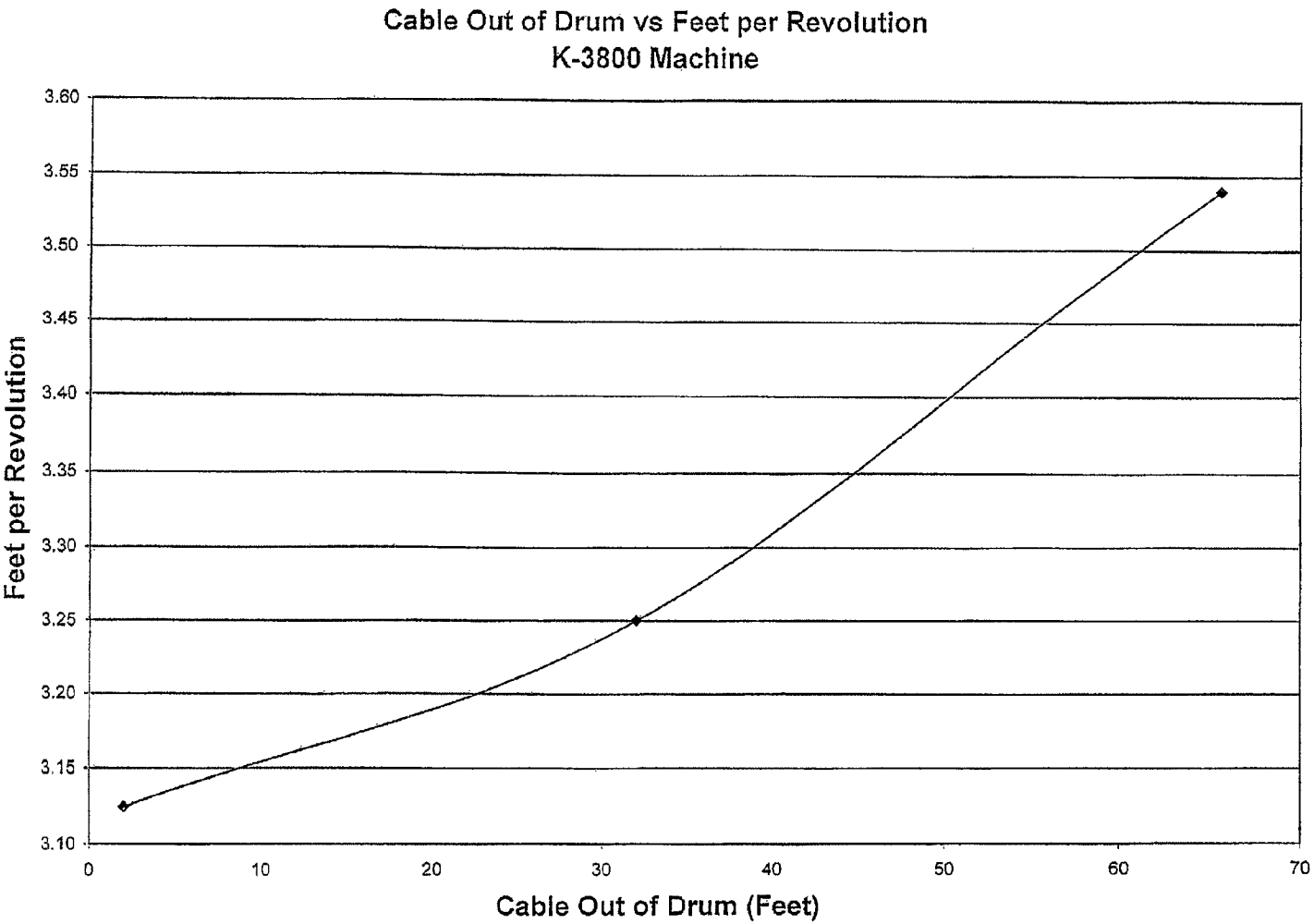
FIG. 35 is a graph illustrating change in linear feet of cable displacement per one rotational difference between two rotating components of the drain cleaning device referenced in FIG. 34, as the amount of cable payed out from the device changes.

Using the same K-3800 machine, another investigation was conducted. After fully retracting the cable into the rotary drum of the machine, the length of cable payed out per one rotation between the two components was then measured over the course of cable pay out. This investigation was similar to the previously described investigation, however instead of monitoring passes between scores, a single complete rotation of the guide tube relative to the outer drum was reviewed. At the beginning of the trial, pay out of cable revealed that for every single rotation of the guide tube relative to the outer drum, approximately 3.12 feet of cable were payed out. At a cable pay out of about 32 feet, for a single relative rotation between the two components, about 3.25 feet of cable was payed out. Pay out of cable was continued and at approximately 65 feet of cable having been payed out, for a single relative rotation between the two noted components, 3.54 feet of cable was payed out. The change in linear feet of cable displacement per single rotational difference between outer drum and guide tube as a function of total cable pay out is illustrated in FIG. 35.

Figure 36:
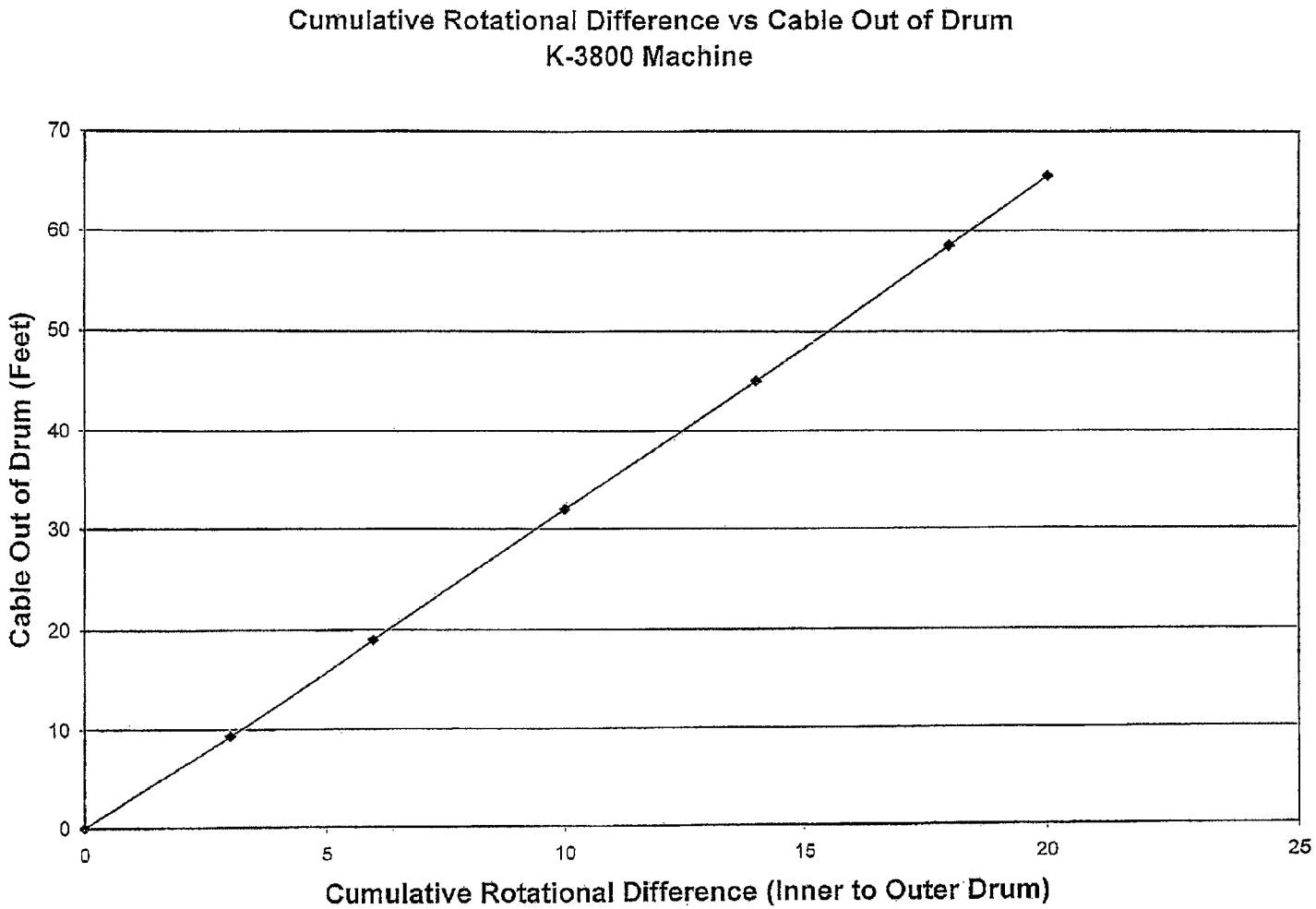
FIG. 36 is a graph illustrating the relationship between the amount of cable payed out and the cumulative rotational difference between two rotating components of the drain cleaning device referenced in FIGS. 34 and 35.

Yet another investigation conducted using the noted K-3800 machine. In this investigation, the cumulative rotational difference between the inner drum and the outer drum was measured over the course of cable pay out. At the beginning of the investigation, after about 3 cumulative rotations of the inner drum to the outer drum, approximately 9 feet of cable had been payed out from the device. After about 20 cumulative rotations of the inner drum to the outer drum, approximately 66 feet of cable had been payed out. The results of this investigation are illustrated in FIG. 36.

Determination of Cable Pay Out

The previous examples illustrate the relationship between relative rotation between the rotating components, i.e. an outer drum and an inner drum, and cable pay out. The examples also illustrate how this relationship depends upon the particular drain cleaning machine and its configuration. The actual determination of cable pay out is preferably performed by a processor. The determination can be algorithmically determined in several ways. For example, for a particular outer drum, inner drum, and cable combination, information as to the relationship between the number of relative rotations between the inner and outer drums and the amount of cable pay out is input to the processor. During use of the drain cleaning machine, the number of relative rotations is monitored and preferably measured by use of the sensor systems described herein. A look-up table, equation, or correction factor(s) may be used to then determine the extent of cable payed out based upon the number of relative rotations. As illustrated in the previously noted examples and FIGS. 28-36, the length of cable pay out needs to be corrected in order to account for the changing wrap diameters as the cable is retracted into and withdrawn from, the outer drum. As will be appreciated, these determinations are preferably performed by the processor using information and correction factors previously input or otherwise supplied to the processor.

It will be understood that any one or more features of the various embodiments described herein can be used in combination with any one or more other features of other embodiments described herein. That is, the present invention includes combinations of the various embodiments described herein.

All patents, patent applications, and publications identified herein are incorporated by reference in their entirety.

The exemplary embodiments have been described with reference to the preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A method for determining a length of cable extended or retracted relative to a rotary drum drain cleaning device, the device including (i) a frame assembly, (ii) a first rotatable member rotatably supported on the frame assembly, the first member defining an interior hollow region, (iii) a second rotatable member rotatably supported on at least one of the first rotatable member and the frame assembly, the second member defining a cable outlet, and (iv) a flexible cable at least partially disposed in the first member and extending through the cable outlet of the second member, the method comprising:

sensing relative rotational movement between the first member and the second member;

providing information regarding the sensed relative rotational movement to a processor; and the processor determining length of cable extended or retracted relative to the device based upon the information.

2. The method of claim 1 wherein sensing is performed by:

affixing at least one marker to the first rotatable member;

affixing at least one marker to the second rotatable member;

providing a sensor assembly adapted for sensing the at least one first marker and the at least one second marker.

3. The method of claim 1 wherein the information regarding the sensed relative rotational movement includes angular difference between rotation of the first member and rotation of the second member, the step of determining length of cable extended or retracted relative to the device performed by totaling the angular difference over a period of time.

* * * * *